US010895113B2

(12) United States Patent
Schaaf et al.

(10) Patent No.: US 10,895,113 B2
(45) Date of Patent: Jan. 19, 2021

(54) DRILLING SYSTEM, BIASING MECHANISM AND METHOD FOR DIRECTIONALLY DRILLING A BOREHOLE

(71) Applicant: B&W Mud Motors, LLC, Benbrook, TX (US)

(72) Inventors: Stuart Schaaf, Sugar Land, TX (US); Marcus D. Wernig, Orange, TX (US)

(73) Assignee: B&W Mud Motors, LLC, Benbrook, TX (US)

( * ) Notice: Subject to any disclaimer, the term of this patent is extended or adjusted under 35 U.S.C. 154(b) by 0 days.

(21) Appl. No.: 16/403,240

(22) Filed: May 3, 2019

(65) Prior Publication Data

US 2019/0257155 A1 Aug. 22, 2019

Related U.S. Application Data

(63) Continuation of application No. 15/376,887, filed on Dec. 13, 2016, now Pat. No. 10,301,877, which is a continuation of application No. 13/837,665, filed on Mar. 15, 2013, now Pat. No. 9,556,678.

(60) Provisional application No. 61/653,150, filed on May 30, 2012.

(51) Int. Cl.

| | |
|---|---|
| ***E21B 7/06*** | (2006.01) |
| ***E21B 44/00*** | (2006.01) |
| ***E21B 4/02*** | (2006.01) |
| *E21B 47/0228* | (2012.01) |

(52) U.S. Cl.

CPC ..... *E21B 7/068* (2013.01); *E21B 4/02* (2013.01); *E21B 7/06* (2013.01); *E21B 7/067* (2013.01); *E21B 44/005* (2013.01); *E21B 47/0228* (2020.05)

(58) Field of Classification Search

CPC ..... E21B 7/067; E21B 7/068

See application file for complete search history.

(56) References Cited

U.S. PATENT DOCUMENTS

| | | | |
|---|---|---|---|
| 3,667,556 | A | 6/1972 | Henderson |
| RE29,526 | E | 1/1978 | Jeter |
| 4,475,982 | A | 10/1984 | Lai et al. |
| 4,492,276 | A | 1/1985 | Kamp |

(Continued)

FOREIGN PATENT DOCUMENTS

| | | | |
|---|---|---|---|
| EP | 0109699 | A2 | 5/1984 |
| WO | 2007/134748 | A1 | 11/2007 |

OTHER PUBLICATIONS

Spherical Bearing, Wikipedia, page last modified Aug. 11, 2015. (2 pages).

(Continued)

*Primary Examiner* — Giovanna Wright

(74) *Attorney, Agent, or Firm* — Timothy G. Ackermann

(57) ABSTRACT

A variable offset bearing assembly, associated with an offset shaft, having a longitudinal axis, disposed with a housing, having a longitudinal axis, the assembly including a radial bearing associated with the offset shaft; a thrust bearing associated with the offset shaft; the radial bearing and thrust bearing permit axial misalignment between the longitudinal axes of the offset shaft and the housing; and the thrust bearing and radial bearing manage axial and radial misalignment of the radial bearing and thrust bearing within the housing, caused by an axial or radial force exerted upon the housing and offset shaft.

8 Claims, 25 Drawing Sheets

(56) References Cited

U.S. PATENT DOCUMENTS

| | | | |
|---|---|---|---|
| 4,745,982 | A | 5/1988 | Wenzel |
| 4,811,798 | A | 3/1989 | Falgout, Sr. et al. |
| 5,050,692 | A | 9/1991 | Beimgraben |
| 5,113,953 | A | 5/1992 | Noble |
| 5,158,529 | A | 10/1992 | Kanai |
| 5,467,832 | A | 11/1995 | Orban et al. |
| 5,484,029 | A | 1/1996 | Eddison |
| 5,485,889 | A | 1/1996 | Gray |
| 5,518,379 | A | 5/1996 | Harris et al. |
| 5,617,926 | A | 4/1997 | Eddison et al. |
| 5,803,185 | A | 9/1998 | Barr et al. |
| 5,817,937 | A | 10/1998 | Beshoory et al. |
| 5,845,722 | A | 12/1998 | Makohl et al. |
| 5,875,859 | A | 3/1999 | Ikeda et al. |
| 6,092,610 | A | 7/2000 | Kosmala et al. |
| 6,092,965 | A | 7/2000 | Mark et al. |
| 6,109,372 | A | 8/2000 | Dorel et al. |
| 6,158,529 | A | 12/2000 | Dorel |
| 6,216,802 | B1 | 4/2001 | Sawyer |
| 6,244,361 | B1 | 6/2001 | Comeau et al. |
| 6,340,063 | B1 | 1/2002 | Comeau et al. |
| 6,415,878 | B1 | 7/2002 | Cargill et al. |
| 6,505,684 | B2 | 1/2003 | Rayssiguier et al. |
| 6,543,312 | B2 | 4/2003 | Sullivan et al. |
| 6,598,687 | B2 | 7/2003 | Eppink et al. |
| 6,708,784 | B1 | 3/2004 | Borg |
| 6,837,315 | B2 | 1/2005 | Pisoni et al. |
| 6,840,336 | B2 | 1/2005 | Schaaf et al. |
| 6,942,044 | B2 | 9/2005 | Moore et al. |
| 7,004,263 | B2 | 2/2006 | Moriarty et al. |
| 7,066,284 | B2 | 6/2006 | Wylie et al. |
| 7,147,066 | B2 | 12/2006 | Chen et al. |
| 7,234,543 | B2 | 6/2007 | Schaaf |
| 7,311,157 | B1 | 12/2007 | Clarke |
| RE39,970 | E | 1/2008 | Askew |
| 7,360,610 | B2 | 4/2008 | Hall et al. |
| 7,413,034 | B2 | 8/2008 | Kirkhope et al. |
| 7,481,281 | B2 | 1/2009 | Schuaf |
| 7,506,701 | B2 | 3/2009 | Hall et al. |
| 7,571,643 | B2 | 8/2009 | Sugiura |
| 7,681,642 | B2 | 3/2010 | Bell et al. |
| 7,913,773 | B2 | 3/2011 | Li et al. |
| 8,062,140 | B2 | 11/2011 | Wall et al. |
| 8,141,657 | B2 | 3/2012 | Hutton |
| 8,286,732 | B2 | 10/2012 | Walker et al. |
| 8,322,461 | B2 | 12/2012 | Hay et al. |
| 8,360,172 | B2 | 1/2013 | Santelmann |
| 2004/0222023 | A1 | 11/2004 | Haci et al. |
| 2005/0236187 | A1 | 10/2005 | Chen et al. |
| 2006/0090935 | A1 | 5/2006 | Van Steenwyk et al. |
| 2008/0314641 | A1 | 12/2008 | McClard |
| 2009/0205867 | A1 | 8/2009 | Reckmann et al. |
| 2009/0260884 | A1 | 10/2009 | Santelmann |
| 2010/0025115 | A1 | 2/2010 | Kotsonis et al. |
| 2010/0108384 | A1 | 5/2010 | Byreddy et al. |
| 2010/0212964 | A1 | 8/2010 | Beuershausen |
| 2010/0236830 | A1 | 9/2010 | Haughom |
| 2011/0005839 | A1 | 1/2011 | Marchand et al. |
| 2011/0088951 | A1 | 4/2011 | Orban et al. |
| 2011/0284292 | A1 | 11/2011 | Gibb et al. |
| 2012/0037428 | A1 | 2/2012 | Plop |
| 2012/0312600 | A1 | 12/2012 | Abbasi |
| 2013/0032401 | A1 | 2/2013 | Edbury et al. |

OTHER PUBLICATIONS

Stockhausen, Ed, et al.; "Directional Drilling Tests in Concrete Blocks Yield Precise Measurements of Borehole Position and Quality"; IADC/SPE Drilling Conference and Exhibition; Mar. 6-8, 2012; San Diego, California. (14 pages).

FIG. 36
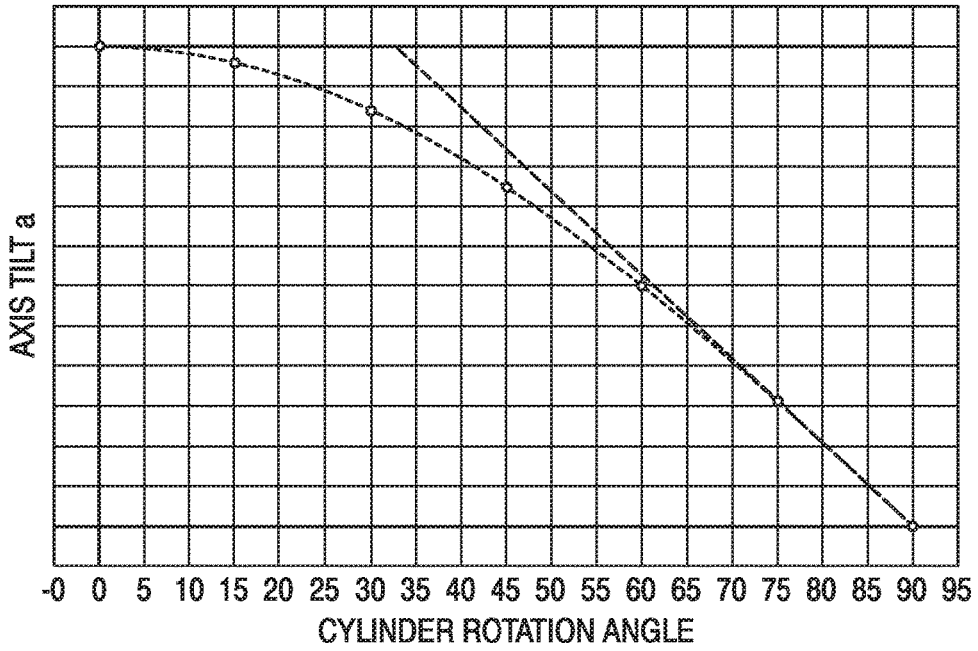
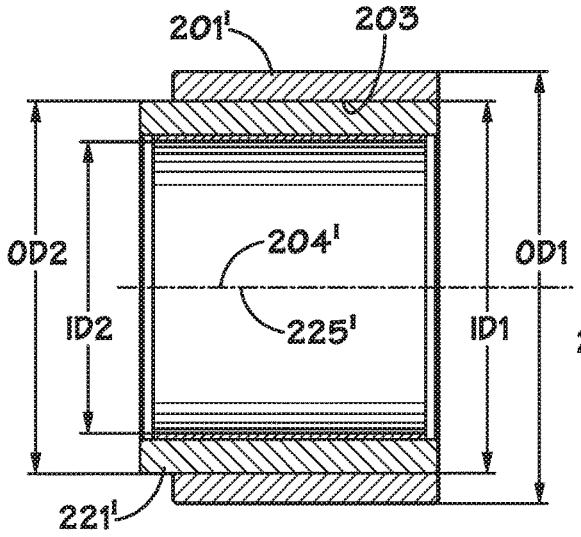
FIG. 37
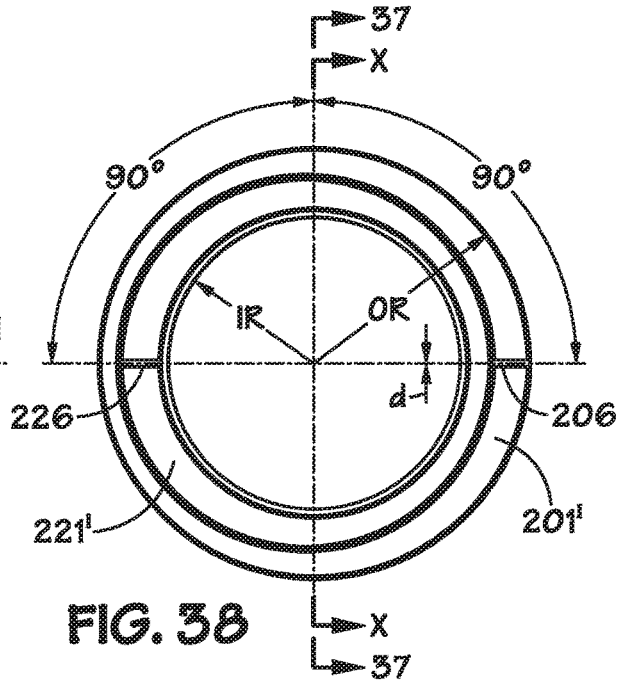
FIG. 38

(0° Toolface Angle)

(50° Toolface Angle)

(0° Toolface Angle
20° Offset Adj. Angle)

(50° Toolface Angle
20° Offset Adj. Angle)

DRILLING SYSTEM, BIASING MECHANISM AND METHOD FOR DIRECTIONALLY DRILLING A BOREHOLE

CROSS-REFERENCE TO RELATED APPLICATIONS

This application is a continuation of U.S. patent application Ser. No. 15/376,887, filed Dec. 12, 2016, which in turn is a continuation of U.S. patent application Ser. No. 13/837,665, filed Mar. 15, 2013, now U.S. Pat. No. 9,556,678 which in turn claims the benefit of U.S. Provisional Patent Application Ser. No. 61/653,150, filed May 30, 2012. The patent applications identified above are incorporated here by reference in their entirety.

FIELD OF DISCLOSURE

This disclosure relates generally to the field of drilling systems, biasing mechanisms for use with drilling systems, and methods for directionally orienting downhole assemblies, including directionally drilling boreholes.

DESCRIPTION OF THE RELATED ART

The following descriptions and examples are not admitted to be prior art by virtue of their inclusion within this section.

Wells, or boreholes, are generally drilled in the ground to recover natural deposits of hydrocarbons and other desirable materials trapped in geological formations in the Earth's crust. A drill bit is attached to the lower end of a drill string suspended from a drilling rig. The drill string is a long string of sections of drill pipe that are connected together end-to-end to form a long shaft for moving the drill bit into the Earth. Drilling fluid, or "mud", is typically pumped down through the drill string to the drill bit. The drilling fluid may not only lubricate and cool the drill bit, but it may also be used to drive a mud motor.

Directional drilling is the intentional deviation of the borehole from the path it would naturally take when the borehole is drilled by advancing a drill bit into the Earth, whereby a portion of the borehole is inclined at an angle with respect to the vertical and with the inclination having a particular compass heading or azimuth. In directional assemblies, the drill bit has a "toolface" angle. The toolface angle is the relative position of the angle of the bit shaft, to which the drill bit is attached, to the high side of the borehole. This toolface angle is the offset from the high side of the borehole in which the drill bit is deviated when viewed from a plane perpendicular to the longitudinal axis of the borehole. The high side of the borehole can be determined based on the Earth's gravitational field. The Earth's magnetic field can also be used for the determination of borehole high-side. The high-side is determined with the magnetic field vector and specific understanding of the borehole's location in latitude and longitude on the Earth. As a borehole is drilled, the toolface angle determines the direction the borehole is drilled and subsequently the borehole's inclination, or the angle with respect to gravity and the borehole's azimuth, or compass heading, when viewed from above the Earth's surface.

Currently, directionally drilling of oil and gas wells is typically done with either a mud motor or with a Rotary Steerable System ("RSS"). With mud motor based directional drilling methods, the rotation of the drill string is stopped and the mud motor's orientation is accomplished by orienting the drill pipe, or drill string, from the Earth's surface to point the mud motor in a new direction typically by lifting the mud motor upwardly from the bottom of the borehole, or off-bottom, and then rotating the drill string to point the mud motor in the desired new direction. The mud motor based directional drilling system is then pushed forward without rotation of the drill pipe, which is generally referred to as a "slide". During a slide, only the drill bit is rotating as it is driven by the mud motor. The toolface angle, or toolface, which establishes the new trajectory for the borehole to be drilled determines both the inclination, or angle with respect to gravity and the azimuth, or compass heading, at which the directional drilled borehole will be drilled. For drilling a straight borehole, the drill string is rotated from surface, subsequently rotating the mud motor and bent housing to drill forward. During such rotational drilling, the resulting borehole diameter is slightly larger than the gauge diameter of the drill bit due to the rotation of the bent housing typically used in such drilling.

An RSS uses complex, electromechanical systems that include sensors, onboard computers, and advanced control systems to continuously orient the drill bit in the desired direction, while the entire RSS and drill pipe continue to rotate.

BRIEF SUMMARY

The following presents a simplified summary of the disclosed subject matter in order to provide a basic understanding of some aspects of the subject matter disclosed herein. This summary is not an exhaustive overview of the technology disclosed herein. It is not intended to identify key or critical elements of the invention or to delineate the scope of the invention. Its sole purpose is to present some concepts in a simplified form as a prelude to the more detailed description that is discussed later.

In one illustrative embodiment, a drilling system may include a power section, a bearing section, an offset shaft, and a biasing mechanism associated with the bearing section to bias the bit shaft to be angularly displaced to permit directional drilling of a borehole. The biasing mechanism may include a pivot associated with a lower bearing assembly of the bearing section, and an offset mechanism associated with an upper radial bearing assembly of the bearing section. An offset mechanism control in the bearing section may also be provided as part of the biasing mechanism. The mud motor may not include a bent housing. The drilling system may include a toolface controller.

In another illustrative embodiment, a biasing mechanism having a bearing section, including a housing, biases an offset shaft, rotating within the housing, to be angularly displaced to permit directional orientation of a downhole assembly, such as in directional drilling of a borehole, and the biasing mechanism may include a pivot associated with a lower bearing assembly, and an offset mechanism associated with an upper radial bearing assembly. The biasing mechanism may include a toolface controller.

BRIEF DESCRIPTION OF THE DRAWINGS

The present drilling system, biasing mechanism, and method for directionally drilling a borehole may be understood by reference to the following description taken in conjunction with the accompanying drawing, in which:

FIG. 36 is a graph illustrating axis tilt angle, a, as a function of the angular position of the offset mechanism of FIGS. 33 and 34;

FIG. 37 is a cross-sectional view of an embodiment of the present offset mechanism of FIGS. 34 and 35, taken along line 37-37 of FIG. 38;

FIG. 38 is an end view of the offset mechanism of FIG. 37;

Figure 1:
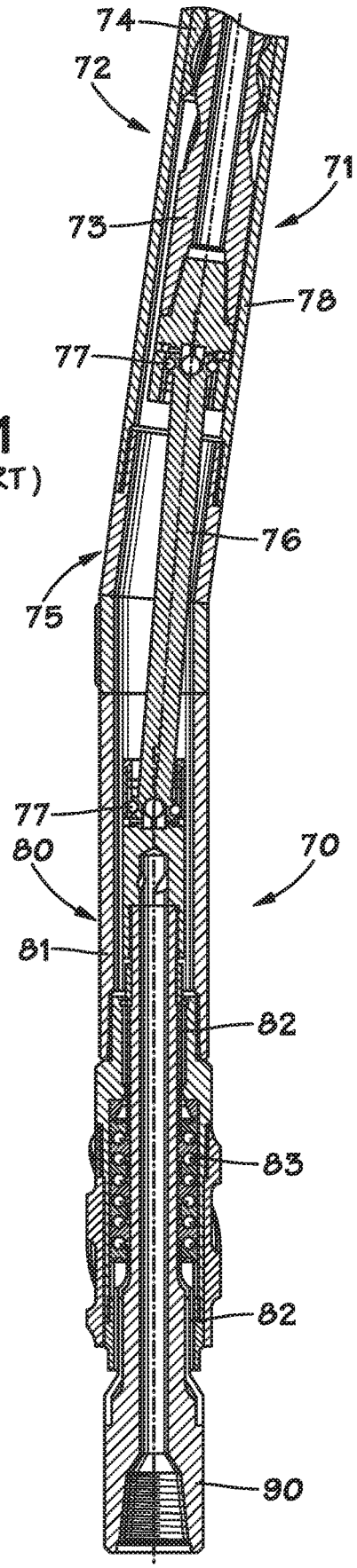
FIG. 1 (PRIOR ART)
FIG. 1 is a partial cross-sectional view of a standard mud motor.

While certain embodiments of the present drilling system, biasing mechanism, and method for directionally drilling a borehole will be described in connection with the preferred illustrative embodiments shown herein, it will be understood that it is not intended to limit the invention to those embodiments. On the contrary, it is intended to cover all alternatives, modifications, and equivalents, as may be included within the spirit and scope of the invention as defined by the appended claims. In the drawing figures, which are not to scale, the same reference numerals are used throughout the description and in the drawing figures for components and elements having the same structure, and primed reference numerals are used for components and elements having a similar function and construction to those components and elements having the same unprimed reference numerals.

DETAILED DESCRIPTION OF THE SPECIFIC EMBODIMENTS

With reference to FIG. 1, a standard mud motor 70 presently used for directional drilling of a borehole, is seen to generally include four sections: a power section 71; bent housing section 75; a bearing assembly section, or bearing section, 80; and a bit shaft 90. Power section 71 is typically a positive displacement motor, which is also known as a Moineau section, or pump, 72. Motor 72 includes a rotor 73 and a stator 74 with progressive cavities disposed between the rotor 73 and stator 74. As drilling fluid, or mud, flows between the rotor and stator 73, 74, a pressure differential across the progressive cavities causes rotation of the rotor 73. The rotation may be transferred to a drive shaft 76 which is operatively coupled to the motor 72, as by a conventional knuckle, or constant velocity joint, or CV joint, 77. Drive shaft 76 passes through the bent housing section 75 and is operatively coupled to bit shaft 90 by another CV joint 77, or other suitable connector.

Still with reference to FIG. 1, bent housing, or bent housing assembly, 75 normally includes either a fixed or a variable bent housing, as is known in the art. Bearing section, or bearing assembly section, 80 is secured to the bent housing 75 in the conventional manner, and bit shaft 90 passes through the housing 81 of the bearing section 80. Bearing section 80 typically includes a combination of axial, or thrust, bearings and radial, or journal, bearings that react to the drilling loads required by the bit (not shown) associated with bit shaft 90, to remove material from the borehole during the drilling process. Bearing section 80 is illustrated with radial bearings 82 and thrust bearings 83. Typically, as is known in the art, two radial bearings 82 and two thrust bearings 83 are used in the bearing section, or bearing assembly, 80. Thrust bearings 83 are intended to take axial loads from the downward drilling process and axial loads from back reaming, when the mud motor 70 is pulled out of the borehole. Radial bearings 82 are intended to take radial loads from side cutting forces from the bit which are transferred to the bit shaft 90, and from side forces acting upon the housing 81 of bearing section 80 caused by deviating the bit in the borehole.

The bent housing section 75 permits the longitudinal axis of the housing 81 of bearing section 80 and the longitudinal axis of the bit shaft 90 to be angularly misaligned, or offset, from the axis of the drill collars 78 located above the bent housing 75.

Figure 2:
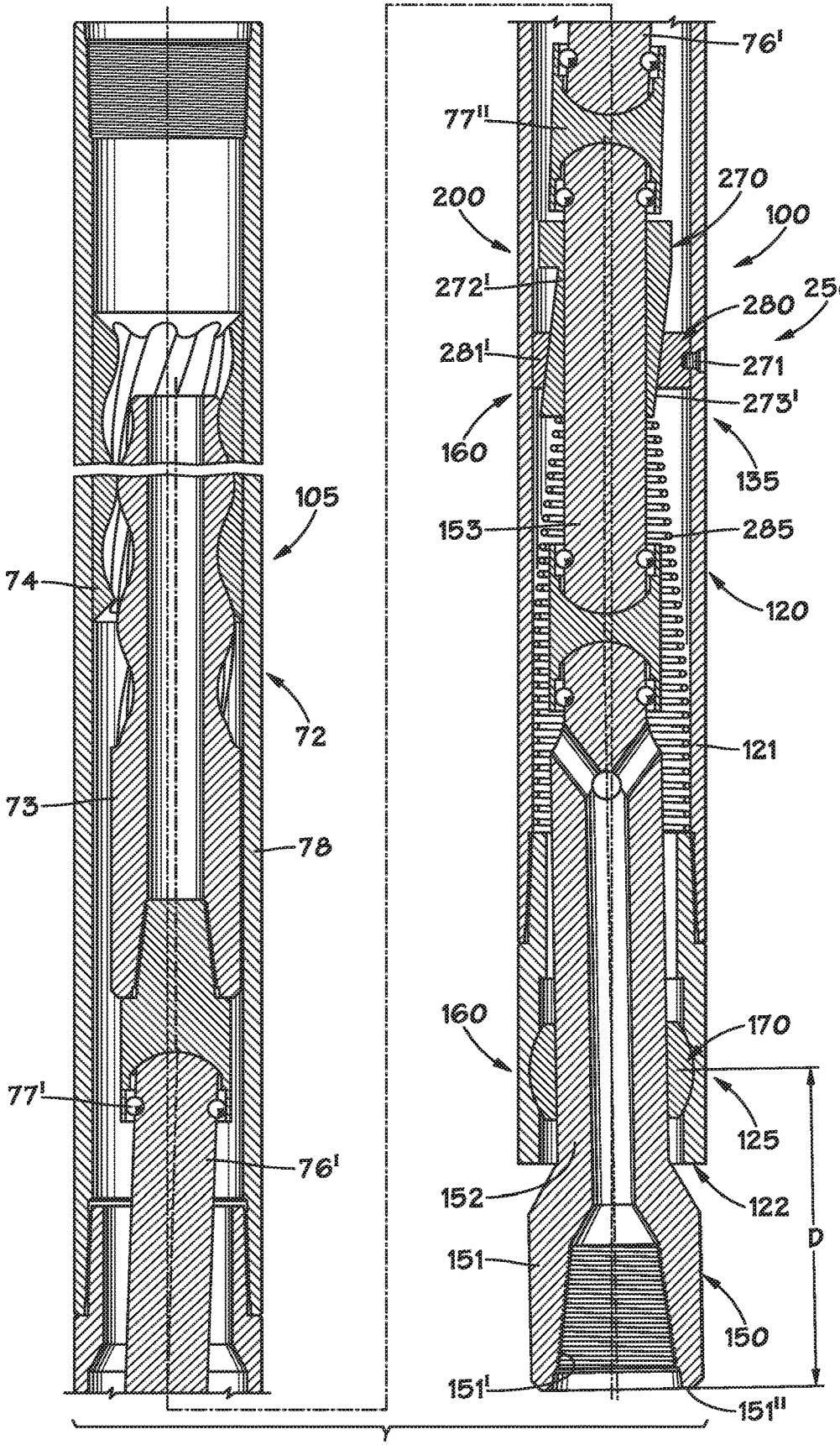
FIG. 2 is a partial cross-sectional view of one embodiment of the present biasing mechanism configured as a drilling system, or mud motor.
Figure 59:
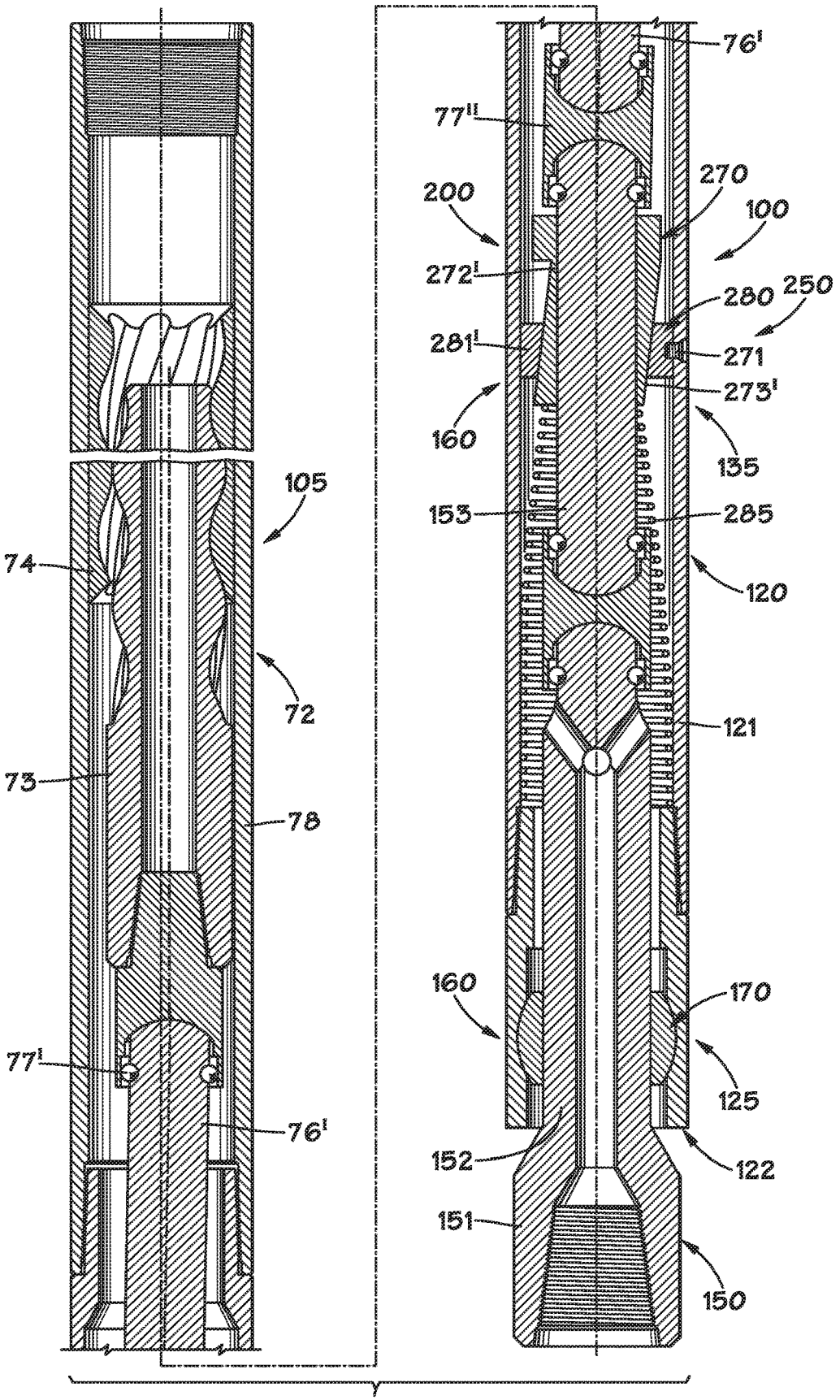
FIG. 59 is a cross-sectional view of an embodiment of the present drilling system, or mud motor, with an offset mechanism controller similar to that of FIG. 57.

With reference to FIGS. 2 and 59, an embodiment of the present biasing mechanism 160 is configured as a mud motor, or drilling system, 100 and is shown to generally include a power section 105, a bearing section 120, an offset shaft, or bit shaft, 150, and a biasing mechanism, or biasing assembly, 160. Power section 105, which is shown as a positive displacement motor, such as a Moineau section, or pump, 72, includes a rotor 73 and stator 74 as previously described in connection with FIG. 1. It is noted that other power sections 105 are contemplated and could be utilized to create a drilling system. These power sections 105 may include, but are not limited to, downhole fluidic turbines, hydraulic motors, electrical motors, and other devices that impart relative rotation. A drive shaft 76' is associated with the rotor 73, as by a CV joint 77'. The power section 105 includes a drill collar, or housing, 78 which is threadedly connected to the bearing section housing 121. Bit shaft 150 is received within bearing section housing 121 and is operatively associated with the drive shaft 76' as by another CV joint 77". Bearing section housing 121 has a lower end 122.

Bit shaft, or offset shaft, 150 has a first portion 151, which preferably includes a bit box 151' and a bit box face, or lower-surface, 151" at its lower end, extending outwardly from the lower end 122 of the bearing section housing 121, and a second portion 152 and a third portion 153 are disposed within the bearing section housing 121. The first portion 151 may be adapted for use with any drill bit, such as rotatable drill bit 500 (FIG. 70), for drilling a borehole in the Earth, as by the threaded connection, or bit box 151', at the lower end of first portion 151 for threadedly receiving a drill bit (not shown). While directionally drilling a portion of a borehole, offset shaft, or bit shaft 150, rotates independently with respect to housing 121 and housing 78, and housing 121 is not rotated while offset shaft 150 is being rotated to directionally drill a portion of the borehole. As will be hereinafter described in greater detail, bearing section 120 includes a lower bearing assembly 125 and an upper radial bearing assembly 135 within bearing section housing 121. As will also be hereinafter described in greater detail, biasing mechanism, or biasing assembly, 160 associated with the bearing section 120 biases the bit shaft, or offset shaft, 150 to be angularly displaced to permit directional orientation of a downhole assembly, such as a drill bit 500 (FIG. 70), to directionally drill a borehole. The biasing assembly, or biasing mechanism, 160 includes a pivot 170 associated with the lower bearing assembly 125, an offset mechanism 200 associated with the upper radial bearing assembly 135, and may include an offset mechanism controller 250 in the bearing section 120. It should be noted that in contrast to the typical mud motor 70 of FIG. 1, the present drilling system, or mud motor, 100 does not include a bent housing 75, such as that shown in FIG. 1, or any other type of bent housing. It is contemplated that a mud motor 100 could be assembled with both a biasing mechanism 160 and a bent housing for additional transverse offset. The biasing mechanism 160, including, offset mechanism 200, and offset mechanism controller 250, are hereinafter described in greater detail in connection with FIG. 59. As will hereinafter be described in greater detail, the biasing mechanism 160 of the present mud motors, or drilling systems 100 may also include a toolface controller 300 (FIGS. 64-67).

In general, as will be hereinafter described in greater detail, the biasing mechanism 160 and offset mechanism 200 are utilized to bias the bit shaft, or offset shaft 150 to provide an axis tilt, or angular offset to the bit shaft 150 to permit the desired directional orientation of the bit shaft 150 to directionally drill a borehole. Biasing mechanism 160, such as by offset mechanism 200, generally can vary, or adjust, an angular relationship between the longitudinal axes of the housing 121 and the bit shaft 150. An offset mechanism controller 250, in general, may be provided to control the movement of the offset mechanism 200 in order to vary the angular offset, or axis tilt, for the bit shaft 150. Alternatively, some embodiments of the present mud motor, or drilling system 100, may not vary the axis tilt, or angular offset, of the bit shaft and instead may have a fixed angular offset, or axis tilt, for the bit shaft 150. Embodiments of the present mud motors, or drilling systems, 100 may include a toolface controller 300 which controls the toolface angle of a drill bit associated with the bit shaft 150. The toolface angle establishes the relative position of the angle of the bit shaft 150 to the high side of the borehole. This toolface angle is the angular offset from the high side of the borehole in which the drill bit is deviated when viewed from a plane perpendicular to the longitudinal axis of the borehole, or similarly to the longitudinal axis of the bearing section housing 121. The high side of the borehole can be determined based on the Earth's gravitational field. The Earth's magnetic field can also be used and the high side determined with the magnetic field vector and specific understanding of the latitude and longitude on the Earth. As the borehole is drilled, the toolface angle determines the direction the borehole is drilled and subsequently the borehole's inclination, or the angle with respect to gravity and the borehole's azimuth, or compass heading, when viewed from above the Earth's surface. In general, the toolface controller 300 preferably rotates the offset mechanism 200 relative to, and independent of, the housing, or bearing section housing, 121, whereby the toolface angle may be variably controlled and altered during directional drilling operations, with such variable control being independent of angular offset, or axis tilt, of the bit shaft 150. Alternatively, a toolface controller 300 may not be utilized, operated, or provided and the toolface angle remains fixed during drilling operations.

Figure 3:
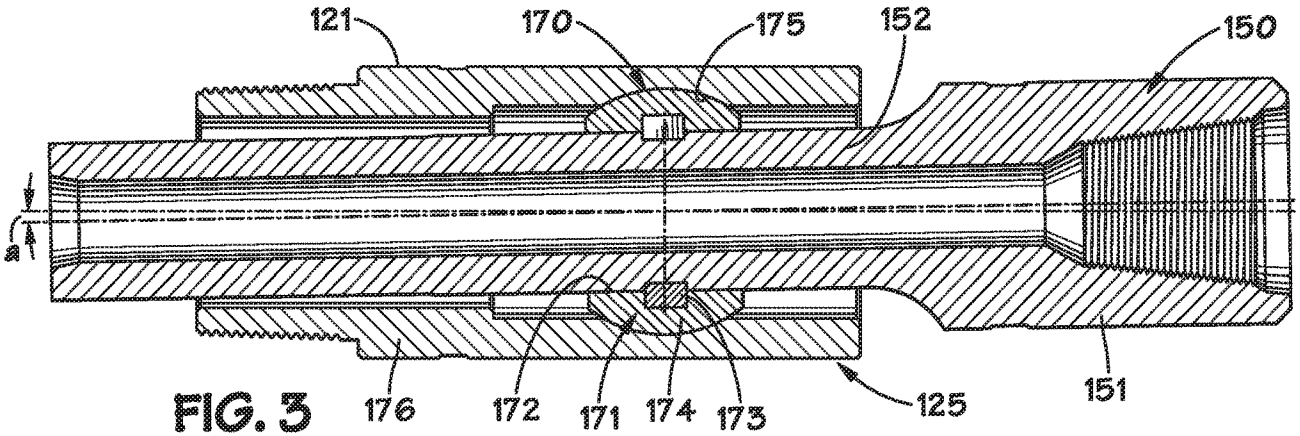
FIG. 3 is a partial cross-sectional view of a pivot of the present biasing mechanism.

With reference to FIG. 3, an embodiment of a pivot 170 of biasing mechanism 160 will be described. Pivot 170 is associated with the lower bearing assembly 125 of the bearing section 120. In this embodiment, pivot 170 is a spherical bearing 171. The second portion 152 of offset shaft, or bit shaft, 150 is disposed within the bearing section housing 121 associated with the lower bearing assembly 125, and the second portion 152 of the bit shaft passes through the central bore 172 of spherical bearing 171. A conventional anchor, such as a split ring or key 173 may be used to prevent axial movement of bit shaft 150 with respect to spherical bearing 171.

Spherical bearing 171 includes a ball 174 matingly received within a matching spherical pocket 175 formed in the interior of the bearing section housing 121. Ball, or ball member, 174 may have its sides truncated as shown in FIG. 3. Bit shaft 150 rotates independently of the bearing section housing 121. Spherical bearing 171 may be of any suitable construction, design, and/or type, provided it has the requisite strength to function in mud motor 100 in connection with use of bit shaft 150 to drill a borehole. The lower bearing assembly 125 moves the pivot point of the bit offset in a directional drilling mud motor 100 much closer to the bit (not shown) attached to the bit shaft 150, and is capable of fixed or adjustable offset operation. The bit shaft 150 rides on spherical bearing 171, which also acts as a spherical thrust bearing for axial loads. The spherical surface of ball 174 is assembled in the spherical pocket 175, rotates relative to the spherical pocket 175 and loads against the spherical pocket 175 in the bearing section housing 121. Spherical bearing 171, or the contact of ball member 174 with the spherical pocket 175, serves as a radial bearing to take radial loads upon bearing section 120, as well as takes axial loads and acts as a thrust bearing. The spherical bearing 171, or pivot 170, receives, or takes, both rotation and offset on the spherical surfaces of the ball 174 and pocket 175.

Figure 4:
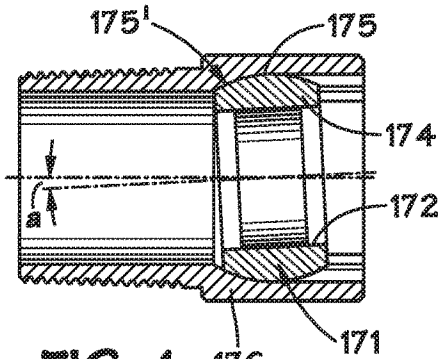
FIG. 4 is a partial cross-sectional view of a portion of a pivot of the present biasing mechanism, similar to that of FIG. 3.
Figure 7:
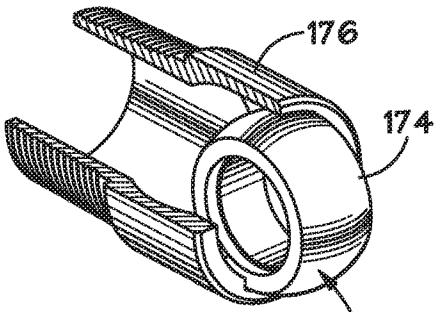
FIGS. 5-11 are perspective views of the pivot of the biasing mechanism of FIG. 4, illustrating some details of construction and assembly of the pivot of the biasing mechanism of FIG. 4.
Figure 6:
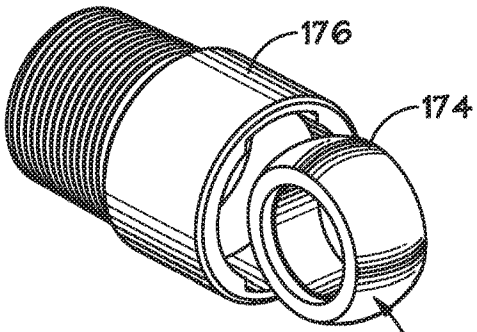
Figure 5:
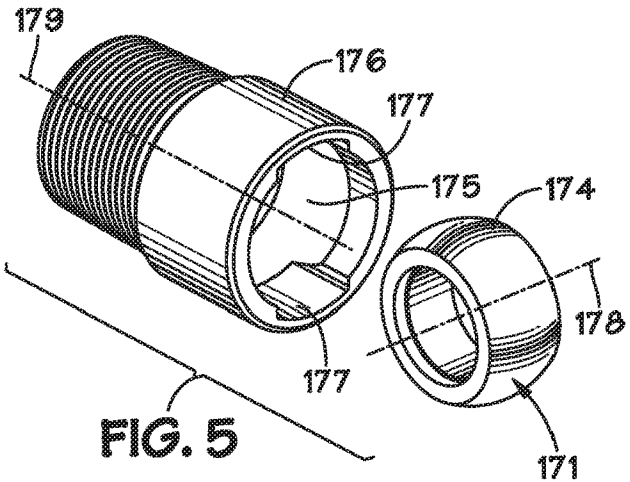
Figure 11:
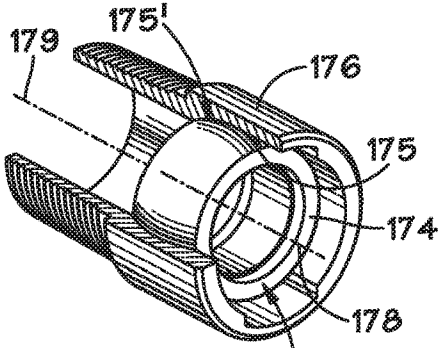
Figure 10:
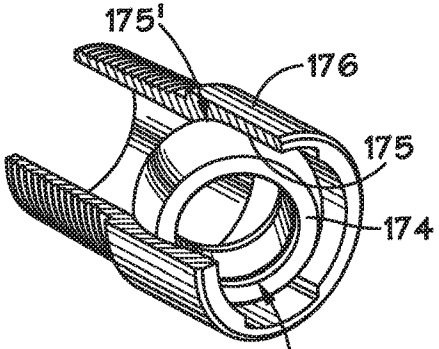
Figure 9:
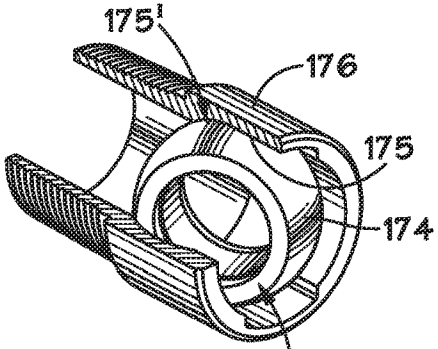
Figure 8:
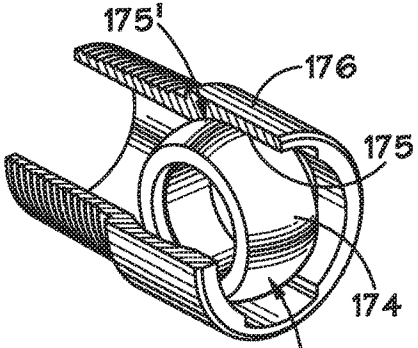

With reference to FIGS. 4-11, the assembly of the spherical bearing 171 within a bias housing 175, which forms part of the bearing section housing 121, will be described. Bias housing 176 includes spherical pocket 175, which is sized to matingly receive the ball 174 of spherical bearing 171. As seen in FIG. 5, spherical pocket 175 of bias housing 176 is provided with two oppositely disposed slots 177. The ball 174 of spherical thrust bearing 171 is rotated so that its longitudinal axis 178 is disposed perpendicular to the longitudinal axis 179 of bias housing 176, whereby ball 174 may be inserted into the slots 177 of bias housing 176, as shown in FIGS. 6-8. As seen in FIG. 8, ball, or ball member, 174 of spherical bearing 171 is seated within the mating spherical pocket 175 and shoulders against it as shown at 175' (FIGS. 4, 8 and 11). With reference to FIGS. 9-11, the spherical ball 174 may be rotated until its longitudinal axis 178 is disposed in a parallel relationship with that of the longitudinal axis 179 of bias housing 176. After ball 174 has been rotated into the position shown in FIG. 11, a retainer member of any suitable design (not shown) may be associated with bias housing 176 to secure the ball 174 of spherical bearing 171 within bias housing 176 in any conventional manner. With ball 174 disposed within spherical pocket 175, as shown in FIG. 11 with the longitudinal axes 178, 179 being aligned and disposed parallel with each other, bit shaft 150 (FIG. 3) may be assembled, or inserted, into the inner bore 172 of spherical bearing 171.

Figure 12:
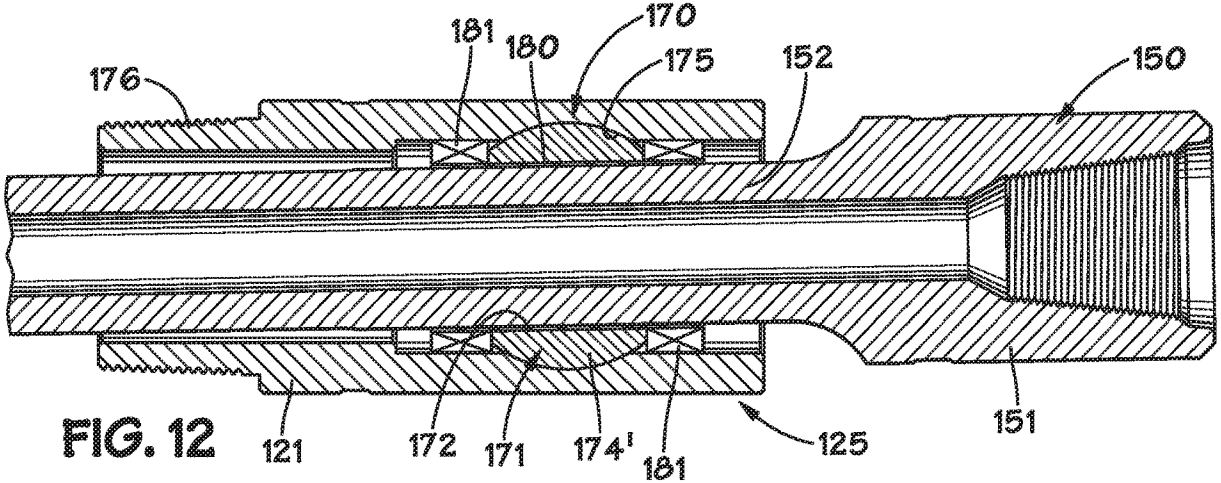
FIG. 12 is a partial cross-sectional view of another embodiment of a pivot of the present biasing mechanism.

With reference to FIG. 12, another embodiment of pivot 170 associated with the lower bearing assembly 125 of the bearing section 120 is illustrated. A spherical shaped ball member 174', similar in construction to ball member 174 of FIG. 3, is disposed within a spherical pocket 175 formed within the bias housing 176, which forms a part of the bearing housing 121. At least one internal radial, or journal, bearing 180 is disposed within the internal bore 172 of ball member 174'. At least one axial thrust bearing 181 is associated with the spherical pivot member, or ball 174', and preferably two axial thrust bearings 181 are associated with spherical ball member 174', one on each side of ball member 174'. Bit shaft 150 rotates independently of the bias housing 176. The pivot 170, or pivoting spherical component, or ball member 174', also acts as a spherical thrust bearing for radial and axial loading, with no relative rotation between the ball 174' and housing 176. Axial thrust and tension loads are transferred to the pivot 170, or ball 174' by the axial thrust bearings 181. The bit shaft 150 is located within bearing section 120 by the shouldering of bit shaft 150 against the axial thrust bearings 181. The pivot 170, or spherical shaped pivot member, or ball, 174' is used to manage only axial misalignment on the spherical surface of ball member 174'. The radial bearing 180 disposed between the pivot member 174' and the bit shaft 150 permits relative rotation of the bit shaft 150 with respect to housing 121 of bearing section 120 as shown in FIG. 2.

Figure 13:
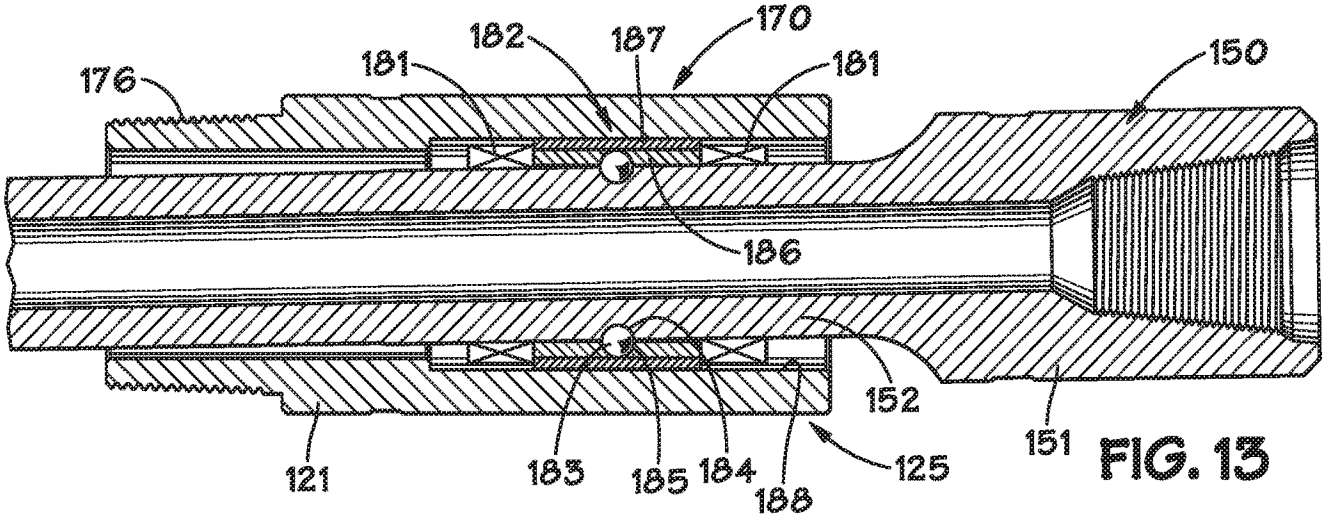
FIG. 13 is a partial cross-sectional view of another embodiment of a pivot of the present biasing mechanism.

With reference to FIG. 13, another embodiment of pivot 170 associated with the lower bearing assembly 125 is illustrated. In this embodiment of pivot 170, a universal joint "knuckle" also referred to as a constant velocity joint, or CV joint 182, with spherical loading surface architecture is used for the pivot 170. CV joint 182 include spherical knuckles, or balls, 183 located in mating spherical pockets 184 formed in the second portion 152 of bit shaft 150, and the spherical knuckles 183 are aligned and received in mating spherical shaped pockets 185 formed in the inner wall surface of a knuckle cylinder 186 disposed adjacent a radial, or journal, bearing, 187, that rotates with respect to bias housing 176 of bearing housing 120. The relative rotation journal bearing surface of bearing 187 is between the knuckle cylinder 186 and the inner wall surface, or inner diameter, 188 of bias housing 176. Axial thrust bearings 181 are provided as previously discussed in connection with FIG. 12.

The embodiment of pivot 170 of FIG. 13, or CV joint 182, is used to manage only axial misalignment across the CV joint 182, where the pivot 170, or knuckles 183, is located on bit shaft 150. Between the interface of the CV joint 182 and the housing 121 is the knuckle cylinder 186. The inner diameter of knuckle cylinder 186 allows for the pivoting of the bit shaft 150 with respect to bias housing 176. The outer diameter of the knuckle cylinder 186 is a portion of the radial bearing 187 which allows relative rotation between the knuckle cylinder 186 and the housing 176. Axial load is transmitted through the CV joint 182 by the axial thrust bearings 181, and radial forces are acted upon by radial bearing 187.

Figure 14:
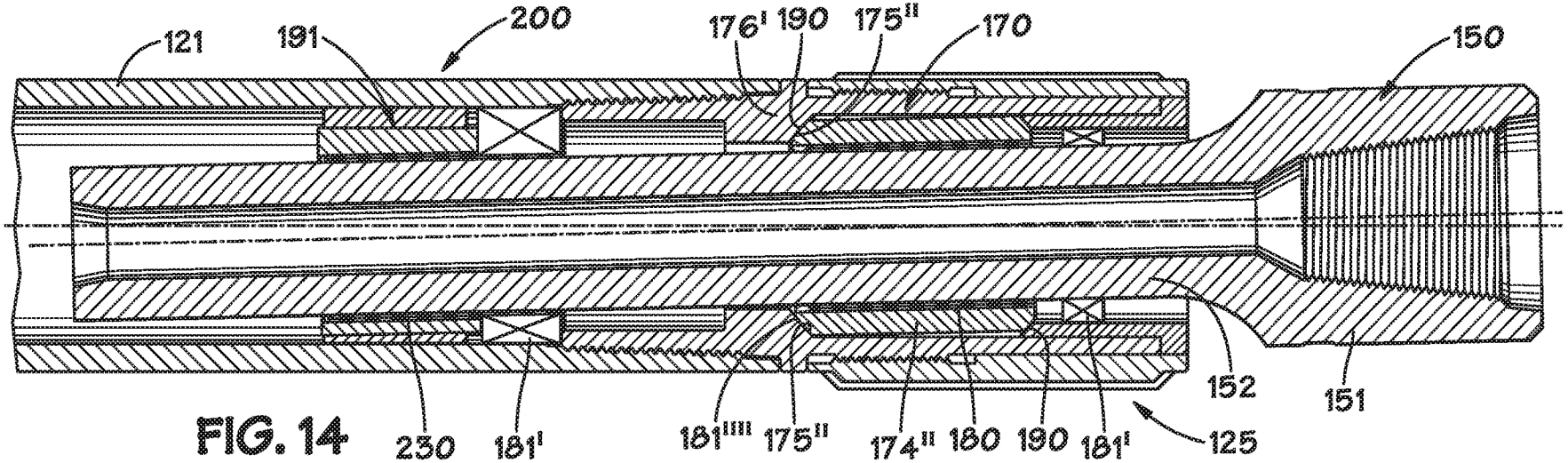
FIG. 14 is a partial cross-sectional view of another embodiment of a pivot of the present biasing mechanism.

With reference to FIG. 14, another embodiment of pivot 170 is illustrated. A spherical pivot member, or truncated ball member 174" is disposed within bearing section housing 121. Spherical pivot member 174" is similar to that of the spherical pivot member 174' of FIG. 12, with the primary difference between the two spherical pivot members 174" and 174' being that the outer spherical surface, or a circumferential portion, of the spherical pivot member 174' has been removed, or truncated for radial clearance of pivot member 174" within housing 121 as shown in FIG. 14. A radial bearing 180 as previously described in connection with FIG. 12 is utilized with spherical pivot member 174". Axial, or thrust, bearings 181' are disposed within the lower bearing assembly 125 in bearing section housing 121. A bias housing 176' is provided and is threadedly received within housing, or collar, 121. Bias housing 176' is provided with a concave, spherical-shaped, pocket 175" that matingly receives truncated, pivot ball member 174". A load bearing surface between truncated spherical ball member 174" and pocket 175" is indicated at 190 where the outer spherical surface of ball member 174' contacts the inner spherical wall surface of pocket 175". This load bearing surface at 190 provides an axial, or thrust, bearing 181"" for pivot ball member 174" to transfer axial forces acting upon pivot ball member 174" to bias housing 176' and then to housing 121.

The lower axial, or thrust, bearing 181' adjacent pivot member 174" in FIG. 14, as well as those hereinafter shown in FIGS. 64-68, is shown schematically. The thrust bearings 350, 350', or 350" as hereinafter shown and described in connection with FIGS. 67-70 could be utilized for this bearing 181'. The upper axial, or thrust bearing 181' adjacent offset mechanism 200 in FIG. 14, as well as those hereinafter shown in connection with offset mechanism 200' in FIGS. 64-68, is also shown schematically. The axial, or thrust, bearings 370 or 370' as shown and described in connection with FIGS. 69-70 could be utilized for the bearing 181'.

Figure 16:
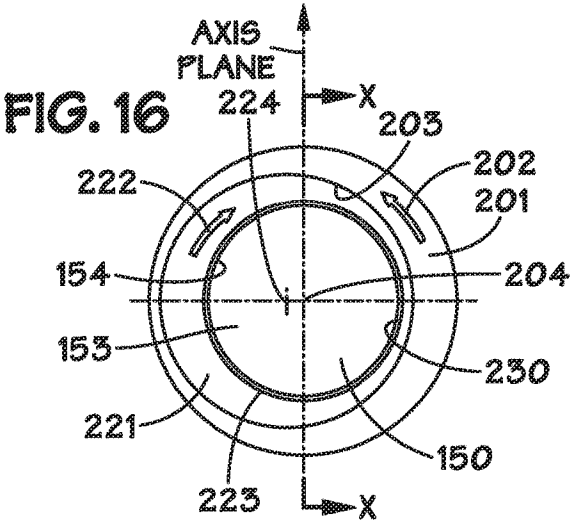
FIG. 16 is a partial cross-sectional, end view of one embodiment of the present offset mechanism.
Figure 33:
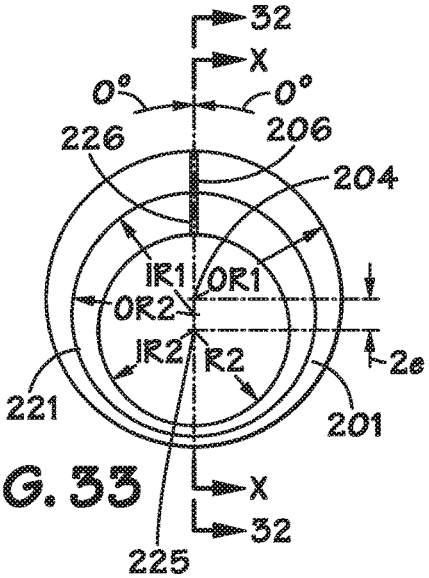
FIG. 33 is an end view of the offset mechanism of FIG. 32.
Figure 34:
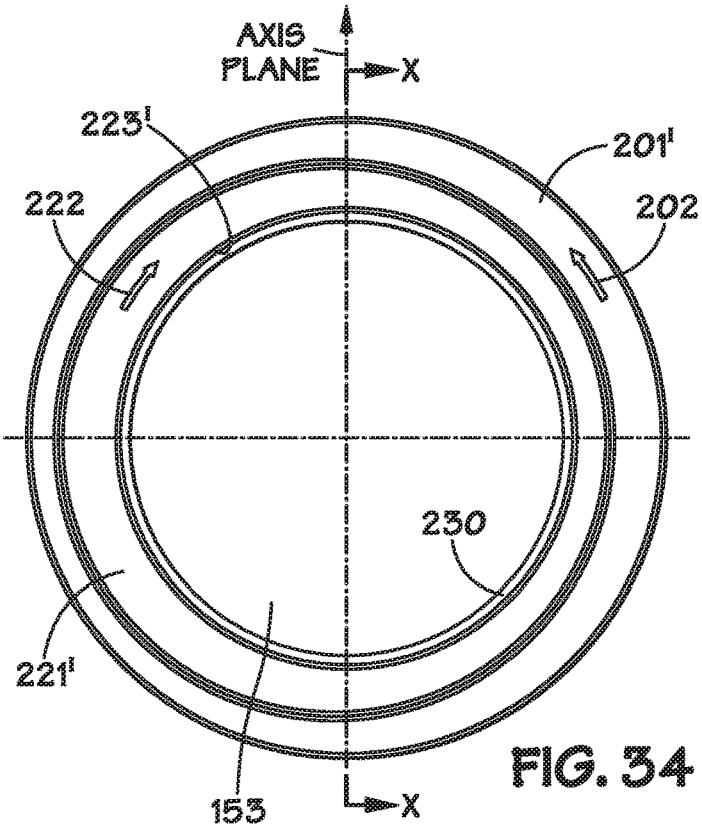
FIGS. 34 and 35 are partial cross-sectional, end views of another embodiment of the present offset mechanism.

Still with reference to FIG. 14, in addition to radial bearing, or lower radial bearing, 180, an upper radial bearing 191 may be disposed adjacent the upper axial thrust bearing 181'. Upper radial bearing 191 may include two eccentric cylinders which form an offset mechanism 200 as hereinafter described in connection with the embodiments of offset mechanisms 200 of FIGS. 16-33 and FIGS. 34-50, including a radial bearing 230 as shown in FIGS. 16 and 34. As will be hereinafter described in greater detail, an offset mechanism controller 250 may be provided for offset mechanism 200, and a toolface controller 300 may also be included.

With truncated spherical pivot member 174", the pivot 170 is created by the pivoting of truncated ball member 174" with respect to pocket member 175" upon the outer spherical, circumferential surface of ball member 174". Truncation of ball member 174" reduces the overall size of pivot 170. Pivot 170 of FIG. 14 is used only to manage axial misalignment and axial and radial forces acting upon the spherical, circumferential surface 190 between ball member 174" and pocket 175". Axial loads are placed through the spherical pivot 170 by the axial, or thrust, bearings 181'.

Figure 15:
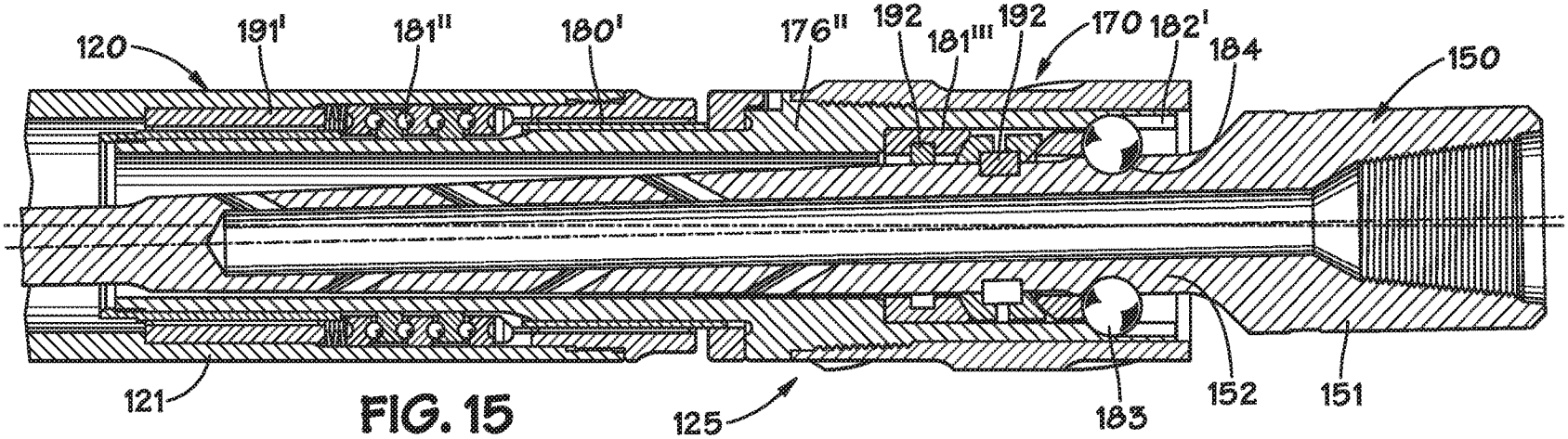
FIG. 15 is a partial cross-sectional view of an embodiment of a lower bearing assembly of the present biasing mechanism.

With reference to FIG. 15, another embodiment of a pivot 170 associated with a lower bearing assembly 125 of a bearing section 120 includes a universal joint knuckle, or CV joint, 182' with spherical loading surface architecture. The constant velocity joint 182' includes spherical knuckles, or balls, 183, received within mating spherical shaped pockets 184 formed in the second portion 152 of bit shaft 150. The use of a CV joint 182' as illustrated in FIG. 15 results in the bias housing 176" rotating with bit shaft 150, as bit shaft 150 rotates. A plurality of axial, or thrust, bearings 181" and 181'" are associated with the lower bearing assembly 125, as shown in FIG. 15. Axial thrust bearing 181'" is preferably a spherical thrust bearing retained in place by a plurality of split ring connectors 192. Upper and lower radial bearings 191' and 180' support bias housing 176" and are located between the outer surface of bias housing 176" and the interior surface of bearing section housing, or collar, 121. The axial thrust bearings 181", 181'" support bias housing 176" in axial thrust or tension loading, while the upper and lower radial bearings 191', 180' support the bias housing 176" in radial and/or transverse loading. The bias assembly is bottom-loaded and requires a retaining nut (not shown). The bias assembly is then bottom loaded into the bearing section housing 121, which also requires a retaining nut shown as part of the journal stator bearing.

With reference now to FIG. 16, an offset mechanism 200 which is part of the biasing mechanism 160 associated with the bearing section 120 to bias the bit shaft 150 to be angularly displaced to permit directional drilling of a borehole, will be described. Offset mechanism 200 is associated with the upper radial bearing assembly 135 of the bearing section 120 (FIG. 2). The embodiment of offset mechanism 200 of FIG. 16 includes first and second counter-rotating eccentric cylinders 201, 221. Cylinder 201 rotates in the direction of arrow 202, and cylinder 221 rotates in the direction of arrow 222. Alternatively, cylinders 201, 221, can rotate in opposite directions from those shown by arrows 202, 222, in FIG. 16; however, the cylinders 201, 221 should always counter-rotate with respect to each other, if toolface is to be maintained at a fixed toolface angle, and hereinafter described. Offset mechanism 200, of the upper radial bearing assembly 135 preferably includes at least one radial, or journal, bearing 230, and the at least one radial bearing 230 is associated with an outer wall surface 154 of the third, or upper, portion 153 of the bit shaft 150. The first and second counter-rotating, eccentric cylinders 201, 221, each have an inner bore 203, 223. The inner bore 223 of the second cylinder 221 is associated with the at least one radial bearing 230 in a conventional manner. The second counter-rotating eccentric cylinder 221 is disposed within the inner bore 203 of the first counter-rotating eccentric cylinder 201, whereby the two cylinders 201, 221, can rotate with respect to each other in the directions of arrows 202, 222. Each of the first and second counter-rotating eccentric cylinders of FIG. 16 have longitudinal, or primary, axes 204, 224, and the longitudinal axes 204, 224, are disposed parallel to each other.

Figure 18:
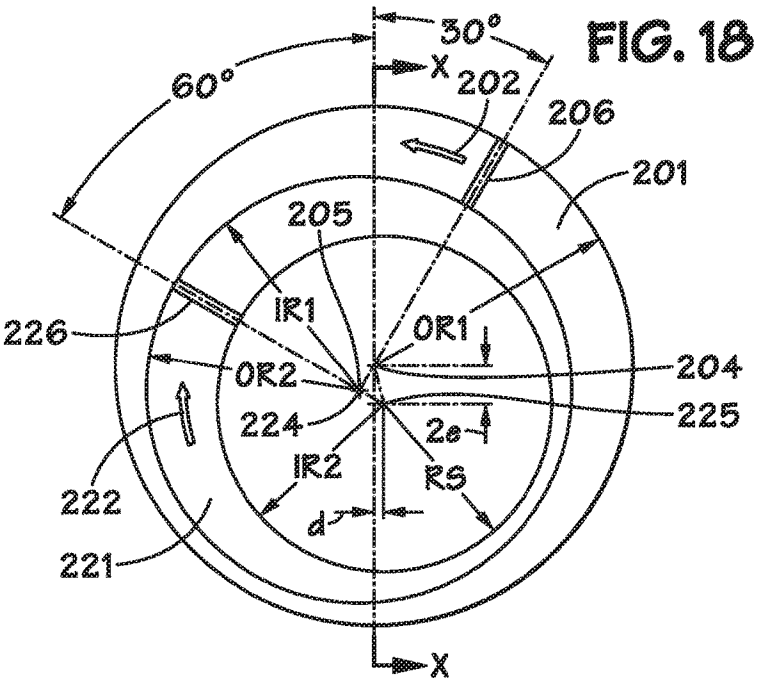
FIGS. 17 and 18 are partial cross-sectional, end views of an offset mechanism similar to that of FIG. 16.
Figure 17:
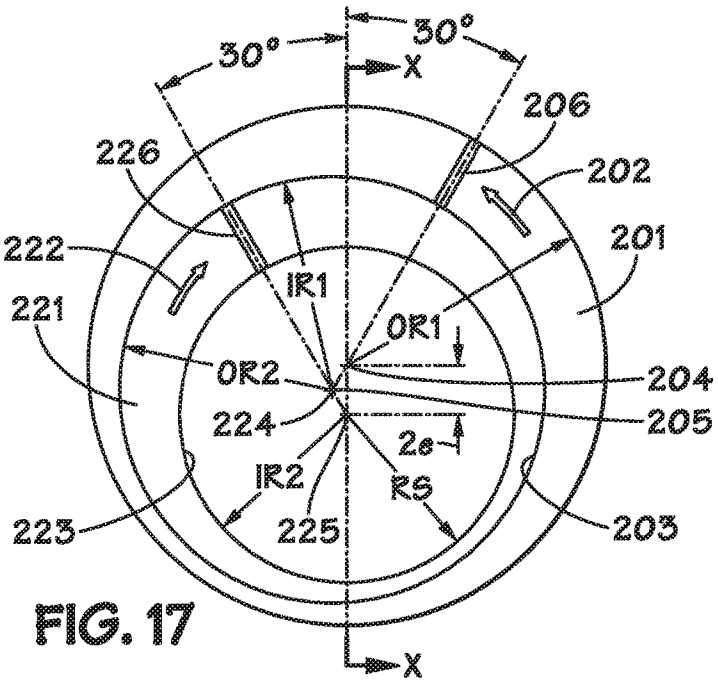

With reference to FIGS. 17 and 18, the operation of offset mechanism 200 will be described. The outer radius of the first, or outer, cylinder 201 is designated as OR1, and OR1 originates from the primary, or longitudinal, axis 204 of first, or outer, cylinder 201. First, or outer, cylinder 201 also has an eccentric, secondary axis 205 which passes through the center of its eccentric inner bore 203. Inner bore 203 of the first cylinder 201 has an inner radius designated as IR1 in FIGS. 17 and 18. It can be seen that the primary axis 204 and the eccentric axis 205 of the first cylinder 201 are vertically offset from one another by an offset, or offset eccentricity, e. Similarly, the second, or inner, cylinder 221 has an outer radius designated as OR2 extending from its primary axis 224, and an inner radius designated as IR2 extending from its eccentric, secondary axis 225. The eccentric inner bore 223 of the second, or inner, cylinder 221, receives the radial bearing 230 and offset shaft, or the third, or upper, portion 153 of the bit shaft 150. As is known in the art, a low friction surface, such as Teflon, or a Molybdenum Disulfide ("Moly") coating, as are all known in the art, may be provided between cylinders 201 and 221 to facilitate their rotation with respect to each other. The radius of the offset shaft, or third, or upper, portion 153 of bit shaft 150 has an inner radius designated as RS.

Still with reference to FIGS. 16-18, for illustration purposes, the end surfaces of each of the first and second cylinders 201, 221 include an angular position reference 206, 226. When the angular positions of each of the cylinders 201, 221 are of equal magnitude, such as shown in FIG. 17 wherein each cylinder is angularly disposed at an angle of 30 degrees from the X-X section line, and in opposite directions, the secondary axis 225 of the second, or inner, cylinder 221 is vertically offset from the primary axis 204 of the first, or outer, cylinder 201, although both axes are co-planar with each other in the toolface plane, designated by the X-X section line. Each of the cylinders 201, 221, contributes an amount of offset eccentricity, or axis offset, e so that the total planar offset of the axes is effectively 2e as shown in FIG. 17.

With reference to FIG. 18, it is seen that if the first and second cylinders 201 and 221 are angularly disposed from each other by different angles, such as by rotating outer cylinder 201 an angle of 30 degrees, and rotating inner cylinder 221 an angle of 60 degrees, an eccentricity 2e is created; however, the secondary axis 225 of the second, or inner cylinder 221, is not vertically co-planar, with the primary axis 204 of the first, or outer, cylinder 201, nor is it co-planar, or vertically co-linear, with the toolface reference designated by the X-X section line in FIG. 18. In addition to the offset eccentricity, or axis offset, 2e, there is a deviation d from the toolface plane of section line X-X. Independent control of each of the cylinders, in either clockwise or counterclockwise rotation, can allow for independent, simultaneous, setting of both toolface and offset.

With respect to FIGS. 17 and 18, as the second, or inner, cylinder 221 rotates about its primary axis 224 in a clockwise motion, as shown by arrow 222 and the outer, or first, cylinder 201 rotates counter-clockwise in the direction of arrow 202 about its primary axis 204, eccentric, secondary axis 225 of the inner, or second, cylinder 221 remains in the toolface axis plane, designated by the X-X section line, provided the angles of rotation of the cylinders 201, 221, though in opposite directions, are of the same angular magnitude as illustrated in FIG. 17. This forces the axis of the offset shaft, or third, or upper portion, 153 of bit shaft 150 riding on bearing, or bearings 230 (FIG. 16) in the eccentric inner bore 223 of the inner, or second, cylinder 221 to remain co-planar with the toolface axis plane, designated by the X-X section line. As shown in FIG. 17, the sum of the positive and negative, or clockwise and counter-clockwise, rotation angles, up to a 90 degree magnitude (on the toolface side), sums to zero with a corresponding total transverse, or axis offset, of 2e. The cylinders can rotate more than 90 degrees. Doing so, however, flips the toolface axis to the opposite hemispherical side of the assembly.

Figure 19:
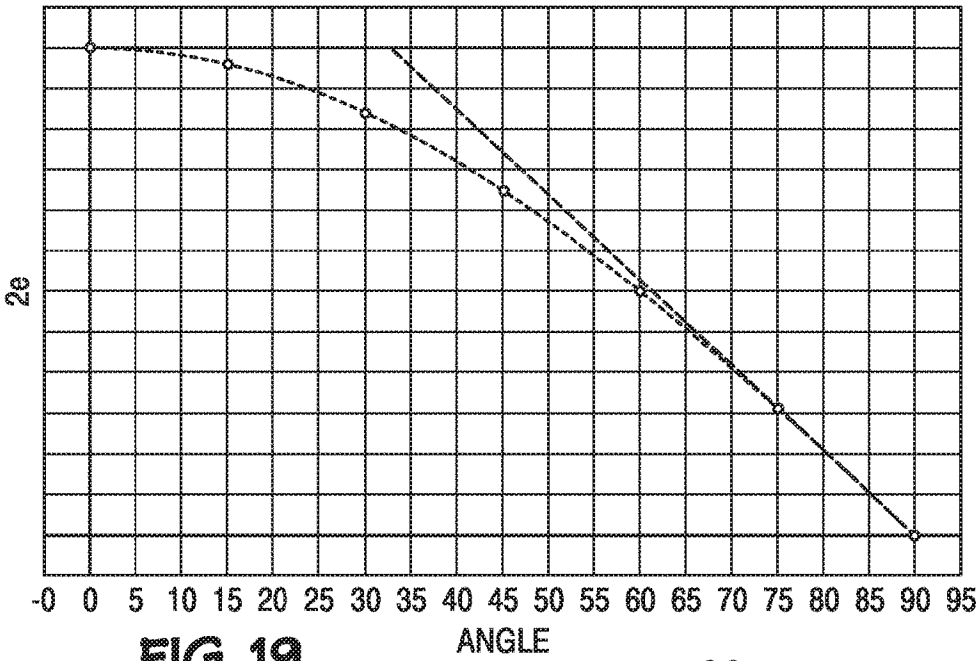
FIG. 19 is a graph illustrating offset eccentricity 2e as a function of the angular position of the offset mechanism of FIGS. 16-18.

As will be hereinafter described in connection with FIGS. 20-33, when varying the angular positions of cylinders 201, 221 an equal angular offset of from 90 degrees to zero degrees, the amount of parallel shaft, or axis, offset e progresses from 0, when each cylinder 201, 221 is angularly disposed 90 degrees, to a maximum value $e_{max}=2e_c$ determined by the eccentricity of the bore offsets, which is the difference between the locations of the primary axis 204 of the outer cylinder 201 and the secondary axis 225 of the inner, or second, cylinder 221. This relationship is illustrated in the graph of FIG. 19, wherein the total offset eccentricity, or total planar offset, 2e is plotted against the angular position of cylinders 201, 221. Near the 90-degree angular position, the total axis offset 2e is fairly linear. As the angle positions approach 0, the amount of axial offset 2e observes a sinusoidal response with diminishing returns as it approaches its maximum $2e_c$ offset value.

Figure 21:
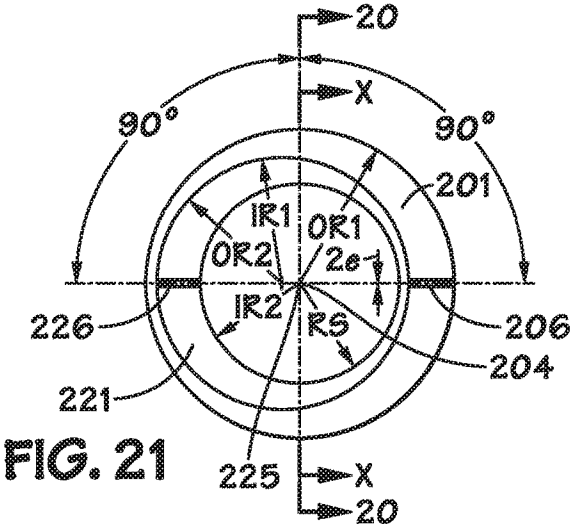
FIG. 21 is an end view of the offset mechanism of FIG. 20.
Figure 20:
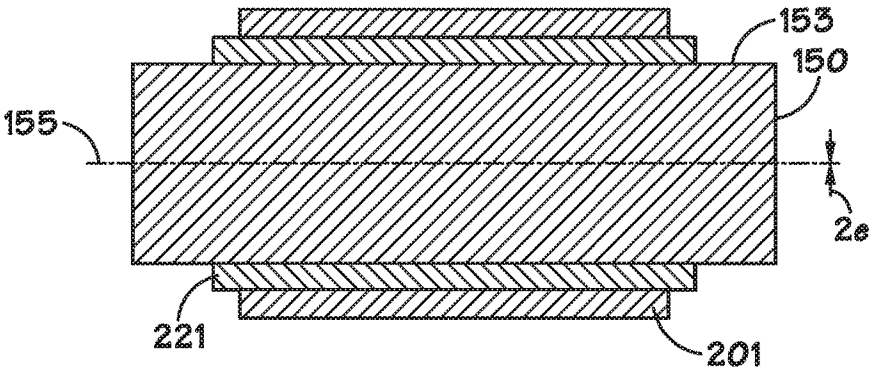
FIG. 20 is a cross-sectional view of an embodiment of the present offset mechanism, taken along line 20-20 of FIG. 21.
Figure 22:
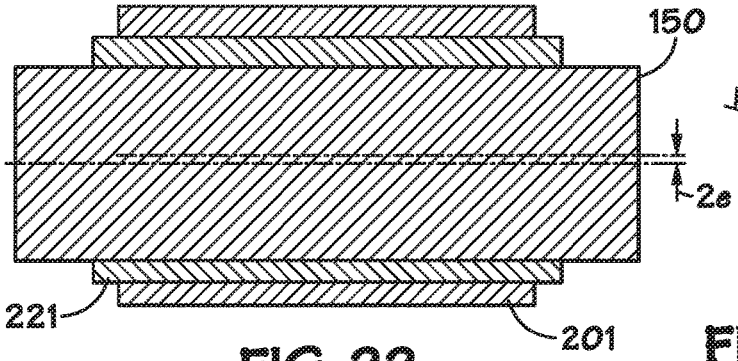
FIG. 22 is a cross-sectional view of an embodiment of the present offset mechanism, taken along line 22-22 of FIG. 23.
Figure 23:
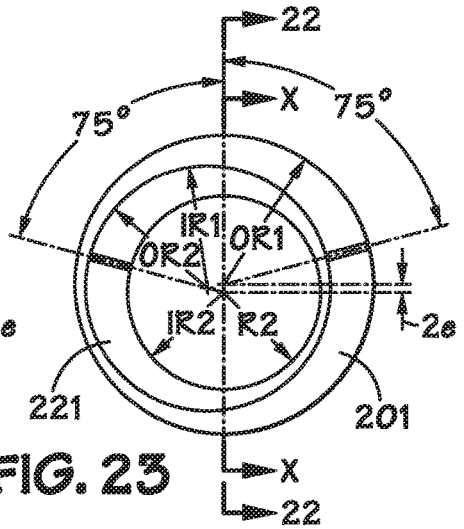
FIG. 23 is an end view of the offset mechanism of FIG. 22.
Figure 24:
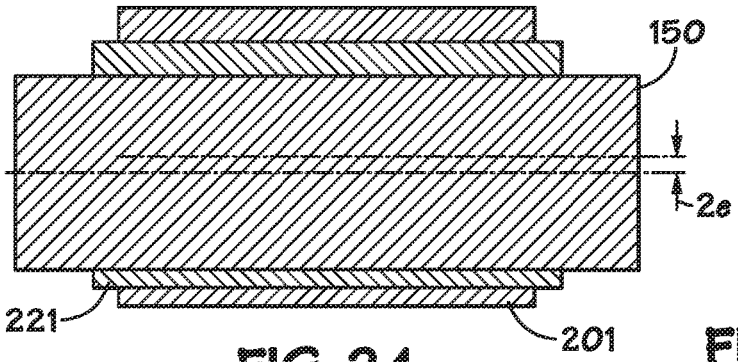
FIG. 24 is a cross-sectional view of an embodiment of the present offset mechanism, taken along line 24-24 of FIG. 25.
Figure 25:
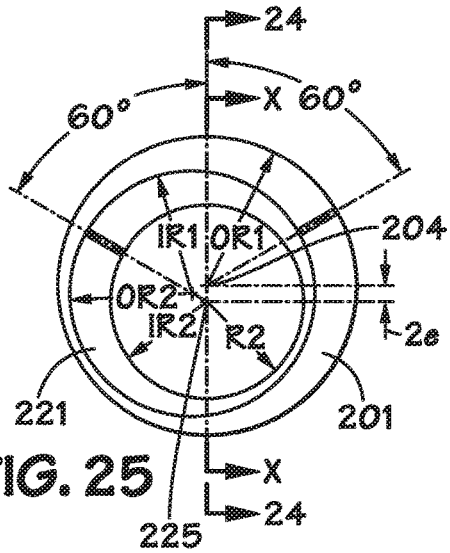
FIG. 25 is an end view of the offset mechanism of FIG. 24.
Figure 26:
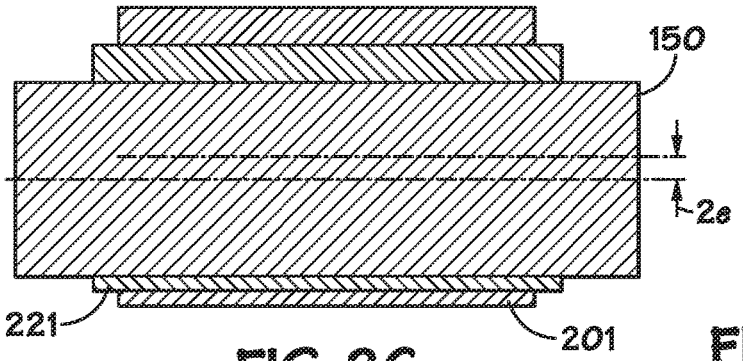
FIG. 26 is a cross-sectional view of an embodiment of the present offset mechanism, taken along line 26-26 of FIG. 27.
Figure 27:
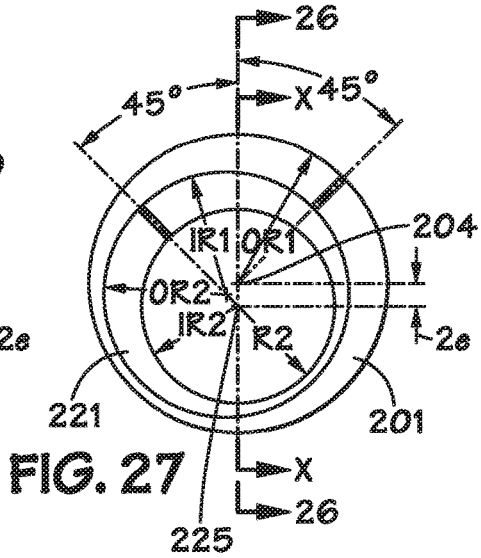
FIG. 27 is an end view of the offset mechanism of FIG. 26.
Figure 32:
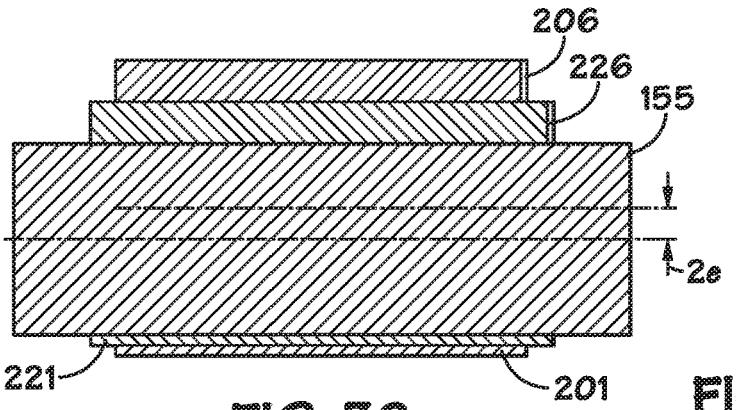
FIG. 32 is a cross-sectional view of an embodiment of the present offset mechanism, taken along line 32-32 of FIG. 33.

For example, with reference to FIGS. 20 and 21, where the cylinders 201, 221 are each angularly displaced from the X-X plane an angle equal to 90 degrees, the amount of axial offset, or 2e, is 0. As seen in FIG. 20, the longitudinal axis 155 of the third, or upper, portion 153 of bit shaft 150 is equidistantly disposed from the outer wall surface of the first, or outer, cylinder 201. As seen in FIG. 21, the primary axis 204 of outer cylinder 201 is co-planar, and coincident with the secondary axis 225 of the inner cylinder 221. As seen with respect to FIGS. 22-23, as the angular disposition between cylinders 201, 221 decreases from 90 degrees to 75 degrees, the parallel shaft offset, or 2e, increases. The parallel shaft offset increases, reaching its maximum value as shown in FIGS. 32 and 33, when the angular offset is zero degrees. Throughout FIGS. 22-33, the primary axis 204 of the outer cylinder 201 remains co-planar, or vertically co-linear with the toolface reference plane, with the secondary axis 225 of the inner cylinder 221. The angular disposition between cylinders 201 and 221 are illustrated in 15 degree incremental movements extending from 90 degrees in FIG. 21 to zero degrees in FIG. 33. The angular disposition between cylinders 201 and 221 can be rotated through 360 degrees. The offset will again increase in amplitude, but in the opposite direction, as the cylinders 201, 221 rotate between 90 degrees and 180 degrees to be a value of −2e at 180 degrees.

With reference now to FIG. 34, another embodiment of an offset mechanism 200 which is part of the biasing mechanism 160 associated with the bearing section 120 to bias the bit shaft 150 to be angularly displaced to permit directional drilling of a borehole, will be described. This offset mechanism is associated with the upper radial bearing assembly 135 of the bearing section 120 (FIG. 2). The embodiment of offset mechanism 200 of FIG. 34 includes first and second counter-rotating eccentric cylinders 201', 221'. Cylinder 201' rotates in the direction of arrow 202, and cylinder 221' rotates in the direction of arrow 222. Alternatively, cylinders 201', 221', can rotate in opposite directions from those shown by arrows 202, 222, in FIG. 34. Offset mechanism 200, of the upper radial bearing assembly 135, preferably includes at least one radial, or journal, bearing 230, and the at least one radial bearing 230 is associated with an outer wall surface 154 of the third, or upper, portion 153 of the bit shaft 150. The first and second counter-rotating, eccentric cylinders 201', 221', each have an inner bore 203', 223'. The inner bore 223' of the second cylinder 221' is associated with the at least one radial bearing 230 in a conventional manner. The second, inner counter-rotating eccentric cylinder 221' is disposed within the inner bore 203' of the first counter-rotating eccentric cylinder 201', whereby the two cylinders 201', 221', can rotate with respect to each other in the directions of arrows 202, 222; while still maintaining a fixed toolface. Independent control of each of the cylinders 201', 221', in either clockwise or counterclockwise rotation can allow for independent, simultaneous setting of both toolface and offset. Each of the first and second counter-rotating eccentric cylinders 201', 221' of FIG. 34 have longitudinal, or primary, axes 204', 224', and the longitudinal axes 204', 224', are not disposed parallel to each other, as will hereinafter be described in greater detail.

Figure 35:
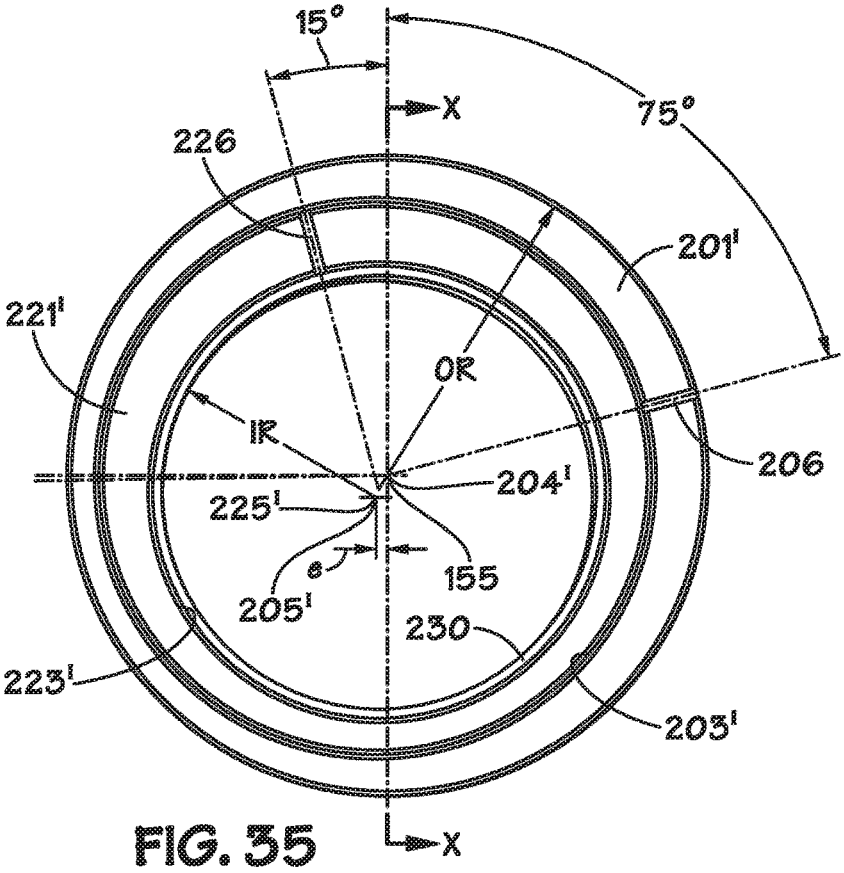
Figure 39:
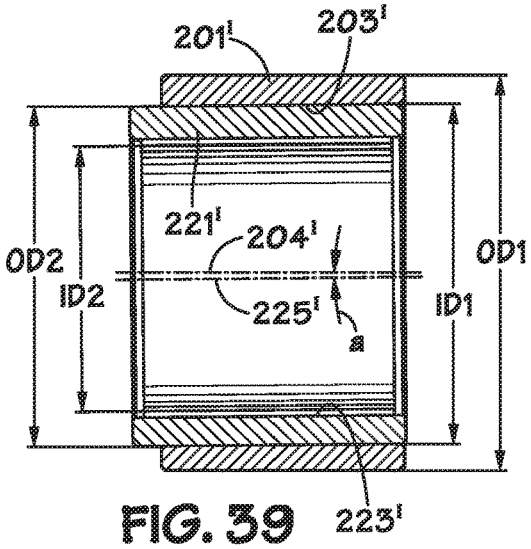
FIG. 39 is a cross-sectional view of an embodiment of the present offset mechanism of FIGS. 34 and 35, taken along line 39-39 of FIG. 40.
Figure 40:
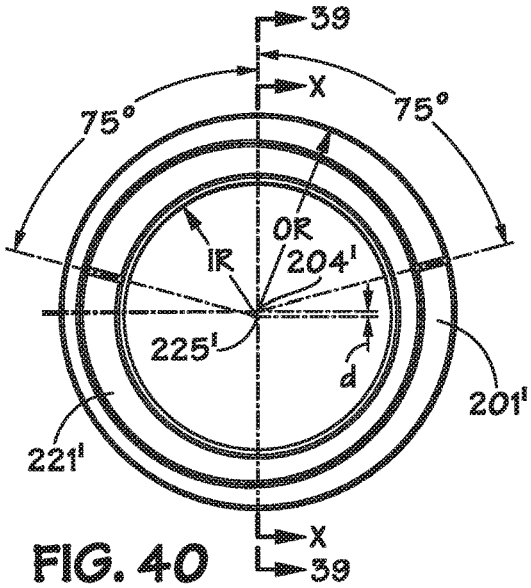
FIG. 40 is an end view of the offset mechanism of FIG. 39.
Figure 41:
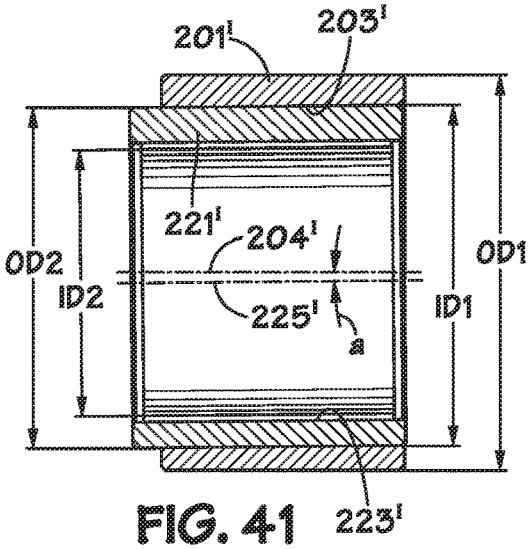
FIG. 41 is a cross-sectional view of an embodiment of the present offset mechanism of FIGS. 34 and 35, taken along line 41-41 of FIG. 42.
Figure 42:
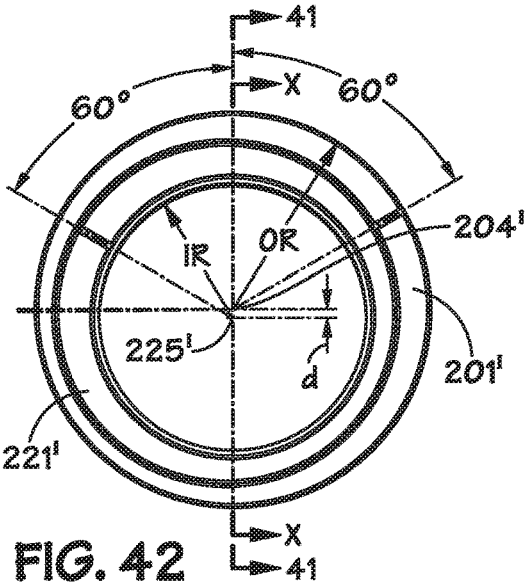
FIG. 42 is an end view of the offset mechanism of FIG. 41.
Figure 43:
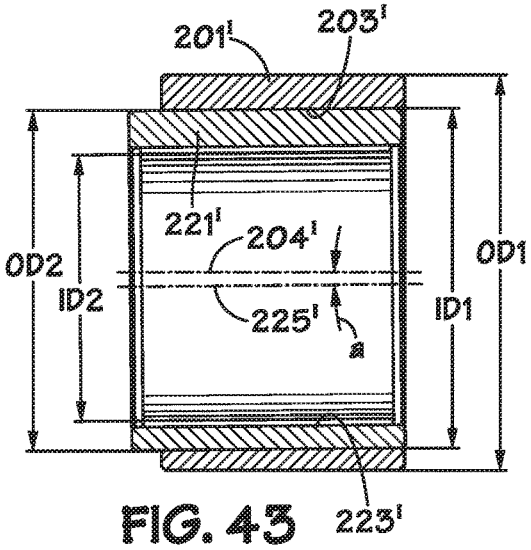
FIG. 43 is a cross-sectional view of an embodiment of the present offset mechanism of FIGS. 34 and 35, taken along line 43-43 of FIG. 44.

With reference to FIGS. 35 and 43, the operation of offset mechanism 200 of FIGS. 34 and 35 will be described. The outer radius of the first, or outer, cylinder 201' is designated as OR1 and it originates from the primary, or longitudinal, axis 204' of the first, or outer, cylinder 201'. First, or outer, cylinder 201' also has an eccentric, secondary axis 205' which extends through the center of its eccentric inner bore 203'. Inner bore 203' of the first cylinder 201' has an inner diameter designated as ID 1 as seen in FIG. 43. The second, or inner, cylinder 221' has an outer diameter designated as OD2 (FIG. 43). Second, or inner, cylinder 221' has an inner radius designated as IR2 (FIG. 35) extending from its eccentric, secondary axis 225'. The eccentric inner bore 223' of the second, or inner, cylinder 221' receives radial bearing 230, and offset shaft, or the third, or upper, portion, 153 of the bit shaft 150.

As seen in connection with FIGS. 35 and 43, the inner bore 223' of the second, or inner, cylinder 221', with its inner diameter ID2, is not disposed parallel to the outer diameter OD1 of the first, outer, cylinder 201', or its primary axis 204'. As seen in FIG. 43, the secondary, or longitudinal, axis 225' of the second, or inner cylinder 221' is not parallel to the primary, or longitudinal axis 204 of the first, or outer cylinder 201'. The inner bore 223' is tilted by an angular offset, or axis tilt, a that originates from a center of rotation position axially offset from the first, or outer, cylinder 201'.

Figure 44:
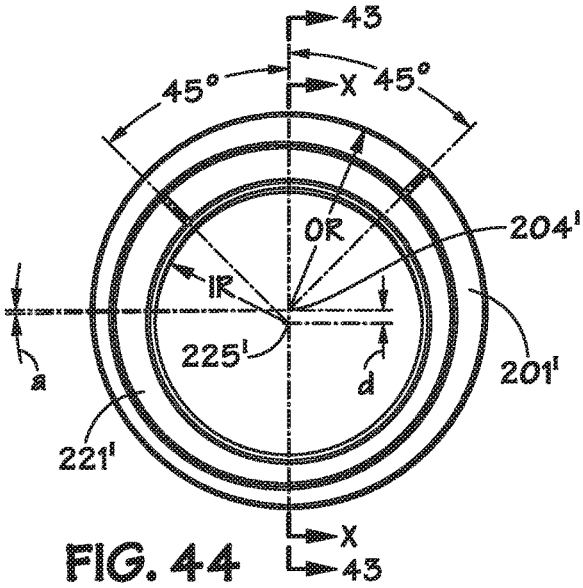
FIG. 44 is an end view of the offset mechanism of FIG. 43.
Figure 45:
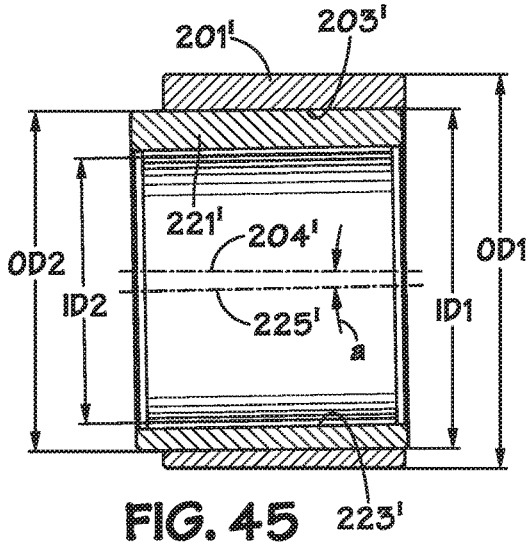
FIG. 45 is a cross-sectional view of an embodiment of the present offset mechanism of FIGS. 34 and 35, taken along line 45-45 of FIG. 46.
Figure 46:
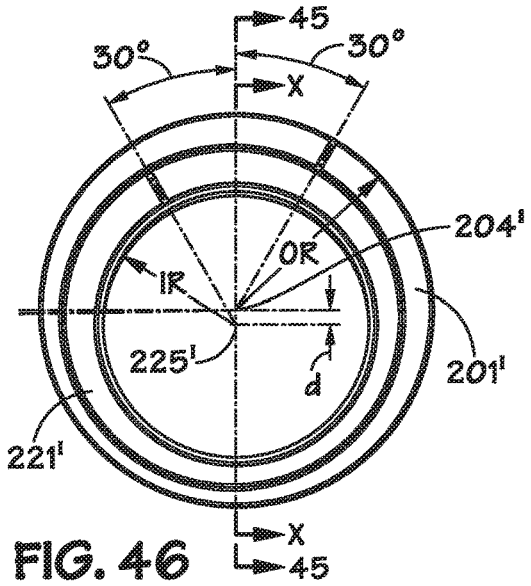
FIG. 46 is an end view of the offset mechanism of FIG. 45.
Figure 47:
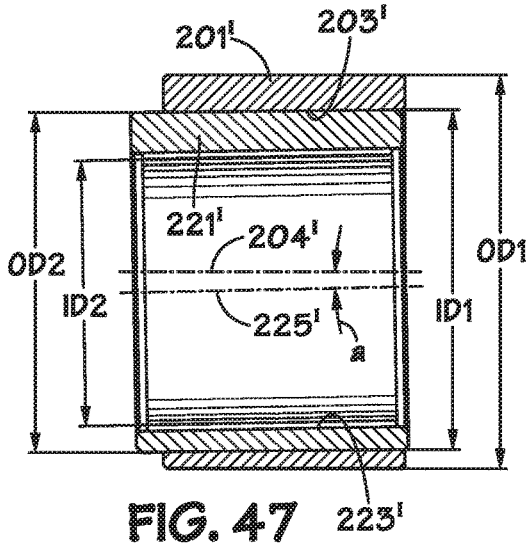
FIG. 47 is a cross-sectional view of an embodiment of the present offset mechanism of FIGS. 34 and 35, taken along line 47-47 of FIG. 48.
Figure 48:
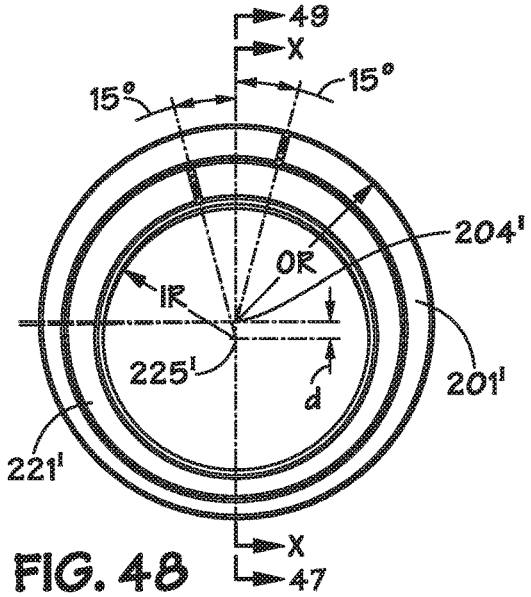
FIG. 48 is an end view of the offset mechanism of FIG. 47.

With reference to FIGS. 35, 43, and 44, for illustration purposes, the end surfaces of each of the first and second cylinders 201', 221' include an angular position reference 206, 226. When the angular positions of each of the cylinders 201', 221' are of equal magnitude, such as shown in FIG. 44, wherein each cylinder is angularly disposed in opposite directions at an angle of 45 degrees, from section line 43-43, or the toolface as designated by the X-X section line, the secondary axis 225' of the inner, or second, cylinder 221' is tilted, or vertically offset, from the primary axis 204' of first, or outer, cylinder 201', though both axes 204', 225', are co-planar with each other, and co-planar with the toolface plane, designated by the X-X, or 43-43 section lines of FIG. 44. Each cylinder 201', 221' contributes an equal amount of angle tilt, or axis tilt, a, and the total amount of axis tilt is twice the amount contributed by each cylinder 201', 221'.

With reference to FIG. 35, if cylinders 201', 221' are angularly disposed from each other with angles of unequal magnitude, such as the 15 degree angle for the second, or inner, cylinder 221', and the 75 degree angle for the first, or outer, cylinder 201', an eccentricity e is created as shown in FIG. 35, but the primary axis 204' of cylinder 201' and the secondary axis 225' of inner cylinder 221' are no longer co-planar with the toolface reference or plane as designated by the X-X section line. By use of unequal angles of rotation, or angular position, for the first and second cylinders 201', 221', an axis tilt a is created, but with a corresponding eccentricity e from the toolface plane. As the inner, or second, cylinder 221' rotates about its primary axis 225' in a clockwise motion and the first, or outer, cylinder 201' rotates counter-clockwise about its primary axis 204', the second, or inner cylinder's eccentric, secondary axis 225' remains in the toolface axis plane, as designated by the X-X section line, provided the angles of rotation of each of the cylinders 201, 221', though rotating in opposite directions, are of the same angular magnitude, as shown in FIG. 44. This forces the longitudinal axis 155 of the offset shaft, or third, or upper, portion 153 of the bit shaft 150 riding on hydrodynamic radial bearing or bearings 230 in the inner bore 223' of the second, or inner, cylinder 221' to remain co-planar with the toolface axis plane, section line X-X, but with an angular offset a relative to the center of rotation position. As shown in FIG. 44, the sum of the positive and negative rotation angles, up to a 90 degree magnitude, sums to zero with a corresponding transverse axis tilt a.

Figure 49:
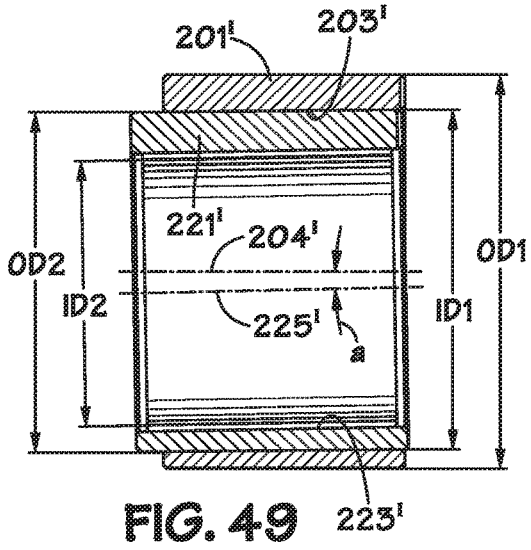
FIG. 49 is a cross-sectional view of an embodiment of the present offset mechanism of FIGS. 34 and 35, taken along line 49-49 of FIG. 50.
Figure 50:
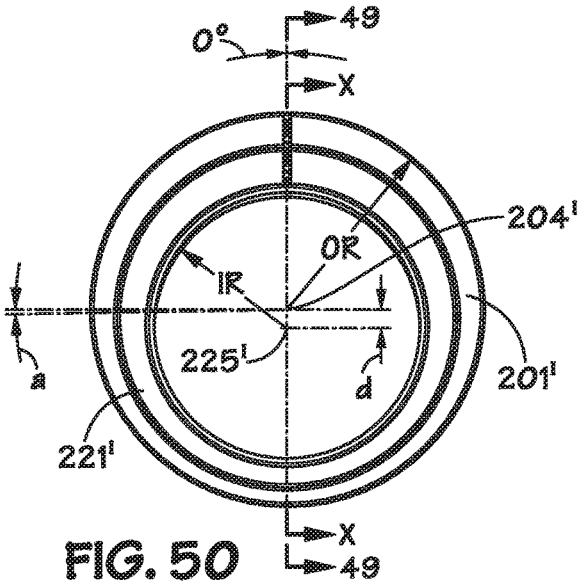
FIG. 50 is an end view of the offset mechanism of FIG. 49.
Figure 52:
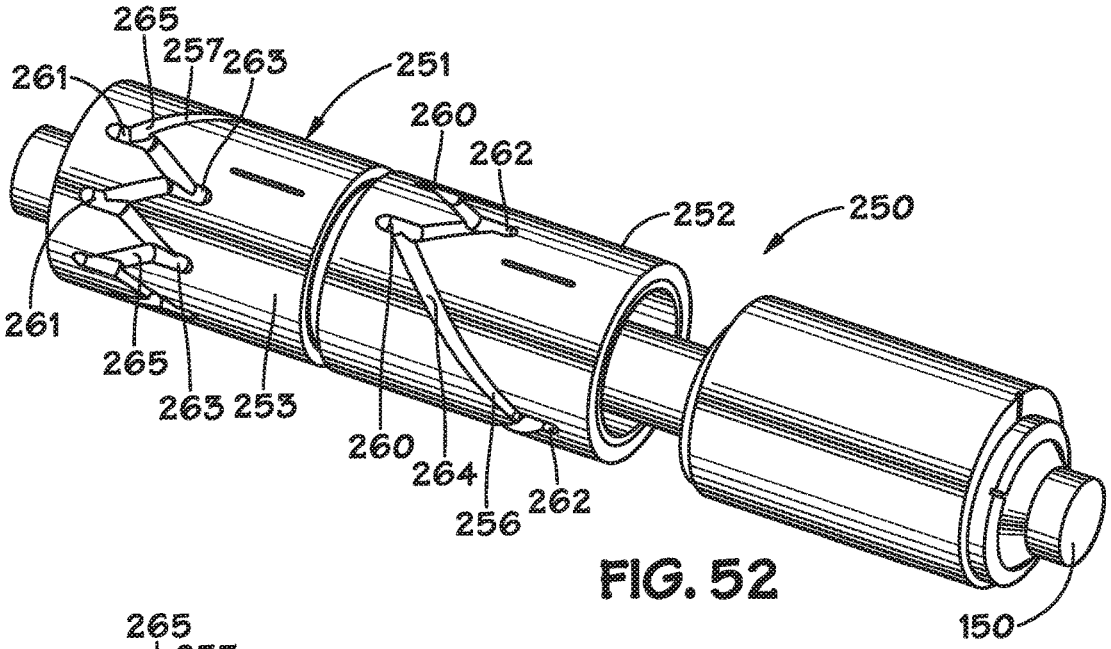
FIGS. 51 and 52 are perspective views of an embodiment of an offset mechanism controller of the present biasing mechanism.
Figure 51:
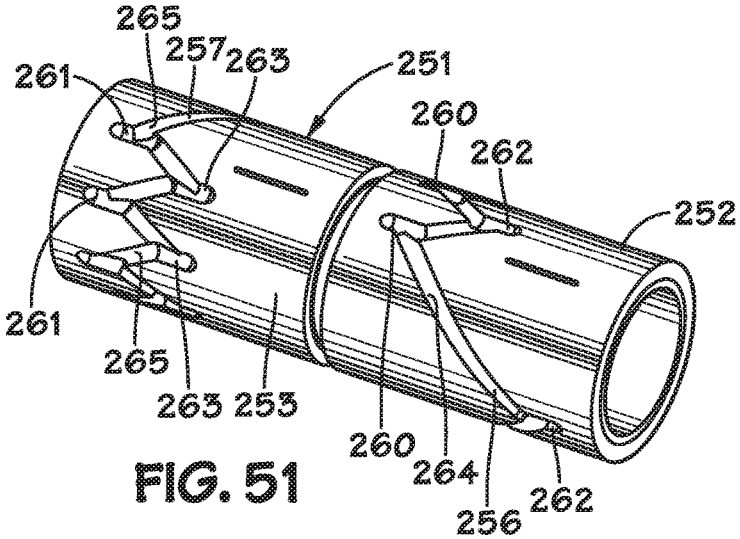

As will hereinafter be described in connection with FIGS. 37-50, when varying the angular positions of cylinders 201', 221', an equal, angular offset of from 90 degrees to zero degrees, the amount of axis tilt a progresses from zero, when each cylinder 201', 221' is angularly disposed 90 degrees, as shown in FIG. 38, to a maximum value of axis tilt a as shown in FIG. 50 when each cylinder 201', 221' is disposed at a zero degree angle with respect to the section lines 49-49, X-X. This relationship is illustrated in the graph of FIG. 36, wherein the total axis tilt a is plotted against the angular positions of cylinders 201', 221'. Near the 90 degree angular positions, the total axis tilt is fairly linear. As the angle positions approach zero, the amount of axis tilt a observes a sinusoidal response with diminishing returns as it approaches its maximum axis tilt value $a_{max}$. The angular disposition between cylinders 201' and 221' can be rotated through 360 degrees. The offset will again increase in amplitude, but in the opposite direction, as the cylinders are rotated between 90 degrees and 180 degrees, to be a value of $-a_{max}$ at 180 degrees.

For example, with reference to FIGS. 37 and 38, where the cylinders 201', 221' are each angularly displaced from the X-X plane an angle equal to 90 degrees, the amount of axis tilt a is zero. As seen in FIG. 37, the primary axis 204' of first, or outer, cylinder 201' is co-planar and coincident with the secondary axis 225' of the inner cylinder 221'. As previously discussed in connection with FIGS. 43 and 44, as the angular disposition between cylinders 201', 221' decreases from 90 degrees to 45 degrees, the axis tilt a increases. The axis tilt d increases, reaching its maximum value as shown in FIGS. 49 and 50, when the angular offset is zero degrees. The angular disposition between cylinders 201' and 221' are illustrated in 15 degree incremental movements extending from 90 degrees in FIG. 38 to zero degrees in FIG. 50.

As will hereinafter be described in greater detail with reference to FIGS. 60, 61, and 65-67, offset mechanism 200 of biasing mechanism 160 may be provided by use of a single eccentric cylinder which provides a fixed amount of axis tilt, a, or axis offset, e.

With reference to FIGS. 51-54, an embodiment of an offset mechanism controller 250 will be described. As will be hereinafter described in greater detail, offset mechanism controller 250 is preferably disposed within the housing, or collar or collars, 121 of bearing section 120. An offset mechanism controller 250 provides for relative, rotational displacement of the first and second cylinders 201, 201' and 221, 221' of the upper radial bearing assembly 135 in order to permit biasing mechanism 160 to bias the bit shaft 150 to be angularly displaced to permit orientation of a downhole assembly, such as a drill bit (not shown) attached to the offset shaft, or bit shaft, 150, to permit directional drilling of a borehole. When relative, rotational displacement of the components of the offset mechanisms 200 previously described in connection with FIGS. 16-50 is required, it can be accomplished through various mechanisms known in the industry, such as mechanical devices, electrical devices or electro-mechanical device. The desired relative rotation of the first and second cylinders 201, 201' and 221, 221' of offset mechanisms 200 might be rotated in opposite directions by a system of motors, such as electric motors, hydraulic motors, or electro-mechanical assembles or other devices, a single motor with a reverse-direction gear mechanism, or by hydraulic pressure from pump cycles. Alternatively, the cylinders, 201, 201' and 221, 221' could be manipulated in an indirect manner by parasitically harnessing the rotary power of the drive shaft. This could be accomplished by causing a clutch, mechanical or electrical, to engage the drive shaft temporarily, such that a portion of its rotary power is transferred to one or both of the cylinders. The duty cycle of clutch engagement could be controlled by suitable electronics and result in the controlled and desired movement of the cylinders.

When actuation of an offset mechanism 200 of FIGS. 16-50 is desired, such control or actuation could also be accomplished by using mechanical connections as the actuators which use intermittent connection to rotating elements of drilling system, or mud motor, 100. Such actuation could also occur through rotation of the relative elements of the offset mechanisms 200 of FIGS. 16-50 associated with the upper radial bearing assembly by using intermittent mechanical connections. This intermittent mechanical connection could be done with clutches, brake systems, or other intermittent mechanical means to create intermittent relative rotation between the inner and outer cylinders 201, 201' and 221, 221' of the offset mechanism 200 associated with the upper radial bearing assembly.

The control of the offset mechanism controller 250 that allows the relative displacement of the components of the offset mechanism 200 can be accomplished through various mechanisms. The control of the offset mechanism controller 250 associated with the upper radial bearing assembly can be done through: surface control using relative pressure or changes in flow; surface control using changes in speed; use of downhole mechanical, electrical or electro-mechanical, hydraulic controllers known to those in the industry; use of downhole electronics and/or downhole computer control systems; use of a combination of surface control and downhole systems to provide dynamic and real time control of the downhole adjustable offset/bias; and use of downhole electronics in combination with downhole sensors to maintain toolface and offset angle, as are known in the industry. The use of downhole electronics with downhole sensor, combined with control signals from both downhole and the surface are preferred to control the downhole adjustable offset/bias.

As to the offset mechanism controller 250 to actuate the offset mechanisms 200, mechanical and electro-mechanical actuators such as motors, clutches and brakes are preferred. Mechanical actuators that can be hydraulically controlled using pumps at the surface could be utilized. With reference to FIGS. 51-54, an embodiment of an offset mechanism controller 250 utilizing a dual double ratchet piston will be hereinafter described in greater detail.

Figure 28:
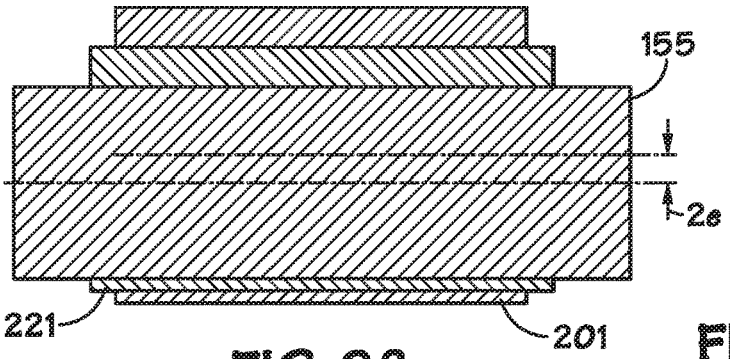
FIG. 28 is a cross-sectional view of an embodiment of the present offset mechanism, taken along line 28-28 of FIG. 29.
Figure 29:
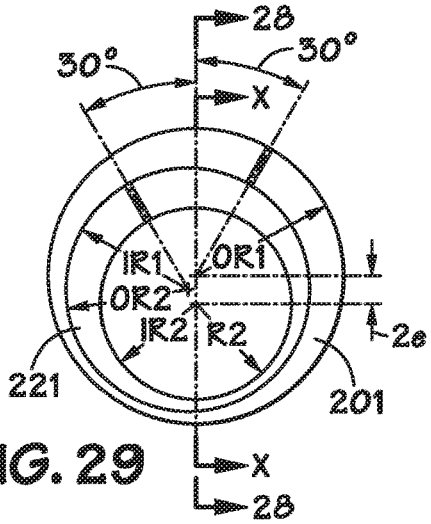
FIG. 29 is an end view of the offset mechanism of FIG. 28.
Figure 30:
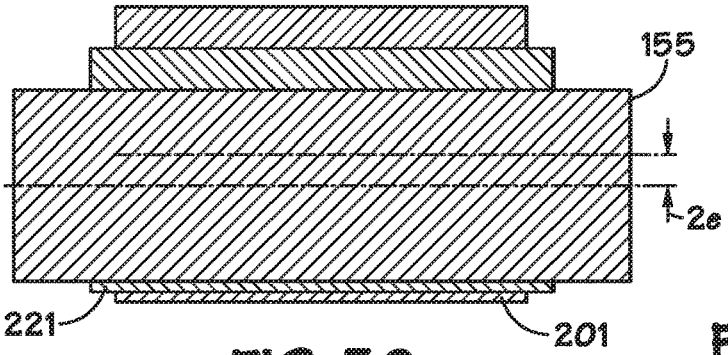
FIG. 30 is a cross-sectional view of an embodiment of the present offset mechanism, taken along line 30-30 of FIG. 31.
Figure 31:
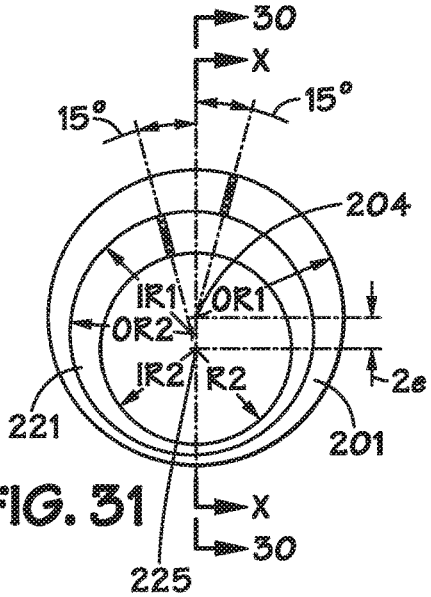
FIG. 31 is an end view of the offset mechanism of FIG. 30.
Figure 53:
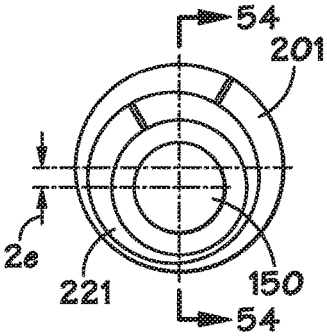
FIG. 53 is an end view of offset mechanism controller of FIG. 52.
Figure 54:
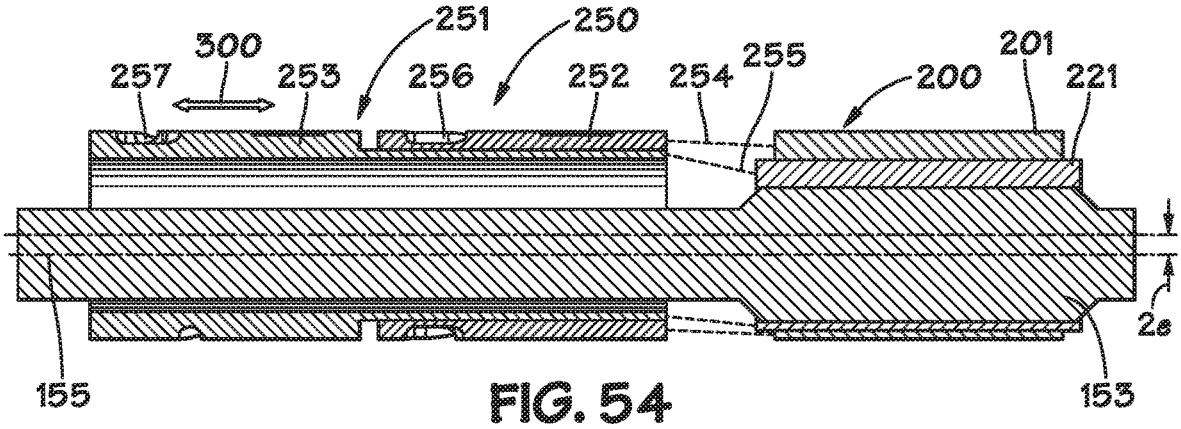
FIG. 54 is a partial cross-sectional view of offset mechanism controller, taken along line 54-54 of FIG. 53.

With reference to FIGS. 51-54, bit shaft 150 is shown with its third portion 153 associated with offset mechanism 200 which includes first and second counter-rotating eccentric cylinders 201, 221, wherein the angular disposition of the first and second cylinders 201, 221, correspond to equal 30 degree angles as seen in FIG. 53 and as illustrated and previously described in connection with FIGS. 28 and 29, whereby an axial offset, or parallel shaft offset, 2e is obtained. A dual ratchet piston actuator 251 is associated with the first and second counter-rotating eccentric cylinders, 201, 221, as will hereinafter be described in greater detail. Upon movement of the dual ratchet piston actuator 251, rotation of the first and second cylinders 201, 221, is obtained. Dual ratchet piston actuator 251 includes first and second ratchet pistons 252, 253. As seen in FIG. 54, first ratchet piston 252 is operatively associated with first, or outer, cylinder 201 as by any suitable, conventional connector 254, as shown in phantom lines, and the second ratchet piston 253 is operatively associated with the second, or inner, cylinder 221 of offset mechanism 200 in any suitable, conventional manner, by a connector 255, shown in phantom lines in FIG. 54. The outer surface of each ratchet piston 252, 253, includes a ratcheting pathway 256, 257 in which a ratchet pawl member, or pin member (258, 259) (FIGS. 55 and 56) may follow. Each ratcheting pathway 256, 257 includes a plurality of upper receptacles, or lock positions, 260, 261, and lower receptacles, or lock positions 262, 263, which may receive pin members 258, 259 as they pass through ratcheting pathways 256, 257.

As the ratchet pistons 252, 253 are moved axially in the direction of arrows 300 (FIG. 54), the pin members 258, 259 pass through the ratcheting pathway 256, 257 and engage the sloping pathway surfaces 264, 265 that are located between the upper and lower lock positions 260-263. As the ratchet pistons 252, 253 are axially moved between the upper and lower receptacles, or lock positions, 260-263, the ratchet pistons 252, 253 are rotated, proportional to the amount of axial displacement of each respective ratchet piston 252, 253. The rotational movement of the ratchet pistons 252, 253 is in turn transmitted to the first and second cylinders 201, 221, to cause them to counter-rotate and operate to provide the desired offset eccentricity e and/or axis tilt a as previously described in connection with FIGS. 16-33 and/or FIGS. 34-50, respectively. A compression spring (not shown) could store the displacement energy for the return cycle of the dual ratchet piston actuator 251, as is known in the industry.

Dual ratchet piston actuator 251, in combination with the offset mechanisms 200 of FIGS. 3-34, and a pivot 170, previously described in connection with FIGS. 3-15, results in a downhole adjustable offset/bias for the bit shaft 150. Both an adjustable offset/bias and adjustable toolface may be achieved. The dual ratchet piston actuator 251 of FIGS. 51-54 could also be utilized with the embodiment of offset mechanism 200, described previously in connection with FIGS. 34-50.

Figure 55:
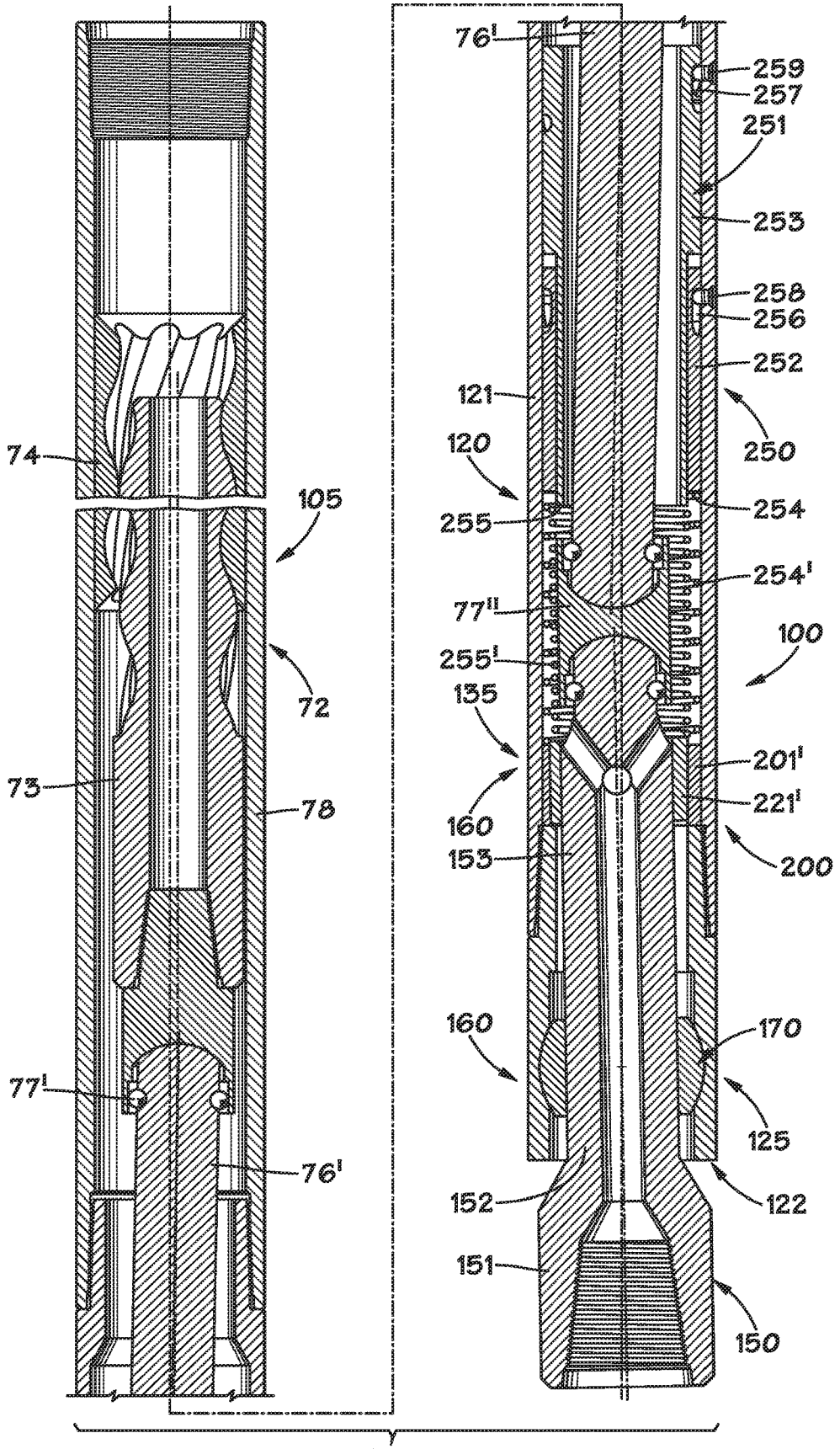
FIGS. 55 and 56 are cross-sectional views of an embodiment of the present drilling system, or mud motor, using the offset mechanism controller of FIG. 54.
Figure 56:
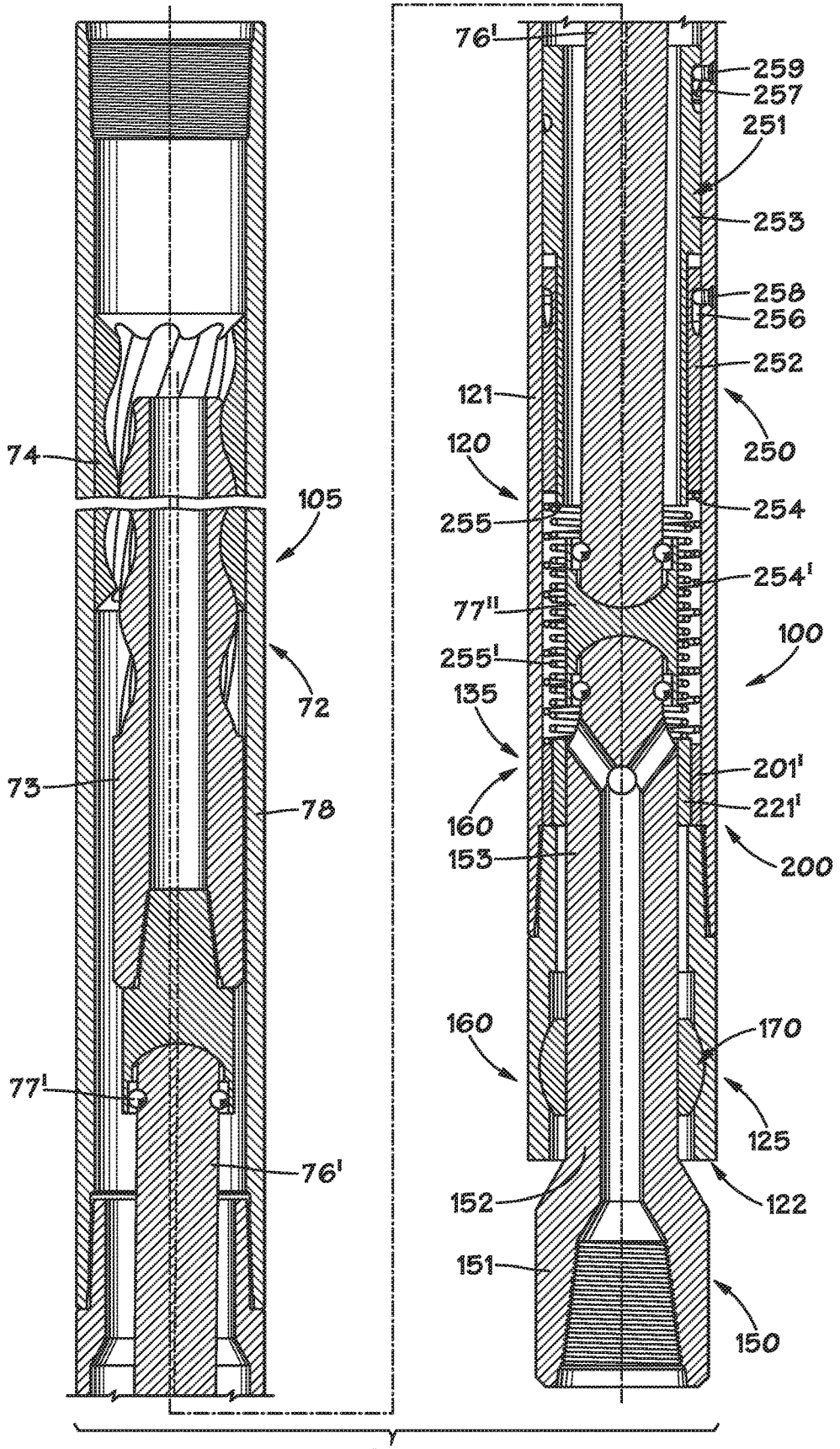

With reference to FIGS. 55 and 56, an embodiment of the present drilling system, or mud motor, 100 is illustrated. Drilling system, or mud motor, 100 includes: a power section 105, as previously described in connection with FIG. 2; a bearing section 120 including housing 121 and having a lower end 122, a lower bearing assembly 125, an upper radial bearing assembly 135, bit shaft 150 having a first portion 151 extending outwardly from the lower end 122 of the bearing section housing 120, a second portion 152 disposed within the bearing section 120 and associated with the lower bearing assembly 125, and a third portion 153 disposed within the bearing section housing 121 and associated with the upper radial bearing assembly 135; and a biasing mechanism 160 associated with the bearing section 120 to bias the bit shaft 150 to be angularly displaced to permit directional drilling of a borehole.

In the embodiment of the present mud motor 100 illustrated in FIGS. 55 and 56, biasing mechanism 160 is provided with a pivot 170 associated with the lower bearing assembly 125 of the bearing section 120, and the pivot 170 is the embodiment of pivot 170 previously described in connection with FIGS. 3-11 or FIG. 12. Pivot 170 could also be any of the pivots 170 previously described in connection with FIGS. 13-15. The offset mechanism 200 of biasing mechanism 160, which is associated with the upper radial bearing assembly 135 includes first and second counter-rotating eccentric cylinders 201', 221', having non-parallel axes as previously described in connection with FIGS. 34-50.

In the embodiment of the present mud motor 100 of FIGS. 55 and 56, an offset mechanism controller 250 is provided in the bearing section 120, and the offset mechanism controller 250 is the dual ratchet piston actuator 251 previously described in connection with FIGS. 51-54, which includes first and second ratchet pistons 252, 253. Pin members 258, 259 are fixed with respect to bearing section housing 121, and are disposed within the ratcheting pathways 256, 257, of the first and second ratchet piston cylinders 252, 253. First and second cylinders 201', 221' are operatively connected to the first and second ratchet piston cylinders 252, 253, by connectors 254, 255, which preferably are torsion springs 254', 255', which provide the counter-rotation of first and second cylinders 201', 221' in the desired manner previously described. Alternatively, as shown in FIGS. 53 and 54, the offset mechanism 200 could be the first and second counter-rotating eccentric cylinders 201, 221 having longitudinal axes which are parallel to each other, as described in connection with FIGS. 53, 54, and 16-33.

In FIG. 55, bit shaft 150 has first and second cylinders 201', 221', disposed in the angular relationship previously described in connection with FIGS. 49 and 50, wherein the maximum bit shaft tilt angle, or axis tilt, a is obtained. The bit shaft offset forces the drill bit (not shown) associated with bit shaft 150, to preferentially cut more material, or rock, on one side of the borehole, enabling the mud motor 100 to drill a curving borehole. In FIG. 56, first and second cylinders 201', 221' are angularly disposed, or counter-rotated, with respect to each other to have the configuration illustrated and previously described in connection with FIGS. 37 and 38 to create a minimum bit shaft tilt angle, or axis tilt, a of zero. When a mud motor 100 has the configuration illustrated in FIG. 56, the mud motor 100 drills a straight borehole, which is the straight-motor condition of mud motor 100. The power section 105 transmits rotary power to the bit shaft 150 through a drive shaft 76' and conventional universal joint adaptors, or knuckle joints, or CV joints, 77', 77". As illustrated in FIGS. 55 and 56, the power section 105 may utilize a Moineau section, or motor, 72 which rotates rotor 73, as previously described. As previously noted, other types of motors could be utilized other than the Moineau section, or pump, 72 illustrated, provided the power section 105 can provide rotary motion to bit shaft 150.

Figure 57:
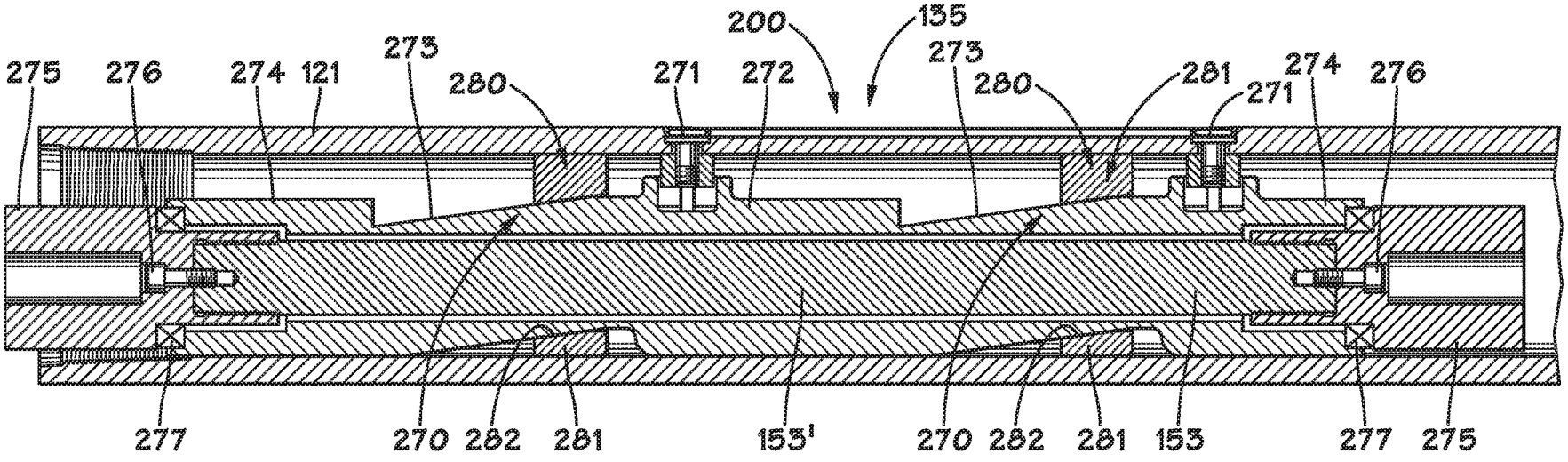
FIG. 57 is a partial cross-sectional view of another embodiment of an offset mechanism controller for the present biasing mechanism.
Figure 58:
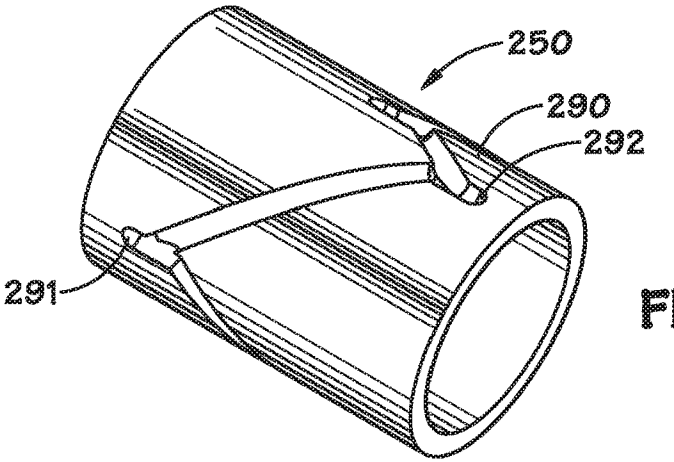
FIG. 58 is a perspective view of a ratchet piston actuator for use with the offset mechanism controller of FIG. 57.

With reference to FIGS. 57 and 58, another embodiment of offset mechanism 200 to be associated with the upper radial bearing assembly 135 and an offset mechanism controller 250 are illustrated. In FIG. 57, upper radial bearing assembly 135 is disposed within housing 121 of bearing section 120 and includes an offset mechanism 200. Offset mechanism 200 includes at least one ramp member 270 which cooperates with at least one mating support member 280 to permit relative motion between the at least one ramp member 270 and the at least one mating support member 280. In FIG. 57, two ramp members 270 are illustrated; however, as will be hereinafter described in greater detail, in connection with FIGS. 2 and 59, offset mechanism 200 may include only one ramp member 270 and one support member 280. The ramp member 270 may be fixed within housing, or collar, 121, as by at least one anchor bolt 271. The at least one ramp member 270 may be a mandrel 272 having a sloping, cylindrical, outer wall surface, or shank member, 273 associated with the third portion 153 of the bit shaft 150. The at least one mating support member 280 may be a ring member 281 having a mating internal bore, or mating, sloping bore, 282 for receipt of the sloping, cylindrical, outer wall surface 273 of the mandrel 272. The ring members 281 are disposed within housing 121, whereby the ring members 281 are axially movable within housing 121, and may be moved axially with respect to mandrel 272. Mandrel, or cylindrical member, 272 is stationary relative to the rotating upper portion 153' and is associated with both the offset mechanism and the upper radial bearing assembly 135. The ends 274 of mandrel, or cylindrical member, 272 are associated with at least one radial bearing, and preferably at least two radial bearings 277. Alternatively, as will be seen in connection with FIGS. 2 and 59, mating support member 280 may be fixed with respect to housing 121, and the at least one ramp member 270 is mounted for relative axial movement with respect to the support member 280.

Still with reference to FIG. 57, the present offset mechanism 200 of FIG. 57 creates a transverse plane offset of the third portion of offset shaft, or bit shaft, 153' by varying, or controlling, the location of the support member 280 with respect to the fixed sloping, cylindrical outer wall surface, or sloping shank member, 273 of mandrel 272. As ring members 281 are axially moved, or displaced, within housing 121, the mating supporting member 280, or ring members 281, force a transverse displacement of the third portion 153' of bit shaft 150 by an amount that is proportional to the axial displacement of the support members 280 and the angle of the sloping, cylindrical, outer wall surface, or shank, 273 of mandrel 272 with respect to the longitudinal axis of housing 121. When the at least one mating support member 280, or ring members 281 are disposed in the axial location shown in FIG. 57, the maximum amount of transverse displacement of bit shaft 153' obtained. When the ring members 281 are disposed at the opposite end of the sloping, cylindrical outer wall surface 273 from that illustrated in FIG. 57, the maximum transverse displacement of shaft 153' in the opposite direction is obtained. This location of ring members 281 positions bit shaft 153' in the straight-motor condition, or straight-drilling system condition. When ring members 281 are disposed intermediate the upper and lower ends of sloping, cylindrical outer wall surfaces 273, bit shaft 153' is in an intermediate-offset condition, wherein the amount of traverse displacement is between zero (0) and the maximum possible amount. The at least one mating support member 280, or ring members 281 could be axially displaced by a linear motor, or by hydraulic pressure from pump cycles, and a compression spring (not shown) could store the displacement energy for the return cycle of the ring members 281.

With respect to FIG. 58, an offset mechanism controller 250 for the offset mechanism 200 of FIG. 57 is illustrated. The offset mechanism controller 250 of FIG. 58 could be utilized to provide for the desired axial displacement of the at least one mating support member 280, or ring members 281. The embodiment of offset mechanism controller 250 of FIG. 58 is preferably a ratchet piston actuator 290 which operates in a similar manner to the first ratchet piston actuator 252 as previously described in connection with FIGS. 51-54. When the axial displacement of the at least one mating support member 280 is provided by hydraulic pressure from pump cycles, which acts on a piston, the desired axial displacement of the at least one mating support member 280 can be obtained by the use of ratchet piston actuator 290. The pump pressure forces the axial displacement of the ratchet piston actuator 290, which has a plurality of upper and lower stops, receptacles, or lock positions 291, 292, which cooperate with a pin member (not shown) similar to pin member 258 (FIG. 56) which cooperates with the first ratchet piston 252 as discussed in connection with FIGS. 51-54.

With respect to FIG. 59, an embodiment of mud motor 100 is shown wherein offset mechanism 200 differs from that described in connection with FIG. 57, in that this embodiment of offset mechanism 200 includes only one ramp member 270 which cooperates with only one mating support member 280, and the support member is fixed with respect to housing 121, while the ramp member is axially moveable. The mandrel 272' has a sloping, cylindrical outer wall surface, or shank member, 273'. The axial displacement of mandrel 272' with respect to fixed ring member 281' results in a proportional radial or transverse offset of bit shaft 153'. This offset forces the offset shaft, or bit shaft, 150 to tilt about the pivot 170, which in turn biases the bit shaft 150 to be angularly displaced to permit directional drilling of a borehole. A compression spring 285 may be provided and associated with mandrel 272 to provide motion to the ratchet piston actuator 290. As illustrated in FIG. 59, biasing mechanism 200 is shown with an axial position of mandrel 272' with respect to ring member 281' providing an angle of bit shaft tilt about pivot 170 of zero degrees. This is the straight-motor condition of this embodiment of mud motor 100. With reference to FIG. 2, the same embodiment of mud motor 100 is also illustrated, wherein the mandrel 272' is disposed with respect to ring member 281' to provide for substantially a maximum value of bit shaft tilt for bit shaft 150. The pivot 170 illustrated in FIGS. 2 and 59 may be the embodiment of pivot 170 illustrated and described in connection with FIG. 12, but it could also be any of the other embodiments of pivot 170, as illustrated and described in connection with FIGS. 3-11, and 11-15.

The biasing mechanism 160 can be configured to create orientation in a variety of downhole assemblies for various types of drilling systems. It is currently contemplated that traditional drilling systems which use mud motors having positive displacement motors or turbine motors will be the most frequent application. However, other variations of drilling systems could also use biasing mechanism 160, such systems including orientation for laser drilling, percussion drilling, hammer drilling, cable drilling, and sonic drilling, etc.

The drilling system can be conveyed in the borehole by various well known devices including, but not limited to, wireline, slickline, drill pipe, casing, tubing and autonomous means.

The driveshaft and offset shaft, or bit shaft, of such drilling systems can be comprised of internal and/or external cross-sectional configurations including, but not limited to, circular, circular with a circular or non-circular bore, polygonal, and polygonal with a circular or non-circular bore. It is known that modifying the shape of the shafts allow for higher torque and power transmission through the shaft.

The universal joint coupling design, such as joints 77' and 77" shown in FIG. 55, provides for torque transmission through a misaligned shaft. Other shaft designs that perform the same function may be utilized, including, but not limited to, flex shafts, hooke joints, etc. Such couplings can also contain devices to increase torque transfer, such as helical or elliptical couplings and/or for torsional damping, devices such as a torque converter.

The offset mechanism 250 controller may be designed for various applications. A simple fixed bend or adjustable bend can be created using a simple mechanical offset controller. It is contemplated that the system could be controlled while downhole through the use of downhole electromechanical systems and downhole electronics. Communication to these systems is contemplated through techniques known to those skilled in the art to include, but not be limited to, electromagnetic communication, wired drill pipe, communication through pressure pulses in the mud column, sound in the pipe and by radio frequency identification (RFID). It is contemplated that the offset mechanism controller 250 could communicate with other downhole systems and/or directly to the surface. As directional drilling operations proceed, if desired, the offset mechanism controller 250 may be operated to vary the offset angle, from the Earth's surface, without withdrawing housing 121 or the drill string, from the borehole and without removing axial load from the drill string.

Downhole sensors for measuring parameters internal and external to the biasing mechanism 160 may be utilized, such as inclinometers, magnetometers, gyroscopes, and/or combinations of these sensors, as well as other types of sensors known to those in the art. Measurements of external parameters include, but are not limited to: drilling parameters, such as rotation rate, inclination, azimuth, shock, vibration, temperature, pressure, etc.; and/or formation parameters, such as resistivity, naturally occurring gamma ray, pressure, density, water salinity, porosity, water volume, etc. An offset mechanism control system and/or toolface control system for use in a downhole drilling system could utilize information from such downhole sensors to modify the angular orientation or relative position of elements within the biasing mechanism 160 in response to predetermined, programmed, or real time information to achieve any desired angular displacement of offset shaft, or bit shaft, and/or relative toolface position to permit directional drilling of a borehole in a desired direction.

Figure 60:
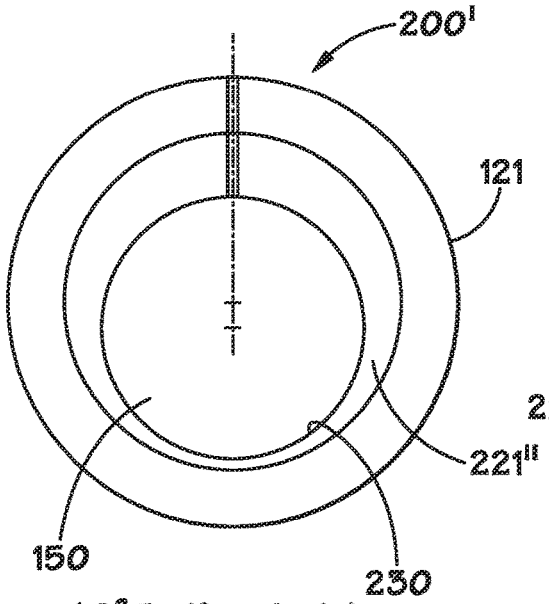
FIGS. 60 and 61 are partial cross-sectional end views of an embodiment of an offset mechanism used with a toolface controller.
Figure 61:
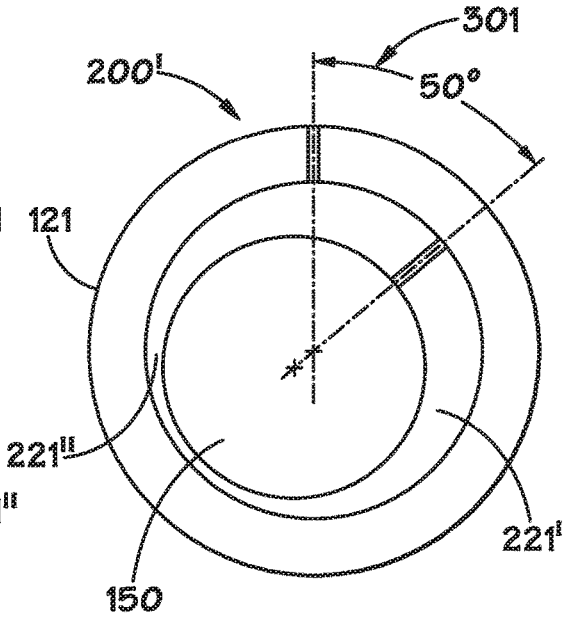

With reference to FIGS. 60-63, offset mechanisms 200 will be described which by use of toolface controller 300, to be hereinafter described in greater detail, permits the toolface, or toolface angle, to be varied during directional drilling operations between 0 degrees and 360 degrees. In the embodiment of offset mechanism 200' of FIGS. 60 and 61, a single eccentric cylinder 221", which may be of the same construction as inner cylinders 221, 221' previously described in connection with FIGS. 16-50, is disposed within housing 121, and disposed about bit shaft 150. The use of a single eccentric cylinder 221" provides a fixed, non-variable, axis tilt, a, or axis offset, e, for bit shaft 150, as previously described. Eccentric cylinder 221" is permitted to rotate within, and with respect to, housing 121. A radial bearing 230, as previously described, is preferably disposed between bit shaft 150 and eccentric cylinder 221", so that bit shaft 150 may rotate within and with respect to, eccentric cylinder 221". By use of a toolface controller 300, to be hereinafter described, and as shown in FIG. 61, by rotating eccentric cylinder 221" within, and with respect to, housing 121, the toolface angle 301 of a drill bit, associated with bit shaft 150 is varied from the 0° toolface angle of FIG. 60 to the approximately 50° toolface angle shown in FIG. 61. Accordingly, during directional drilling operations, a drill bit associated with bit shaft 150 of FIG. 61 will have a predetermined, fixed axis tilt, a, or angular offset, e, and a 50° toolface angle associated therewith. As directional drilling operations proceed, if desired, the toolface controller 300 may be operated to vary the toolface angle 301, from the Earth's surface, without withdrawing housing 121 or the drill string, from the borehole and without removing axial load from the drill string.

Figure 62:
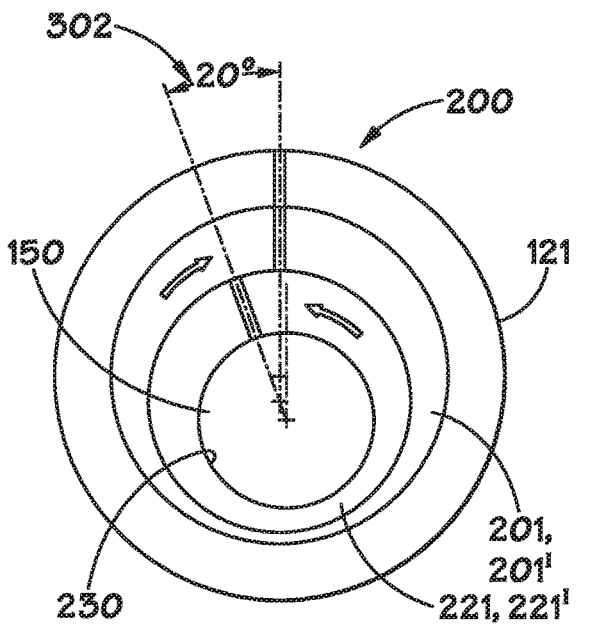
FIGS. 62 and 63 are partial cross-sectional end views of another embodiment of an offset mechanism used with a toolface controller.
Figure 63:
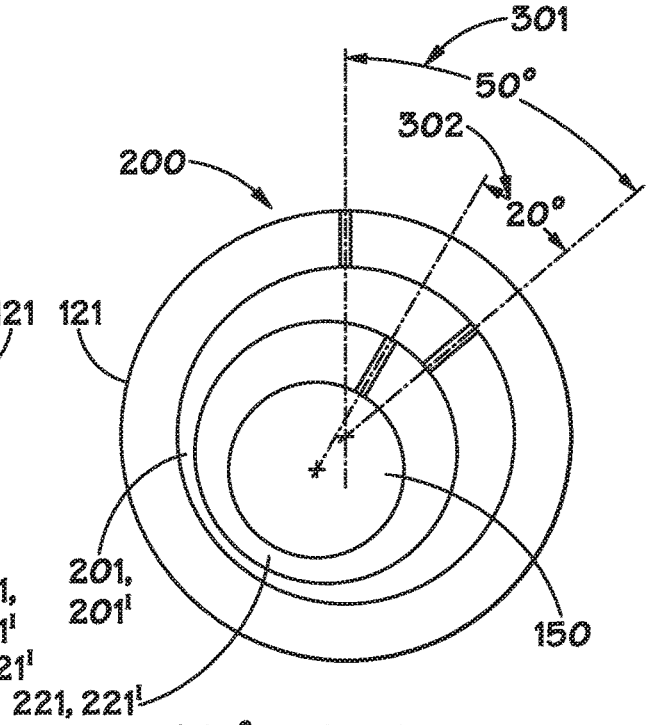

With reference to FIGS. 62 and 63, an offset mechanism 200 is illustrated which includes an eccentric outer cylinder 201 and an eccentric inner cylinder 221 as previously described in connection with FIGS. 16-33, or eccentric outer cylinder 201' and an eccentric inner cylinder 221' as previously described in FIGS. 34-50. Offset mechanism 200 is disposed within housing 121 about bit shaft 150. By counter-rotating outer and inner cylinders 201, 221, or 201', 221' as by use of an offset mechanism controller 250 previously described, a desired angular offset angle 302 between cylinders 201, 221 or 201', 221", is obtained which provides a desired axis tilt, a, or angular offset, e, associated with bit shaft 150. As seen in FIGS. 62 and 63, by fixing eccentric cylinders 201, 221, or 201', 221' substantially stationary with respect to each other with the desired offset angle 302, the desired offset angle 302 is maintained. Upon use of toolface controller 300, by rotating both eccentric cylinders 201, 221 or 201', 221' with respect to housing 121, a desired toolface angle, or toolface, 301 is obtained. By maintaining the relationship between housing 121 and the cylinders 201, 221, or 201', 221' of offset mechanism 200 as shown in FIG. 63, a desired axis tilt, a, or angular offset, e, of bit shaft 150 is maintained, while at the same time the desired toolface angle 301 for the drill bit associated with bit shaft 150 is also maintained. Again by use of toolface controller 300, the toolface angle 301 can be varied during drilling operations by rotating offset mechanism 200, or cylinders 201, 221, 201', 221' with respect to housing 121 to obtain any desired toolface angle 301. With respect to the offset mechanism 200 of FIGS. 62 and 63, an offset mechanism controller 250 may be utilized to provide the desired offset angle 302 between the eccentric cylinders 201, 221 or 201', 221' of offset mechanism 200, as previously described. As with the offset mechanism controller 250 previously described, toolface controller 300 may provide the necessary movement, or rotation, of offset mechanisms 200, 200' by a system of motors, such as electrical motors, hydraulic motors, or electro-mechanical assemblies or other devices, a single motor with a reverse-direction gear mechanism, or by hydraulic pressure from pump cycles. Alternatively, the toolface controller 300 could be manipulated, or operated, in an indirect manner by parasitically harnessing the rotary power of the drive shaft 76' (FIG. 2). This could be accomplished by causing a clutch, mechanical or electrical, to engage the drive shaft temporarily, such that a portion of its rotary power is transferred to one or both of the cylinders. The duty cycle of clutch engagement could be controlled by suitable electronics and result in the controlled and desired movement of the eccentric cylinders of offset mechanism 200, 200'.

Figure 64:
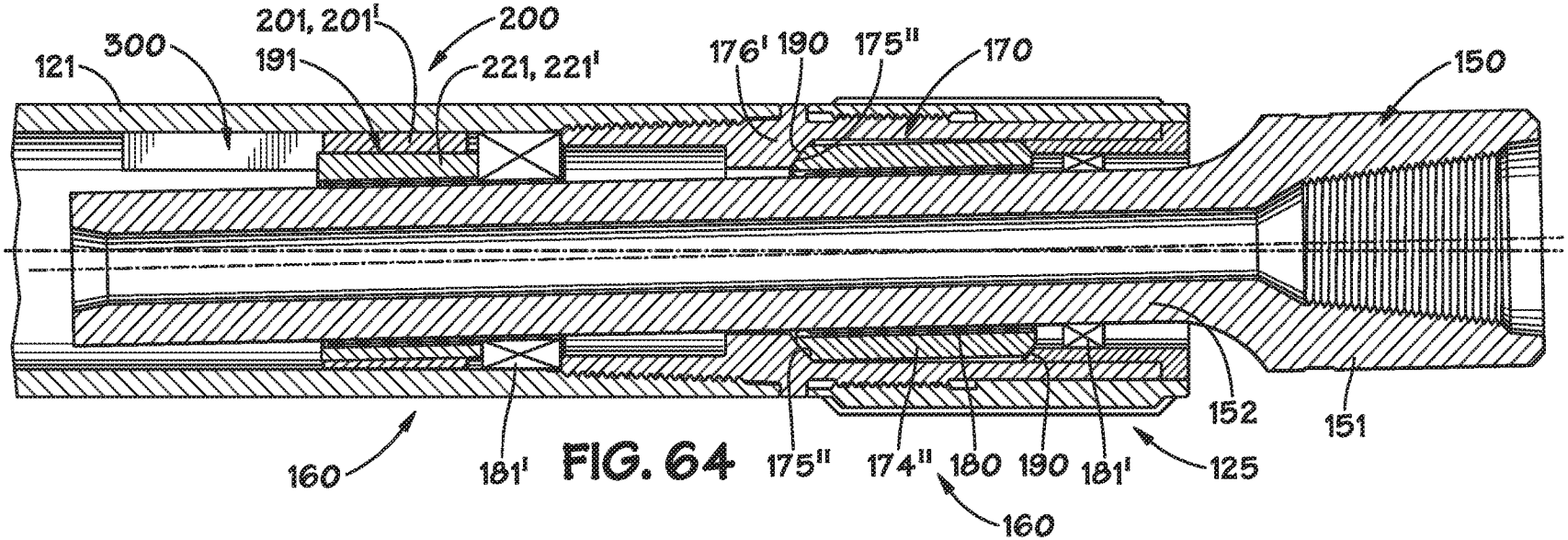
FIG. 64 is a partial cross-sectional view of an embodiment of a biasing mechanism, which includes a toolface controller.

With reference to FIG. 64, an embodiment is illustrated of a biasing mechanism 160 including an offset mechanism 200, having 2 rotatable eccentric cylinders 201, 221 or 201', 221' as previously described in connection with FIGS. 16-50, and which is previously shown in FIG. 14. Any suitable offset mechanism controller 250 and/or actuator 251 as previously described, may be utilized to provide the desired offset angle 302 between the eccentric cylinders, as previously described in connection with FIGS. 62 and 63. Toolface controller 300 is shown associated with offset mechanism 200 and may be operated to rotate and fix the relative positions between the eccentric cylinders 201, 221 or 201', 221' with respect to each other as described in connection with FIGS. 62 and 63, and to then rotate the two relatively stationary, fixed eccentric cylinders 201, 221, or 201', 221' of the offset mechanism 200 to obtain the desired toolface angle 301, as previously described in connection with FIG. 63. If desired, the offset mechanism controller 250, not shown, could be incorporated as a part of, or integrated with, toolface controller 300, so that toolface controller also includes the components of the offset mechanism controller 250. Accordingly, the biasing mechanism 160, offset mechanism 200, and toolface controller 300, along with an offset mechanism controller 250, of FIG. 64 may be operated in directional drilling operations with the toolface angle 301 of FIG. 63 being able to be continuously, or selectively, varied and adjusted throughout directional drilling operations, without removal of housing 121 from the borehole. Simultaneously therewith, the offset angle 302 of FIG. 63 which produces the desired axis tilt, a, or angular offset, e, of a drill bit associated with bit shaft 150 may also be varied without removal of housing 121 from the borehole. Suitable communication and controls may be provided to control the actuation and operation of the toolface controller 300, and related components, as by use of the devices previously described herein to actuate and control the offset controller 250.

Figure 65:
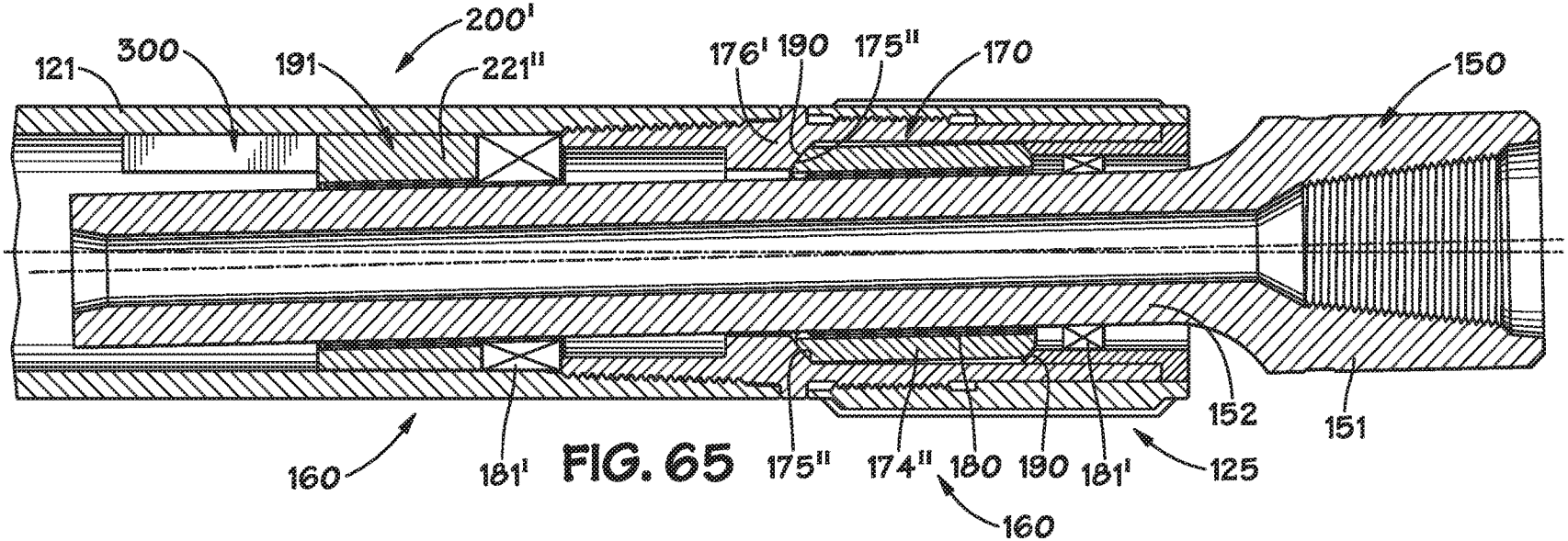
FIG. 65 is a partial cross-sectional view of another embodiment of a biasing mechanism, which includes a toolface controller.

With reference to FIG. 65, a toolface controller 300 is shown associated with an offset mechanism 200' as previously described in connection with FIGS. 60 and 61. As described in connection with FIGS. 60 and 61, toolface controller 300 may be operated to rotate eccentric cylinder 221" in the manner previously described in connection with FIGS. 60 and 61 to obtain the desired toolface angle 301 as shown and described in connection with FIG. 61. By use of toolface controller 300 in combination with the single eccentric cylinder 221" of offset mechanism 200', the toolface angle 301 may be varied and adjusted during directional drilling operations, without removal of housing 121 from the borehole, and the axis offset, e, or axis tilt, a, associated with bit shaft 151 will remain fixed. The selection of the particular eccentric cylinder 221" for offset mechanism 200' determines the specific, fixed axis offset, e, or axis tilt, a.

Figure 66:
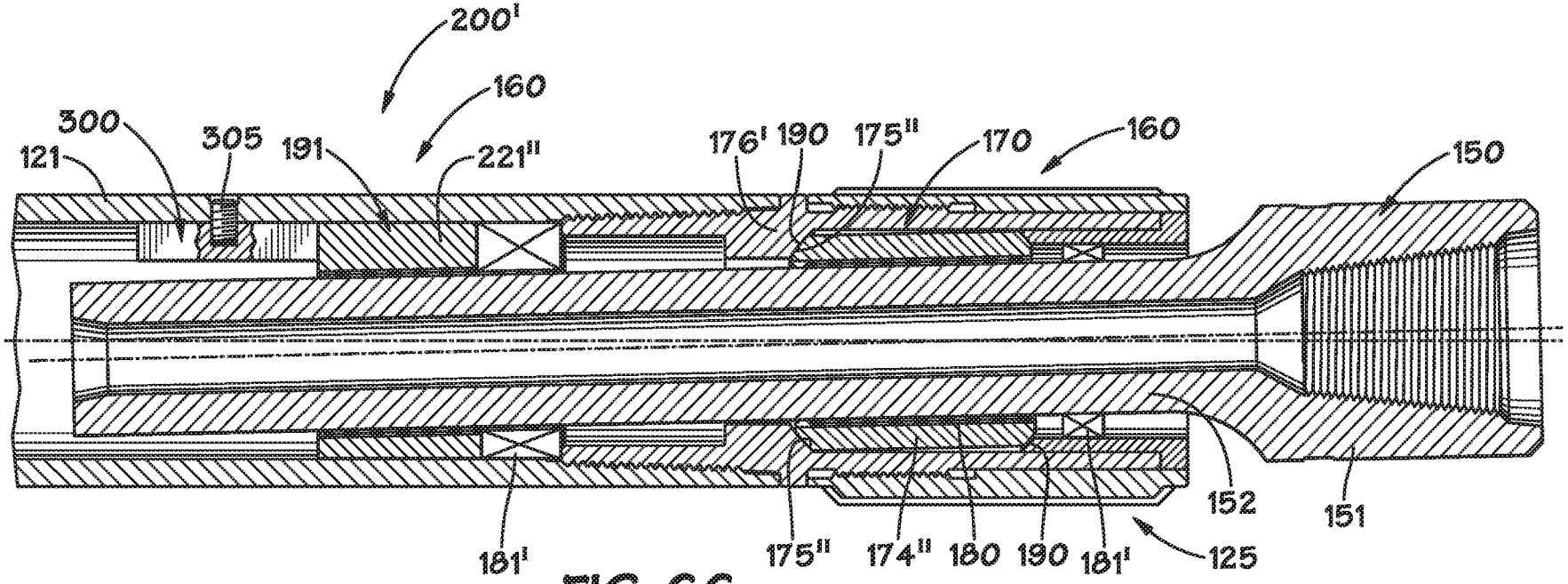
FIG. 66 is a partial cross-sectional view of another embodiment of a biasing mechanism, which includes a toolface controller.

With reference to FIG. 66, an embodiment is illustrated of a biasing mechanism 160, including an offset mechanism 200' having a single eccentric cylinder 221", similar to that described in connection with FIG. 65 is shown. By locking, or securing, toolface controller 300 with respect to housing 121, as by use of a locking pin or other suitable, similar structure, the selected toolface angle 301 (FIG. 61) is fixed. Locking the toolface controller 300 can be done at the time the system is assembled or through a configurable device at the wellsite prior to entering the borehole. As will hereinafter be described in connection with FIG. 67, the use of the biasing mechanism 200' of FIG. 66 in a mud motor, or drilling system, 100 provides a drilling system having a fixed toolface angle 301 and a fixed axis offset, e, or axis tilt, a.

Figure 67:
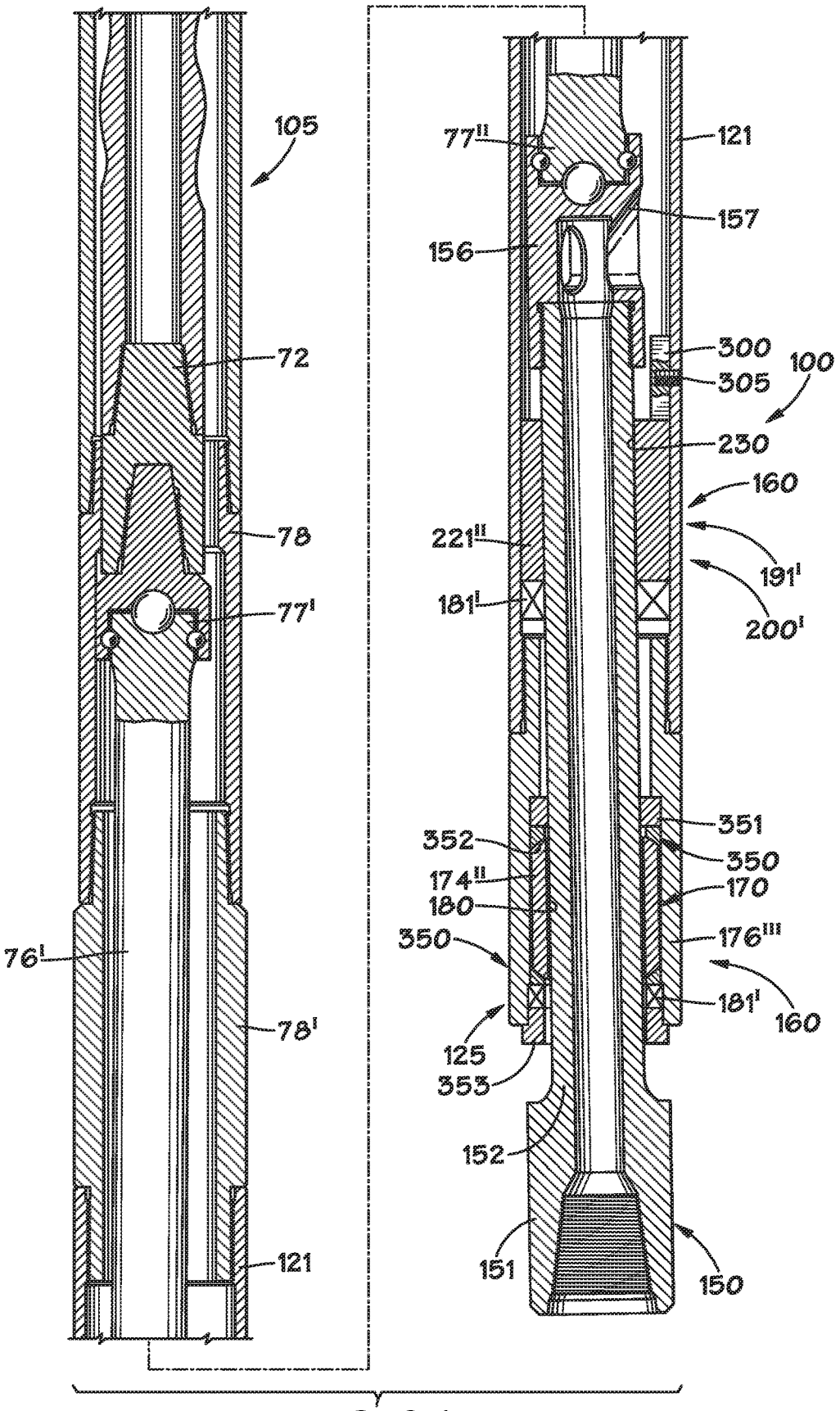
FIG. 67 is a partial cross-sectional view of an embodiment of the present drilling system, or mud motor, with the biasing mechanism of FIG. 66.

With reference to FIG. 67, another embodiment of a mud motor, or drilling system, 100 is shown utilizing a biasing mechanism 160 as shown and described in connection with FIG. 66. This mud motor, or drilling system, 100 generally includes a power section 105, which preferably includes a positive displacement motor, such as a Moineau section, or pump, 72 as previously described, or any other suitable down hole power section 105 as previously described in connection with FIGS. 2 and 59. A drive shaft 76' is associated with the pump 72, as by a CV joint 77'. Power section 105 may include a drill collar, or housing, 78 which may be threadedly connected to an intermediate drill collar, or housing, 78' which in turn is threadedly connected to the bearing section housing 121. Bit shaft 150, as previously described, is received within bearing section housing 121 and bias housing 176''' and is operatively associated with the drive shaft 76' as by another CV joint 77". Bit shaft 150 may include a flow diverter 156 having a plurality of flow passages 157 for circulation of drilling fluid, or drilling mud, through bit shaft 150. Flow diverter 156 may be a separate component or formed integral with bit shaft 150.

Still with reference to FIG. 67, spherical pivot member 174" is provided with an axial, or thrust, bearing 350, or 181', disposed on either side of spherical pivot member 174". The upper axial bearing 350 may include an annular backup ring member 351 disposed about bit shaft 151, and backup ring member 351 bears against an annular pivot socket member 352. The annular pivot socket member 352 has a concave spherical shaped pivot surface which bears against, and mates with, the outer spherical shaped surface of spherical pivot member 174'. A retaining ring 353 may be threadedly received within the end of bias housing 176'''. Retainer member, or retaining ring, 353 retains the lower thrust bearing 350, or 181', and spherical pivot member 174" within bias housing 176''', and is disposed about the second portion 152 of bit shaft 151. The thrust bearings 350, 181' adjacent the pivot member 174" on bit shaft 151 serve as an on-bottom thrust bearing when the drilling system 100 is at the bottom of a borehole with the drill bit 500 (FIG. 70) abutting the bottom of the borehole. The other thrust bearing 181', adjacent offset mechanism 200' bearing serves as an off-bottom thrust bearing, when the drill bit is not abutting the bottom of a borehole, and may have the structure and operation of bearings 370, 370' hereinafter described in connection with FIGS. 69-70. The concave, spherical shaped bearing, or pivot, surfaces formed on the annular pivot socket member 352 may be formed of any suitable material having the requisite strength and bearing characteristics necessary for a bearing operating in a drilling system 100 downhole, such as polycrystalline diamond elements, or carbide elements, such as tungsten, carbide and other bearing surfaces known within the art. The axial, or thrust, bearings 350, or 181', adjacent the pivot member 174 could have the structure and operation of bearings 350' and 350" hereinafter described in connection with FIGS. 69-70.

Biasing mechanism 160 in FIG. 67 is that shown and described in connection with FIG. 66, and utilizes a single eccentric ring 221" as offset mechanism 200'. A toolface controller 300 may be fixed, or releasably secured, to housing 121 as by pin 305. This mud motor, or drilling system, 100 is typically assembled in a shop associated with the drilling operations, at which time the particular eccentric cylinder 221" is selected, the toolface controller 300 rotates the offset mechanism 200' to provide a desired toolface angle 301 (FIG. 61), and the toolface angle is fixed, as by use of the locking device 305. Directional drilling operations may then be commenced, whereby drilling system 100 of FIG. 67 drills a borehole with a fixed axis tilt, a, or axis offset, e, resulting from the use of the single eccentric cylinder 221", and with a fixed toolface angle 301.

Figure 68:
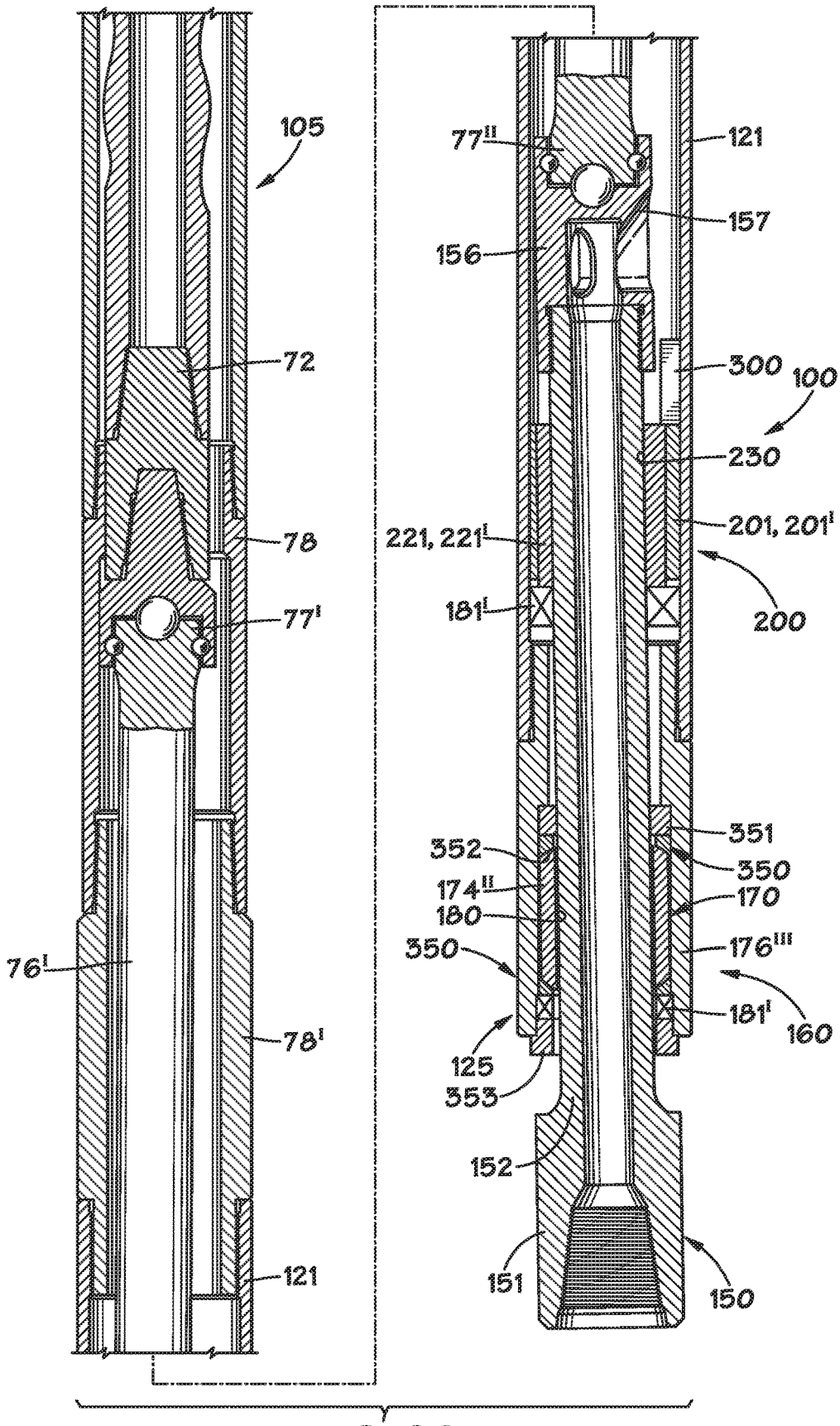
FIG. 68 is a partial cross-sectional view of an embodiment of the present drilling system, or mud motor, as shown in FIG. 67, with the biasing mechanism of FIG. 64.

With reference to FIG. 68, another embodiment of a mud motor, or drilling system, 100 is shown which is substantially the same as the drilling system 100 shown in FIG. 67, wherein a biasing mechanism 160 as shown and previously described in connection with FIG. 64 is utilized. Biasing mechanism 160 utilizes two rotatable eccentric cylinders 201, 221 or 201', 221' as offset mechanism 200', as previously described in connection with FIGS. 16-50, and previously shown in FIG. 14. Any suitable offset mechanism controller 250 and/or actuator 251 as previously described, may be utilized to provide the desired offset angle 301 (FIG. 62) between the eccentric cylinders, as previously described in connection with FIGS. 62 and 63. Tool face controller 300 is shown associated with offset mechanism 200' and may be operated to rotate and fix the relative positions between the eccentric cylinders 201, 221 or 201', 221' with respect to each other as described in connection with FIGS. 62 and 63, and to then rotate the two relatively stationary, fixed eccentric cylinders 201, 221, or 201', 221' of the offset mechanism 200 to obtain the desired tool face angle 301, as previously described in connection with FIG. 63. If desired, the offset mechanism controller 250, not shown, could be incorporated as a part of, or integrated with, toolface controller 300, so the toolface controller also includes the components of the offset mechanism controller 250. Accordingly, the biasing mechanism 160, offset mechanism 200, and toolface controller 300, along with an offset mechanism controller 250, of FIG. 64 may be operated in directional drilling operations with the toolface angle 301 of FIG. 63 being able to be varied and adjusted throughout directional drilling operations, without removal of housing 121 from the borehole. Simultaneously therewith, the offset angle 302 of FIG. 63 which produces the desired axis tilt, a, or angular offset, e, of the drill bit associated with bit shaft 150 may also be continuously, or selectively, varied without removal of housing 121 from the borehole. Suitable controls may be provided to control the actuation and operation of the toolface controller 300, and related component, as by use of the device as previously described to actuate and control the offset controller 250. All the other components of this embodiment 100 of mud motor, or drilling system, 100 are the same as previously described in connection with FIG. 67, including axial, or thrust, bearings 350, 181'. The embodiment of mud motor, or drilling system, 100 of FIG. 68 also includes power section 105 as previously described in connection with FIGS. 2 and 59, which would be associated with drilling system 100 of FIG. 67.

Figure 69:
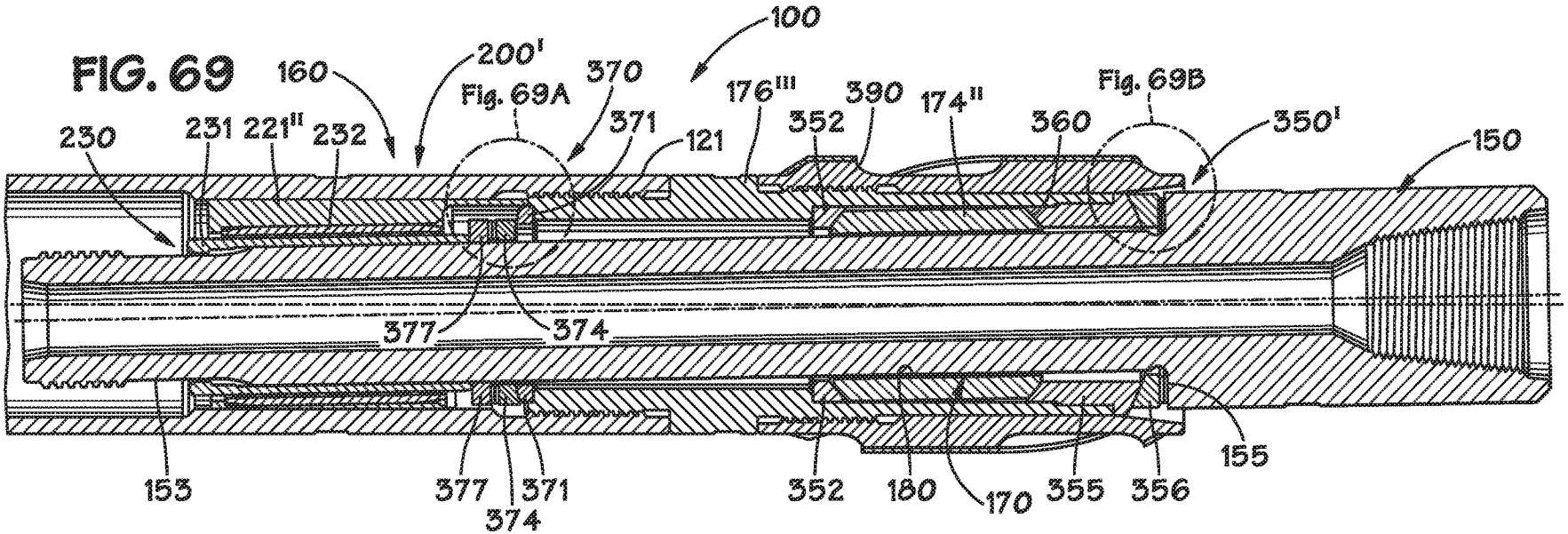
FIG. 69 is a partial cross-sectional view of an embodiment of the present drilling system, or mud motor, with a biasing mechanism similar to that of FIGS. 65 and 66, and further illustrating embodiments of axial thrust bearings.
Figure 70:
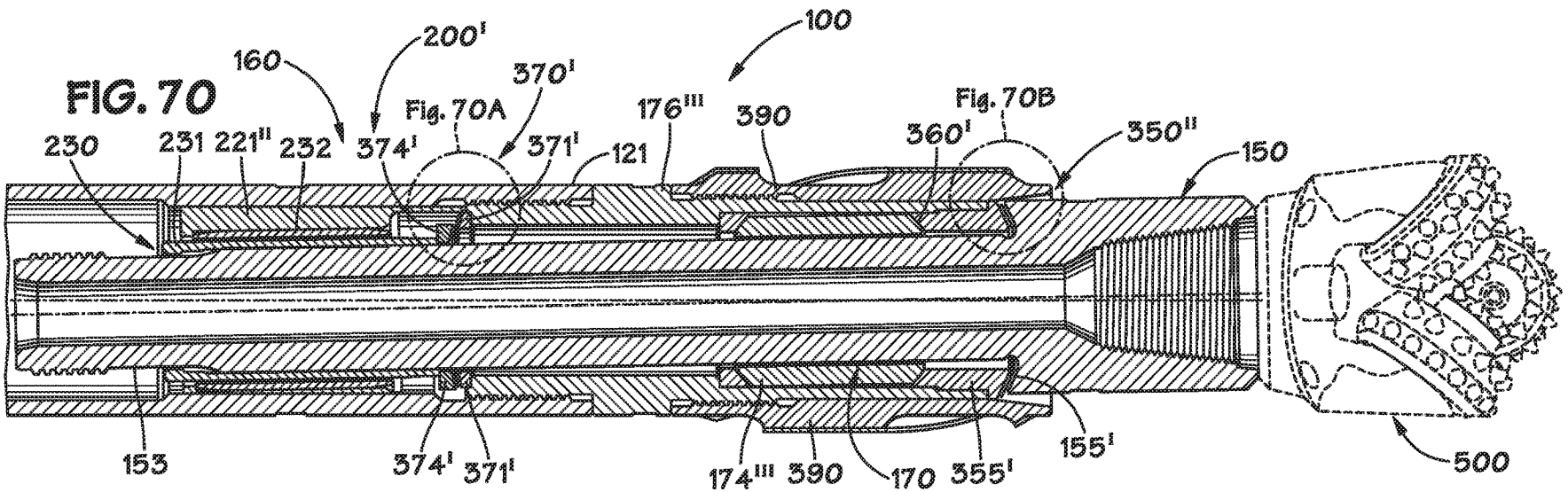
FIG. 70 is a partial cross-sectional view of an embodiment of the present drilling system, or mud motor with a biasing mechanism similar to that of FIGS. 65 and 66, and further illustrating additional embodiments of axial thrust bearings.

With reference to FIGS. 69 and 70, embodiments of axial, or thrust, bearings 350', 350", suitable for use in connection with spherical pivot ball member 174" are shown. Thrust bearings 350' or 350" may be used for the previously described thrust bearings 181, 181', 181'", and 181'" associated with pivot member 170 as shown in FIGS. 12-15, and FIGS. 64-68. FIGS. 69 and 70 also illustrate axial, or thrust bearings, 370, 370', suitable for use as the axial, or thrust, bearings 181', associated with offset mechanisms 200, 200', shown in connection with FIG. 14, and FIGS. 64-68.

With reference to FIGS. 69 and 70, the drilling systems 100 include a biasing mechanism 160 having an offset mechanism 200' as previously shown and described in connection with FIGS. 65, 66, and 67, and utilizes a single eccentric cylinder 221". The drilling system 100 includes a modified bias housing 176'" of FIGS. 67 and 68, to provide for the placement of a conventional stabilizer 390 disposed about the outer surface of biasing housing 176'". Conventional stabilizer 390 can define a near-bit touch point, which can also be provided by other external devices that create such a touch point and create stand-off with the borehole, such as a kick-ad. The pivot 170, or spherical shaped pivot member 174" is disposed about a radial bearing 180, as previously described.

Figure 69B:
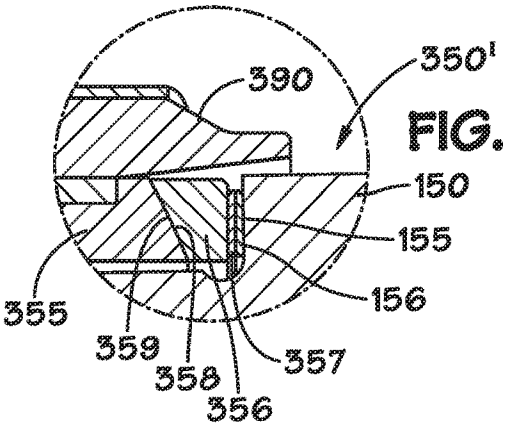
FIGS. 69A and 69B are exploded views of portions of FIG. 69, as indicated in FIG. 69.

With reference to FIGS. 69 and 69B, the thrust bearing 350' includes an annular pivot socket member 352 as previously described in connection with thrust bearing 350 of FIGS. 67 and 68. The annular pivot socket member, or pivot socket, 352 has a concave, spherical shaped bearing, or pivot, surface which contacts and mates with the spherical outer surface of pivot member 174". Disposed between the spherical outer surface of pivot member 174" and bit shaft 150 are an annular load washer 355 and an annular pivot socket member, or stationary bearing stator, 356. Bit shaft 150 is provided with an annular shoulder 155, which bears against the annular pivot socket member 356. Shoulder 155 of bit shaft 150 includes a generally planar wall surface 156 disposed substantially perpendicular to the longitudinal axis of the bit shaft 150. The wall surface 156 of shoulder 155 serves as a bearing rotor of a rotating plane bearing and bears against the mating planar wall surface 357 of annular pivot socket member 356, which functions as a bearing stator of the rotating plane bearing. As bit shaft 150 rotates within housing 121, the rotating wall surface 156 of shoulder 155 bears against the stationary wall surface 357 of annular pivot socket member 356. Of course, alternatively and if desired, instead of this bearing rotor being formed integral with bit shaft 150 via shoulder 155, a separate bearing rotor structure could be utilized and disposed between bit shaft 150 and pivot socket member 356.

On the other side of annular pivot socket member 356 is a concave spherical pivot, or bearing, surface 358 which bears, or shoulders against, a convex spherical pivot surface 359 of annular load washer 355. The other end of load washer 355 has a concave, spherical shaped pivot surface 360 which bears and shoulders against the outer convex, spherical shaped outer surface of spherical pivot member 174". The spherical shaped convex and concave bearing, or pivot, surfaces 156, 357, 358, 359, 360 and pivot member 174" may be provided with any suitable bearing material such as polycrystalline diamond element, or carbide elements, as previously described, and as are known within the art. Thrust bearing 350' thus can transfer axial loads, in an on-bottom condition to the bearing housing 121 via bias housing 176".

With reference to FIG. 69, bearing 180 supports the bit shaft 150 against lateral displacement relative to the bearing housing provided by housing 121 and bias housing 176'". The spherical pivot or bearing surfaces of pivot member 174" allow for misalignment and/or deviation between the axis of the bit shaft 150 and the bearing housing 121, 176'". Side loads against the bit shaft 150 are transferred to the radial bearing 180 on bit shaft 150 to the stator of radial bearing 180 secured to pivot member 174". The radial loads are then transferred from radial bearing 180 to the bearing housing 121, 176'". Once the radial load is transferred to the bearing housing 121, 176'", the radial loads are supported by the housing 121, 176'", if drilling system 100 does not include stabilizer 390, or to the formation surrounding the borehole, if drilling system 100 includes stabilizer 390.

Figure 69A:
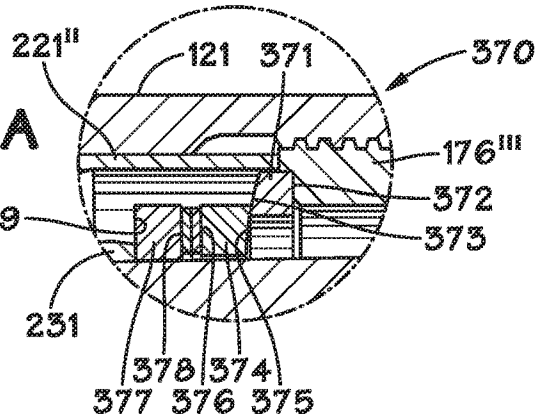

With reference to FIGS. 69 and 69A, an axial, or thrust, bearing 370 is associated with the offset mechanism 200' of FIG. 69, which is in turn associated with radial bearing 230. Radial bearing 230 includes a radial bearing journal rotor member 231 associated, and rotatable, with bit shaft 150, and a radial bearing stator 232 associated with eccentric ring 221". Thrust bearing 370 includes an annular load washer 371 having a planar surface 372 abutting against a portion of the bias housing 176'", and a spherical shaped pivot, or bearing surface 373 which abuts against an annular bearing stator 374 having a spherical shaped pivot, or bearing, surface 375 in an abutting relationship with bearing surface 373 of load washer 371. Stator 374 also has a bearing surface 376 which is disposed in a plane substantially perpendicular to the longitudinal axis of housing 121. Disposed between radial bearing journal rotor 231 and stator 374 is an annular bearing rotor 377 having a bearing surface 378 in an abutting relationship with bearing surface 376 of stator 374, and a bearing surface 379 in an abutting relationship with radial bearing rotor 231.

Thrust bearing 370 functions as an off-bottom axial, or thrust, bearing, which transfers axial forces to the bias housing 176'" and housing 121, when the drill bit associated with bit shaft 150 is disposed in a spaced relationship from the bottom of a borehole. Thrust bearing 350' serves as the on-bottom thrust bearing for drilling system 100 when a drill bit associated with bit shaft 150 is in contact with the bottom of a borehole. Radial bearing 230 acts as a radial bearing support and is also part of the offset mechanism 200' by which the bit axis offset is obtained, as previously described. Bearing 230 is offset and/or deviated from the center-line, or longitudinal, axis of the bearing housing 121 so as to force the upper end, or third portion, 153 of bit shaft 150 to the desired asymmetric, deviated and/or offset position. The bit shaft 150 remains free to rotate relative to the bearing housing 121 because the deviation created by the radial bearing 230 results in an offset axis that still passes through the center point of the bearing assembly pivot. This pivot center point is defined by the center point of the pivot spherical surfaces, and all other spherical pivot surfaces have radii origins that are collocated with the pivot center point.

Still with reference to FIGS. 69, 69A, and 69B, the load washer 371 and stator 374 of thrust bearing 370 are quasi-static relative to each other during operation of drilling system 100. The load washer 371 and stator 374 do not rotate within bearing housing 121, as is the case with the bit shaft 150 which is rotating within housing 121, 176'". The load washer 371 and bearing stator 374 only move relative to each other, either in rotation or translation, when the longitudinal axis of the bit shaft 150 is undergoing deviation relative to the longitudinal axis of the bearing housing 121. Similarly, the radial bearing journal rotor member 231 and bearing rotor 377 of thrust bearing 370 are static relative to each other during operation of drilling system 100. The radial bearing journal rotor member 231 and rotor 377, rotate with the bit shaft 150 which is rotating within housing 121, 176'''. Another way to express this concept is that the axial plane bearing and radial bearing surfaces are subjected to higher frequency motion than the relative lower frequency motion of the spherical pivot surfaces. Similarly, pivot socket member 352, pivot socket member 356 and annular load washer ring 355 of thrust bearing 350' are not subjected to the rotary motion of the bit shaft 150 relative to the bearing housing 121, 176'''. They also only move relative to each other, either in rotation or translation, when the axis of the bit shaft 150 is undergoing deviation relative to the longitudinal axis of the bearing housing 121, 176'''.

Figure 70B:
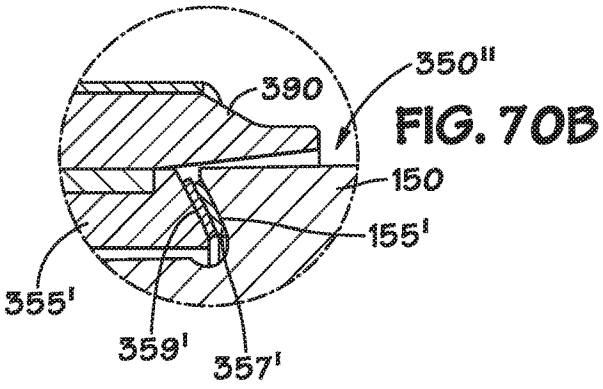
FIGS. 70A and 70B are exploded views of portions of FIG. 70, as indicated in FIG. 70.
Figure 70A:
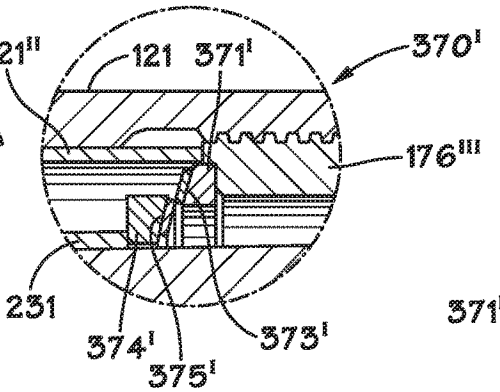

With reference to FIGS. 70, 70A, and 70B, another embodiment of axial, or thrust, bearing 350" and axial, or thrust, bearing 370' are shown. In these embodiments, there are not plane bearings, or bearing surfaces, disposed in planes substantially perpendicular to the longitudinal axis of bit shaft 150 or bearing housing 121, 176'. In this regard, as will be hereinafter described, components of bearings 350' and 370' have been combined, whereby there are not plane bearing surfaces, such as those of 156, 357 and 376, 378, of FIG. 69. Bit shaft 150 is provided with a spherical, concave annular shoulder 155' having a generally spherical shaped bearing, or pivot, surface 357', which serves as a bearing rotor that bears and shoulders against an annular bearing stator 355' having a convex, spherical shaped bearing surface 359'. The other end of stator 355' has a concave, spherical shaped bearing, or pivot, surface 360' which bears and shoulders against the outer convex, spherical shaped outer surface of spherical pivot member 174".

With reference to FIGS. 70 and 70A, axial, or thrust, bearing 370' includes an annular bearing stator 371' and an annular bearing rotor 374'. Stator 371' has a convex, spherical shaped bearing surface 373' which bears against a mating, spherical shaped bearing, or pivot, surface 375' on rotor 374'. The transfer of axial and radial loads and the offset and/or deviation of axis is essentially the same as that previously described in connection with the bearings 350' and 370 of FIG. 69. The spherical pivot, or bearing, surfaces 357', 359' and 373', 375' see the same frequency of motions as that of the rotating bit shaft 150. Similarly, the rotors and stators also potentially experience rotation and/or translation with respect to each other resulting from the offset of the bit shaft 150 and bearing housing 121 center-line, or longitudinal axis.

The foregoing described bearings, including axial, or thrust, bearings 350, 350', 350", 370, and 370', and radial bearings 180 and 230 cooperating therewith as previously described, provide a variable offset bearing assembly associated with the offset, or bit, shaft 150 and housing 121, 176''' that allows for, or permits, axial misalignment between the longitudinal axes of the offset shaft 150 and the housing 121, 176", as well as manages axial and radial misalignment of the radial and thrust bearings associated with the offset shaft and housing caused by any axial or radial forces exerted upon the housing and offset shaft by drill bit 500 (FIG. 70).

The drilling systems 100 illustrated in FIGS. 69 and 70 are shown with a biasing mechanism 160 which utilizes only one eccentric cylinder 221" as offset mechanism 200. If desired, two eccentric cylinders 201, 221, or 201, 221', as previously described could be utilized as offset mechanism 200'. Similarly, the drilling systems 100 of FIGS. 69 and 70 could be provided with toolface controllers 300, offset mechanism controllers 250 and/or actuator 251, whereby the drilling systems of FIGS. 69 and 70 may be operated in directional drilling operations with the toolface angle 301 and axis tilt, or angular offset, of the drill bit associated with bit shaft 150 being continuously, and/or selectively varied during such drilling operations without removal of housing 121 from the borehole.

With reference to the mud motor, or drilling system, 100 of FIGS. 2 and 59, it should be noted that although a variable axis tilt, a, or axis offset, e, may be obtained with this drilling system during drilling operations without removal of housing 121 from the borehole, it has a fixed toolface, or toolface angle. This drilling system 100 of FIGS. 2 and 59 could be provided with a toolface controller 300 which could rotate the offset mechanism 200 of FIGS. 2 and 59, as by rotating ramp member 270 of offset mechanism 200 of FIGS. 2 and 59. Alternatively, if desired, the drilling system 100 of FIGS. 2 and 59 could provide for a fixed axis tilt, a, or axis offset, e, and through use of a toolface controller 300 (not shown) could be provided with a variable toolface angle 301.

Similarly, with reference to the mud motor, or drilling system, 100 of FIGS. 55 and 56, this drilling system 100 has a variable axis tilt, or axis offset, which can be varied during drilling operations without removal of housing 121 from the borehole, but it has a fixed, non-variable toolface, or toolface angle. By providing a toolface controller 300 in combination with the offset mechanism 200 and offset mechanism controller 250 of FIGS. 55 and 56, the drilling system 100 of FIGS. 55 and 56 could also be provided with a variable toolface, or toolface angle 301 during drilling operations.

The offset mechanism 200 of FIGS. 57 and 58 could similarly be utilized in a drilling system to provide a variable toolface angle 301, by providing a toolface controller 300 (not shown) that could provide for rotation of the at least one mating support member 280 shown in FIG. 57, wherein two mating support members 280 are illustrated.

With reference to all of the biasing mechanisms 160, and in particular the pivot 170 of each of them as illustrated in FIGS. 2 and 59, FIG. 3, FIG. 12, FIG. 13, FIG. 14, FIGS. 55 and 56, and FIGS. 64-70, it should be noted that the distance, D, from the mid-point (as measured along the longitudinal axis of each pivot 170, which longitudinal axis generally corresponds to the longitudinal axis of housing 121), MP (FIG. 2) of each pivot 170 to the bit box face 151" (FIG. 2) is less than 36 inches, and more preferably less than 30 to 32 inches. Even more preferably would be for distance, D, to be less than 24 to 32 inches, and a most preferred distance, D, would be less than approximately 24 inches.

It should be noted that in all of the foregoing described embodiments of the present mud motors, or drilling systems, 100, as shown in FIGS. 2-3, 12-15, 55-56, 59 and 64-70, housing 121 is a non-sealed housing. The bearing section 120, including its bearings, and the biasing mechanism 160, offset mechanism 200, and related components are thus exposed to the drilling mud, or drilling fluid, and are not lubricated by oil. In most conventional down-hole systems, which utilize seals and sealed housings, the components therein are only exposed to, and lubricated by, oil, or other similar lubricants, and the seals and/or sealed housings prevent the components therein from being contacted by drilling mud, or drilling fluids. The drill string is moved, such as by pushing it, until the drill bit (FIG. 70) of drilling system contacts the bottom of the borehole.

The drilling system, or mud motor, 100 as previously described is utilized to directionally drill a borehole in the following manner. The drill string is moved, such as by pushing it, until the drill bit 500 (FIG. 70) of drilling system 100 contacts the bottom of the borehole. Preferably, the borehole is drilled while the drill string, or drill pipe, and the mud motor, or drilling system, 100 are pushed forward within the borehole, without rotation of the drill pipe, or drill string, which is generally referred to as a slide, as previously described, or as using the mud motor, or drilling system, 100 in a "sliding mode". During a slide, or in the sliding mode, only the drill bit is rotating with respect to the housing 121 as it is rotatably driven by the bit shaft 150 by the mud motor, or drilling system 100. As is known in the art, the force on the drill bit that provides the axial force that allows the drill bit to put pressure on its cutters and enables the cutting or crushing of the formation in which the borehole is being drilled is known as "Weight on Bit", or "WOB". The WOB is typically controlled and applied to the drill bit by lowering the drill string and drilling system 100 from the surface, and typically the drill string and drilling system 100 will be lowered at the same pace, or rate, as the drill bit is cutting into, or crushing, the formation in which the borehole is being drilled.

The drilling system, or mud motor, 100 previously described herein is utilized to directionally drill a borehole during a slide, or in sliding mode, during which time the axis tilt, a, or angular offset, e, associated with bit shaft 150, or the angular relationship between the longitudinal axes of the housing 121 and bit shaft 150 as previously described, is "actively managed". Additionally during a slide, the toolface angle, or toolface orientation, of the drill bit associated with the bit shaft 150, may also be "actively managed". The term "actively manage" means in this specification and its claims that the axis tilt, or angular offset, associated with bit shaft 150, or the angular relationship between the longitudinal axes of the housing 121 and bit shaft 150, may be continuously and selectively varied and controlled while the mud motor, or drilling system, 100 is in the borehole with the bit shaft 150, and its associated drill bit, rotating and drilling the borehole without rotation of the drill string or the housing 121 of bearing section 120, as previously described, without removal of the drilling system 100 from the borehole, and while maintaining WOB on the drill bit. Similarly, to "actively manage" toolface angle means in this specification and its claims that the toolface angle of drilling system, or mud motor, 100 may be continuously and selectively varied and controlled while bit shaft 150 and its associated drill bit are rotating to directionally drill the borehole, without rotation of the housing 121 of bearing section 120, without removal of the drilling system, or mud motor, 100 from the borehole. As previously described, the axis tilt, or angular offset, associated with bit shaft 150 may be continuously and selectively varied and controlled by operation of the biasing mechanism 160 previously described, including offset mechanisms 200, 200', as well as previously described offset mechanism controllers 250 and/or actuators 251. The toolface angle may be continuously and selectively varied and controlled during drilling operations by use of toolface controller 300, as previously described.

If desired, drilling system, or mud motor, 100 may also be operated with: a fixed, non-variable, axis tilt or axis offset of bit shaft 150 and a fixed toolface angle as shown and described in connection with FIGS. 66 and 67; or with a variable toolface angle with a fixed, non-variable, axis tilt or axis offset as shown and described in connection with FIG. 65; or with continuously and selectively variable axis tilt, or axis offset, and a continuously and selectively variable toolface angle as shown and described in connection with FIGS. 64 and 68.

When the downhole orientation of the drilling system, or mud motor, 100 is actively managed during a slide, or in the sliding drilling mode, the slide may be initiated with all WOB being applied. In certain applications, including horizontal wells with long lateral sections, the ability to transfer WOB using a traditional mud motor is impaired during sliding due to the larger static coefficients of friction. One technique to apply WOB to a drill bit is to rotate the drill pipe, or drill string, from the Earth's surface, or the drilling rig on the Earth's surface, which allows the drill pipe or drill string, to move downwardly through the borehole, thereby compressing the lower end of the drill string and placing WOB on the bit. During rotation of the drill string, the coefficient of friction is reduced and WOB can be transferred to the bit. An approach can be used with drilling system 100 to extend the length of the borehole beyond that of conventional mud motors in long laterals. The drilling system 100 is rotated from the Earth's surface, and the entire drill string is placed in compression until WOB is transferred to the bit. The downhole orientation, including offset angle and/or toolface angle, of the drilling system, or mud motor, 100 is actively managed during a slide, or in the sliding drilling mode, and the slide may be initiated with all WOB being applied. The borehole will be lengthened until the compressive forces are released and available WOB is removed from the bit. This process can be repeated to lengthen the horizontal borehole and maintain directional orientation of the borehole. With conventional mud motors, this technique does not work successfully. With conventional mud motors, the mud motor must be lifted off-bottom to orient it in the correct direction as previously described, and lifting the mud motor off-bottom removes the compressive force, or WOB, and the mud motor cannot move forward in the borehole. In contrast, the present drilling system, or mud motor, 100 described herein, can readily add the necessary WOB to the drill bit after the WOB has been drilled off, by rotation of the drill pipe, or drill string, which allows the drill pipe, or drill string, to move through the borehole, thereby compressing the lower end of the drill string and placing WOB on the drill bit associated with bit shaft 150. As the present drilling system, or mud motor, 100 does not have to be removed from the borehole to permit adjusting and varying of the axis tilt, or angular offset, as well as to permit adjusting and varying toolface angle, the drilling system 100 may be rotated for a short period of time from the Earth's surface, such as by rotation of the drill pipe, or drill string, and housing 121 associated therewith, whereby WOB may be applied to the drill bit associated with bit shaft 150, which continues drilling operations in a subsequent slide, during which toolface angle and/or axis tilt, or angular offset may be selectively varied and adjusted to permit drilling system 100 to continue drilling operations in the desired direction and orientation. Rotation of the drill string allows drilling system 100 to put WOB onto the bit associated with bit shaft 150 and once the WOB is on the bit associated with bit shaft 150, the drill string is in compression. With the drill string in compression while sliding, and the toolface angle and/or axis tilt, or angular offset, being continuously and selectively adjusted or varied, as previously described, the path, or trajectory of the borehole can be modified or changed as necessary to correct for any errors in direction. The foregoing drilling method, which includes a short rotation period for the drill string from the Earth's surface, can be repeated as necessary to continue to apply WOB to the drill bit after the WOB has been drilled off.

In connection with the foregoing described methods and the phrases "without rotation of the drill pipe, or drill string", "without rotation of the housing 121", "without rotation of the drill string or the housing 121", and similar phrases, such phrases are defined to mean in this specification and its claims that the drill string, or drill pipe, and housing 121 are not intentionally rotated from the Earth's surface as by a drilling rig on the Earth's surface engaging and rotating the upper end of the drill string at the Earth's surface, as is conventional in the art. In this regard, if a drill string is rotated in the previously described method to add WOB to the drill bit 500 of the present drilling system 100, upon ceasing the rotation of the drill string from the Earth's surface, there may be some torsional wind up forces stored in the drill string, which may be thereafter released, once the WOB has been drilled off, which may cause some subsequent, undesired, unintended rotation of the drill string and housing. To the extent the drill string and housing 121 of the present drilling system may experience such subsequent, undesired, unintended rotation, such rotation is excluded from the foregoing definition of the foregoing phrases in the specification and claims. In this regard, an advantage of the present drilling system 100 is that during unintended rotation, during a slide, or in sliding mode, drilling system 100 can compensate for the unwinding, or unintended rotation, of the drill string and maintain a desired toolface angle, by actively managing toolface angle.

Each and every patent or other publication or published document referred to in any portion of this specification is incorporated in toto into this disclosure by reference, as if fully set forth herein.

This invention is susceptible to considerable variation in its practice. Therefore the foregoing description is not intended to limit, and should not be construed as limiting, the invention to the particular exemplifications presented hereinabove.

Except as may be expressly otherwise indicated, the article "a" or "an" if and as used herein is not intended to limit, and should not be construed as limiting, the description or a claim to a single element to which the article refers. Rather, the article "a" or "an" if and as used herein is intended to cover one or more such elements, unless the text expressly indicates otherwise.

That which is claimed is:

1. A method for directionally drilling a portion of a borehole, comprising:

utilizing a drilling system associated with a drill string, the drilling system, including: a bearing section having a housing having a lower end, a longitudinal axis, and an upper bearing assembly and a lower bearing assembly disposed within the housing; an offset shaft, having a lower end and a longitudinal axis, independently rotatable within the housing and a drill bit associated with the lower end of the offset shaft; and the upper and lower bearing assemblies each including a radial bearing and a thrust bearing and provide a variable offset bearing assembly;

moving the drill string until the drill bit of the drilling system contacts a bottom of the borehole;

rotating the offset shaft and drill bit with respect to the housing, while not rotating the drill string and the housing, to drill the portion of the borehole; and while the drill bit is in the borehole drilling the portion of the borehole, permitting axial misalignment between the longitudinal axes of the offset shaft and the housing and managing axial and radial misalignment of the radial and thrust bearings within the housing caused by an axial or a radial force exerted upon the housing and offset shaft.

2. A method for directionally drilling a portion of a borehole, comprising:

utilizing a drilling system associated with a drill string, the drilling system, including: a bearing section having a housing having a lower end, a longitudinal axis, and an upper bearing assembly and a lower bearing assembly disposed within the housing; an offset shaft, having a lower end and a longitudinal axis, independently rotatable within the housing and a drill bit associated with the lower end of the offset shaft; and a biasing mechanism associated with the upper bearing assembly in the bearing section;

moving the drill string until the drill bit of the drilling system contacts a bottom of the borehole;

rotating the offset shaft and drill bit with respect to the housing, while not rotating the drill string and the housing, to drill the portion of the borehole; and while the drill bit is in the borehole drilling the portion of the borehole, operating the biasing mechanism to actively manage an angular relationship between the longitudinal axes of the housing and the offset shaft.

3. The method of claim 2, including lubricating the bearing assemblies with a drilling fluid.

4. The method of claim 2, wherein the biasing mechanism of the drilling system includes a pivot having a mid-point associated with the lower bearing assembly in the housing, the pivot comprising a spherical bearing through which passes the second portion of the offset shaft, and the method further comprises disposing the lower end of the offset shaft a distance from the mid-point of the pivot which is less than 36 inches.

5. The method of claim 2, wherein the drilling system includes a toolface controller, and while the drill bit is in the borehole drilling the portion of the borehole, operating the toolface controller to actively manage a toolface angle of the drill bit.

6. The method of claim 2, wherein the drilling system includes a toolface controller, and after the portion of the borehole has been drilled while not rotating the drill string and the housing, rotating the drill string to cause the drill string to be in compression while the drill bit contacts the bottom of the borehole; rotating the offset shaft and drill bit with respect to the housing, while not rotating the drill string and the housing, to drill an additional portion of the borehole; and while the drill bit is in the borehole drilling the additional portion of the borehole, operating the toolface controller to actively manage a toolface angle of the drill bit.

7. The method of claim 6, wherein the biasing mechanism of the drilling system includes an offset mechanism, and rotating the offset mechanism with the toolface controller to actively manage the tool face of the drill bit.

8. The method of claim 6, including while the drill bit is in the borehole drilling the additional portion of the borehole, operating the biasing mechanism to actively manage the angular relationship between the longitudinal axes of the housing and the offset shaft.

* * * * *